US011399996B2

(12) United States Patent
Kuiper et al.

(10) Patent No.: US 11,399,996 B2
(45) Date of Patent: Aug. 2, 2022

(54) AUTOMATIC PATIENT TURNING AND LIFTING METHOD, SYSTEM, AND APPARATUS

(71) Applicant: Kuiper Kamradt LLC, Indianapolis, IN (US)

(72) Inventors: Hendrik Kuiper, Natchez, MS (US); Brian Kamradt, Indianapolis, IN (US)

(73) Assignee: Kuiper Kamradt LLC, Indianapolis, IN (US)

( * ) Notice: Subject to any disclaimer, the term of this patent is extended or adjusted under 35 U.S.C. 154(b) by 0 days.

(21) Appl. No.: 16/240,058

(22) Filed: Jan. 4, 2019

(65) Prior Publication Data

US 2019/0133857 A1 May 9, 2019

Related U.S. Application Data

(63) Continuation-in-part of application No. 14/514,643, filed on Oct. 15, 2014, now abandoned.
(Continued)

(51) Int. Cl.
*A61G 7/00* (2006.01)
*A61G 7/057* (2006.01)
*A61G 7/10* (2006.01)

(52) U.S. Cl.
CPC ..... *A61G 7/001* (2013.01); *A61G 7/05723* (2013.01); *A61G 7/05776* (2013.01);
(Continued)

(58) Field of Classification Search
CPC ..... A61G 7/10; A61G 7/1013; A61G 7/1021; A61G 7/1023; A61G 7/1026;
(Continued)

(56) References Cited

U.S. PATENT DOCUMENTS 1,772,310 A 8/1930 Hart
3,485,240 A * 12/1969 Fountain ..... A61G 7/001 601/148

(Continued)

FOREIGN PATENT DOCUMENTS

WO WO 02/45655 A2 6/2002

OTHER PUBLICATIONS

International Searching Authority, International Search Report and Written Opinion of the International Searching Authority, PCT/US2014/060595, dated Jan. 28, 2015.

*Primary Examiner* — Eric J Kurilla
*Assistant Examiner* — Amanda L Bailey
(74) *Attorney, Agent, or Firm* — Reichel Stohry Dean LLP; Mark C. Reichel; Natalie J. Dean

(57) ABSTRACT

Automatic patient turning and lifting method, system, and apparatus. An exemplary turning and lifting mattress device discloses herein includes a plurality of left and right inflatable turning bladders, a mattress support structure positioned on the bladders and itself including an outer mattress casing including an inner chamber filled with a plurality of particles, at least one contact surface configured to be in contact with a patient during use, wherein the outer mattress casing is configured to be inflated and evacuated such that the outer mattress casing is capable of being shapeable when inflated, and forms a resilient structure configured to hold its shape when evacuated, and wherein, during use, the at least one contact surface conforms to the shape of a body, the plurality of particles displaced from around the body leaving a depression on the at least one contact surface in the shape of the body.

18 Claims, 46 Drawing Sheets

Related U.S. Application Data

(60) Provisional application No. 61/891,696, filed on Oct. 16, 2013.

(52) U.S. Cl.
CPC ..... *A61G 7/1021* (2013.01); *A61G 7/104* (2013.01); *A61G 2200/32* (2013.01)

(58) Field of Classification Search
CPC ..... A61G 7/05776; A61G 7/001; A61G 7/05738; A61G 7/057; A61G 7/05753; A61G 7/015; A61G 2200/32; A61G 7/104; A61G 7/05723
See application file for complete search history.

(56) References Cited

U.S. PATENT DOCUMENTS 3,717,885 A 2/1973 DeMare
3,762,404 A * 10/1973 Sakita ..... A43B 17/035 602/6
4,934,002 A 6/1990 Watanabe
4,947,500 A * 8/1990 Seiler ..... A47C 27/081 5/706
4,977,629 A * 12/1990 Jones ..... A61G 7/001 5/632
5,103,516 A 4/1992 Stevens
5,121,756 A 6/1992 Koledin
5,138,729 A 8/1992 Ferrand
5,560,057 A 10/1996 Madsen et al.
5,630,238 A 5/1997 Weismiller et al.
5,781,949 A 7/1998 Weismiller et al.
5,966,762 A * 10/1999 Wu ..... A61G 7/05769 5/615
5,966,763 A 10/1999 Thomas et al.
6,095,894 A 8/2000 Stevens
6,115,860 A 9/2000 Vrzalik
6,318,372 B1 11/2001 Hiebert
6,625,831 B2 9/2003 Laughlin
6,826,795 B2 12/2004 Wilkinson
6,892,405 B1 * 5/2005 Dimitriu ..... A61G 7/001 5/609
7,007,330 B2 3/2006 Kuiper et al.
7,080,422 B2 7/2006 Ben-Levi
7,464,422 B2 12/2008 Townsend
7,716,767 B2 5/2010 Bohm et al.
8,196,239 B2 6/2012 Carlson et al.
8,372,182 B2 2/2013 Vrzalik et al.
8,413,274 B2 4/2013 Weismiller et al.
8,429,774 B2 4/2013 Tarsaud et al.
8,533,879 B1 * 9/2013 Taylor ..... A47C 27/082 5/713
8,904,876 B2 12/2014 Taylor et al.
2002/0112287 A1 * 8/2002 Thomas ..... A47C 27/086 5/503.1
2002/0133877 A1 9/2002 Kuiper et al.
2002/0170117 A1 11/2002 Flick et al.
2003/0159219 A1 * 8/2003 Harrison ..... A61G 7/05769 5/713
2005/0193496 A1 9/2005 Weedling et al.
2007/0006388 A1 * 1/2007 Townsend ..... A61G 7/001 5/715
2008/0313816 A1 * 12/2008 Bohm ..... A61G 7/05784 5/713
2010/0242170 A1 9/2010 Richards et al.
2012/0030878 A1 2/2012 Davenport et al.
2012/0317727 A1 12/2012 Tanaka et al.
2013/0000048 A1 1/2013 Lipman et al.
2013/0019408 A1 1/2013 Jacofsky et al.
2014/0007353 A1 * 1/2014 Stryker ..... A61G 7/001 5/715
2014/0143956 A1 5/2014 Mohr

* cited by examiner

1800

2000

AUTOMATIC PATIENT TURNING AND LIFTING METHOD, SYSTEM, AND APPARATUS

PRIORITY & RELATED APPLICATIONS

This application is related to, claims the priority benefit of, and is a U.S. continuation-in-part patent application of, U.S. Nonprovisional patent application Ser. No. 14/514,643, filed Oct. 15, 2014 and entitled "Automatic Patient Turning and Lifting Method, System, and Apparatus," which is related to, and claims the priority benefit of, U.S. Provisional Patent Application Ser. No. 61/891,696, filed Oct. 16, 2013, entitled "Automatic Patient Turning and Lifting Method, System, and Apparatus." The contents of each of these applications are incorporated herein directly and by reference in their entirety.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a system, method, and apparatus for the prevention and treatment of wounds of patient immobility, and, more particularly, to a system, method, and apparatus for implementing automatic patient turning and lifting to prevent and/or treat wounds due to patient immobility.

BACKGROUND

Decubitus ulcers, more commonly known as bedsores, are a common and serious problem for bedridden hospital, nursing home, assistant living, and home care patients. Staff is often required to regularly turn patients over in their beds, as the sores are the result of too much prolonged pressure to the skin, caused by the patient lying on one spot for too long. Turning those patients over can be physically difficult work, and some facilities do not always have enough staff on hand to do the turning as often as needed.

Currently available automatic patient turning and lifting devices either do not possess sufficiently supportive bracketing features that prevent the patient from wandering during the automatic turning process, and/or needlessly confine the patient's arms during the automatic turning process. Such devices also lack the ability to completely remove the pressure to areas on a patient in danger of developing decubitus ulcers.

The embodiments disclosed herein are directed toward overcoming one or more of the problems discussed above.

BRIEF SUMMARY

Various embodiments provide techniques for implementing a system, method, and/or apparatus for automatically turning and lifting patients to inhibit and/or treat wounds caused by patient immobility.

In some embodiments, a patient turning and lifting device may be used to imitate the movements of a healthy person during sleep. The device may roll the patient from side to side to keep the patient from remaining in one position for too long. In some embodiments, the device may bracket the torso of the patient without bracketing (or otherwise limiting the motion) of the patient's arms. The device, in one embodiment, uses a support structure to bracket the torso of the patient. The device may rest on a patient supporting surface, such as, but not limited to, a bed or the like. In some embodiments, the device may be configured to be portable so that the device may be moved to different patient supporting surfaces. The device, in some embodiments, includes left and right turning bladders that, when inflated, cause the device to rotate either to the patient's left side or right side. The sequence, intervals, and timing for rotation from left to right, and vice versa, can be controlled by the care giver and/or controlled based on predetermined settings. Operational data regarding the use and history of use of the device to turn the patient may be stored and downloadable, for documentation and patient history information.

The tools provided by various embodiments include, without limitation, methods, systems, and/or software products. Merely by way of example, a method may comprise one or more procedures, any or all of which may be executed by a computer system. Correspondingly, an embodiment may provide a computer system configured with instructions to perform one or more procedures in accordance with methods provided by various other embodiments. Similarly, a computer program may comprise a set of instructions that are executable by a computer system, or by a processor located in the computer system, to perform such operations. In many cases, such software programs are encoded on physical, tangible, and/or non-transitory computer readable media. Such computer readable media may include, to name but a few examples, optical media, magnetic media, and the like.

In one embodiment, a patient turning and lifting device may include at least one inflatable turning bladder and a support structure coupled to at least one inflatable turning bladder. The support structure, in an embodiment, lies between the at least one inflatable turning bladder and a body of a patient. The support structure may be configured to securely position the at least one turning bladder between the body of the patient and a patient supporting surface.

In some embodiments, the patient turning and lifting device may further include at least one pair of lifting straps positioned underneath the at least one inflatable turning bladder. The lifting straps are capable of supporting the patient and the patient turning and lifting device when lifted. The patient turning and lifting device, in some embodiments, further includes a disposable patient interface layer positionable between the support structure and the body of the patient. In some embodiments, two or more patient turning and lifting devices are attachable to each other via one or more fasteners. For releasable attachment, the one or more fasteners may be releasable fasteners. Exemplary releasable fasteners include, but are not limited to, hook and loop fasteners, adhesives, buttons, zippers, and tabs. For permanent or semi-permanent attachment, the one or more fasteners may be permanent fasteners. Exemplary permanent fasteners include, but are not limited to, adhesives, welding materials, stitching, and heat-activated sealants.

According to some embodiments, the at least one inflatable turning bladder includes left and right inflatable turning bladders. The left and right inflatable turning bladders may be configured to be independently inflatable, independently deflatable, jointly inflatable, or jointly deflatable. The left and right inflatable turning bladders may have a variety of cross-sectional shapes that include, but are not limited to wedge, trapezoid, circle, oval, triangle, and irregular polygon.

In some embodiments, the support structure, in a first state, is a flat structure, while the support structure, in a second state, is a resilient structure that includes sidewalls capable of serving as a bracket for at least a torso of the patient without bracketing arms of the patient. According to some embodiments, the support structure includes a plurality of particles, wherein, when air within the support structure is evacuated, the plurality of particles compact against each other to form a resilient structure comprising sidewalls that support the body of the patient and inhibit the body of the patient from wandering when the patient turning and lifting device is rotated about its longitudinal axis of rotation. The plurality of particles may be generally spherical. The particles may be composed of a polymeric material. Specific materials that may be used to form the particles include, but are not limited to, polystyrene, polyurethane, polyamide, polyethylene oxide, polyvinyl chloride, polypropylene, and polyacrylonitrile. In some embodiments the particles may be composed of a foamed polymer, such as polystyrene foam and/or polyurethane foam.

In some embodiments, the support structure includes a plurality of separate pockets and a plurality of particles in each of the plurality of separate pockets. When air within the support structure is evacuated, the plurality of particles within the plurality of separate pockets are brought together to form a resilient structure which includes sidewalls for supporting the body of the patient and for inhibiting the body of the patient from wandering when the patient turning and lifting device is rotated about its longitudinal axis of rotation.

According to some embodiments, the support structure, in a first state, is a non-rigid, foldable structure, while the support structure, in a second state, is a resilient flat structure. The support structure may also include a first fastener on an upper surface thereof and one or more resilient blocks each block having a second fastener on one or more surfaces thereof. The first and second fasteners are configured to couple to each other to removably affix the one or more resilient blocks to the upper surface of the support structure, so as to bracket at least a torso of the body of the patient. In some embodiments, each of the one or more resilient blocks is in the shape of a triangular prism having two triangular end surfaces and three rectangular side surfaces. The second fastener may be provided on two or more of the three rectangular side surfaces. Rotation of each of the one or more resilient blocks may cause a change in an angle of contact of one or more of the resilient blocks with the patient.

In some embodiments, the support structure, in a first state, is a non-rigid, foldable structure. When air is evacuated from the support structure, while the patient is positioned on a top surface of the support structure, the support structure changes to a second state having a resilient structure that includes a depression in the top surface conforming to the body of the patient. Such a depression may comfortably and securely bracket the body of the patient to prevent the patient's body from wandering during patient turning and lifting.

In another embodiment, a patient turning and lifting system includes one or more pumps coupled to a patient turning and lifting device. One or more of the pumps may be fluid pumps that are configured to pump a fluid. For example, fluids that may be pumped include, but are not limited to, air, carbon dioxide, nitrogen, water, organic liquids, inert gases, and gas mixtures other than air. In other embodiments, one or more of the pumps may be vacuum pumps. The patient turning and lifting device includes at least one inflatable turning bladder and a support structure. The support structure, in an embodiment, is positioned between at least one inflatable turning bladder and a patient. The support structure may also be configured to securely position at least one turning bladder between the patient and a patient supporting surface.

In some embodiments, the system may include one or more sensors configured to monitor one or more of the pumps, at least one inflatable turning bladder, the support structure, or any combination of these components. At least one inflatable turning bladder may include left and right inflatable turning bladders that are inflatable and deflatable by one or more pumps in one or more predetermined sequences of inflation and deflation. The one or more predetermined sequences of inflation and deflation may be modified based, at least in part, on measurements by one or more of the sensors.

In yet another embodiment, a patient turning and lifting system includes one or more processors and a non-transitory computer readable medium having stored thereon software comprising a set of instructions that, when executed by at least one of the one or more processors, causes the patient turning and lifting system to perform one or more functions. The set of instructions may include instructions to inflate and/or deflate left and right inflatable turning bladders in one or more predetermined sequences of inflation and deflation. The set of instructions may also include instructions to monitor, via one or more sensors, one or more of the left and right inflatable turning bladders, one or more pumps configured to inflate and/or deflate the left and right inflatable turning bladders, and a support structure that is positioned between the inflatable turning bladders and the patient. The set of instructions may also include instructions to modify the one or more predetermined sequences of inflation and deflation based at least in part on measurements by the one or more sensors.

Various modifications and additions can be made to the embodiments discussed without departing from the scope of the invention. For example, while the embodiments described above refer to particular features, the scope of this invention also included embodiments having different combination of features and embodiments that do not include all of the above described features.

At least one embodiment of a patient turning and lifting mattress device of the present disclosure comprises a plurality of left inflatable turning bladders and a plurality of right inflatable turning bladders; a mattress support structure positioned on the plurality of left and right inflatable turning bladders, comprising; an outer mattress casing comprising an inner chamber filled with a plurality of particles; at least one contact surface configured to be in contact with a patient during use; wherein the outer mattress casing is configured to be inflated and evacuated such that the outer mattress casing is capable of being shapeable when inflated, and forms a resilient structure configured to hold its shape when evacuated; wherein, during use, the at least one contact surface conforms to the shape of a body, the plurality of particles displaced from around the body leaving a depression on the at least one contact surface in the shape of the body; and wherein each of the plurality of left and right inflatable turning bladders are independently inflatable and deflatable from each other and the mattress support structure.

In at least one embodiment of a patient turning and lifting mattress device of the present disclosure, at least one of the plurality of left turning bladders and right turning bladders overlap.

In at least one embodiment of a patient turning and lifting mattress device of the present disclosure, each of the plurality of left turning bladders and right turning bladders has a general shape selected from the group consisting of wedge, trapezoid, circle, sphere, oval, triangle, and irregular polygon.

In at least one embodiment of a patient turning and lifting mattress device of the present disclosure, at least one of the plurality of left turning bladders and at least one of the plurality of right turning bladders are fluidly connected via one or more hoses.

In at least one embodiment of a patient turning and lifting mattress device of the present disclosure, the mattress support structure comprises a plurality of separate pockets, each pocket of the plurality of separate pockets comprising a plurality of particles, wherein the plurality of separate pockets are configured such that, when air within the mattress support structure is evacuated, the plurality of particles within the plurality of separate pockets are brought together by negative pressure to form a resilient structure comprising sidewalls.

In at least one embodiment of a patient turning and lifting mattress device of the present disclosure, the patient turning and lifting mattress device further comprises one or more sensors configured to monitor at least one of: one or more pumps in fluid communication with the plurality of left and right inflatable turning bladders or the mattress support structure; at least one of the plurality of left and right inflatable turning bladders; or the mattress support structure.

In at least one embodiment of a patient turning and lifting mattress device of the present disclosure, each of the plurality of left and right inflatable turning bladders is inflatable and deflatable by the one or more pumps in one or more predetermined sequences of inflation and deflation, wherein the one or more predetermined sequences of inflation and deflation are controlled by a controller, and wherein the controller modifies the predetermined sequences of inflation and deflation based, at least in part, on measurements by the one or more sensors.

In at least one embodiment of a patient turning and lifting mattress device of the present disclosure, the one or more sensors further comprises at least one sensor for detecting at least a pressure distribution and a pressure magnitude on a detecting surface.

In at least one embodiment of a patient turning and lifting mattress device of the present disclosure, the at least sensor is a piezo-resistive pressure sensor.

At least one embodiment of a patient turning and lifting mattress device of the present disclosure comprises at least one inflatable left turning bladder and at least one inflatable right turning bladders; a support structure positioned on the at least one inflatable left turning bladder and on the at least one inflatable right turning bladder, comprising; an outer casing comprising an inner chamber filled with a plurality of particles; at least one contact surface configured to be in contact with a patient during use; wherein the outer casing is configured to be inflated and evacuated such that the outer casing is capable of being shapeable when inflated, and forms a resilient structure configured to hold its shape when evacuated; wherein, during use, the at least one contact surface conforms to the shape of a body, the plurality of particles displaced from around the body leaving a depression on the at least one contact surface in the shape of the body; wherein each of the at least one left inflatable turning bladder and the at least one right inflatable turning bladder are independently inflatable and deflatable from each other and the support structure.

In at least one embodiment of a patient turning and lifting mattress device of the present disclosure, the at least one of the left inflatable turning bladder comprises a plurality of separate left inflatable turning bladders, and the at least one right inflatable turning bladder comprises a plurality of separate right inflatable turning bladders.

In at least one embodiment of a patient turning and lifting mattress device of the present disclosure, at least one of the inflatable left turning bladders and at least one of the inflatable right turning bladders overlap.

In at least one embodiment of a patient turning and lifting mattress device of the present disclosure, the support structure comprises a mattress.

In at least one embodiment of a patient turning and lifting mattress device of the present disclosure, each of the least one left and right inflatable turning bladders has a general shape selected from the group consisting of wedge, trapezoid, circle, sphere, oval, triangle, and irregular polygon.

In at least one embodiment of a patient turning and lifting mattress device of the present disclosure, at least one of the left turning bladders and at least one of the right turning bladders are fluidly connected via one or more hoses.

In at least one embodiment of a patient turning and lifting mattress device of the present disclosure, the support structure comprises a plurality of separate pockets, each pocket of the plurality of pockets comprising a plurality of particles, wherein the plurality of separate pockets are configured such that, when air within the support structure is evacuated, the plurality of particles within the plurality of separate pockets are brought together by negative pressure to form a resilient structure comprising sidewalls.

In at least one embodiment of a patient turning and lifting mattress device of the present disclosure, the patient turning and lifting device further comprises one or more sensors configured to monitor at least one of: one or more pumps in fluid communication with the at least one left inflatable turning bladder, the at least one right inflatable turning bladder, or the support structure; at least one of the left or right inflatable turning bladders; or the support structure.

In at least one embodiment of a patient turning and lifting mattress device of the present disclosure, each of the at least one left and right inflatable turning bladders is inflatable and deflatable by the one or more pumps in one or more predetermined sequences of inflation and deflation, wherein the one or more predetermined sequences of inflation and deflation are controlled by a controller, and wherein the controller modifies the predetermined sequences of inflation and deflation based, at least in part, on measurements by the one or more sensors.

In at least one embodiment of a patient turning and lifting mattress device of the present disclosure, the one or more sensors further comprises at least one sensor for detecting at least a pressure distribution and a pressure magnitude on a detecting surface.

In at least one embodiment of a patient turning and lifting mattress device of the present disclosure, the at least sensor is a piezo-resistive pressure sensor.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

Figure 1:
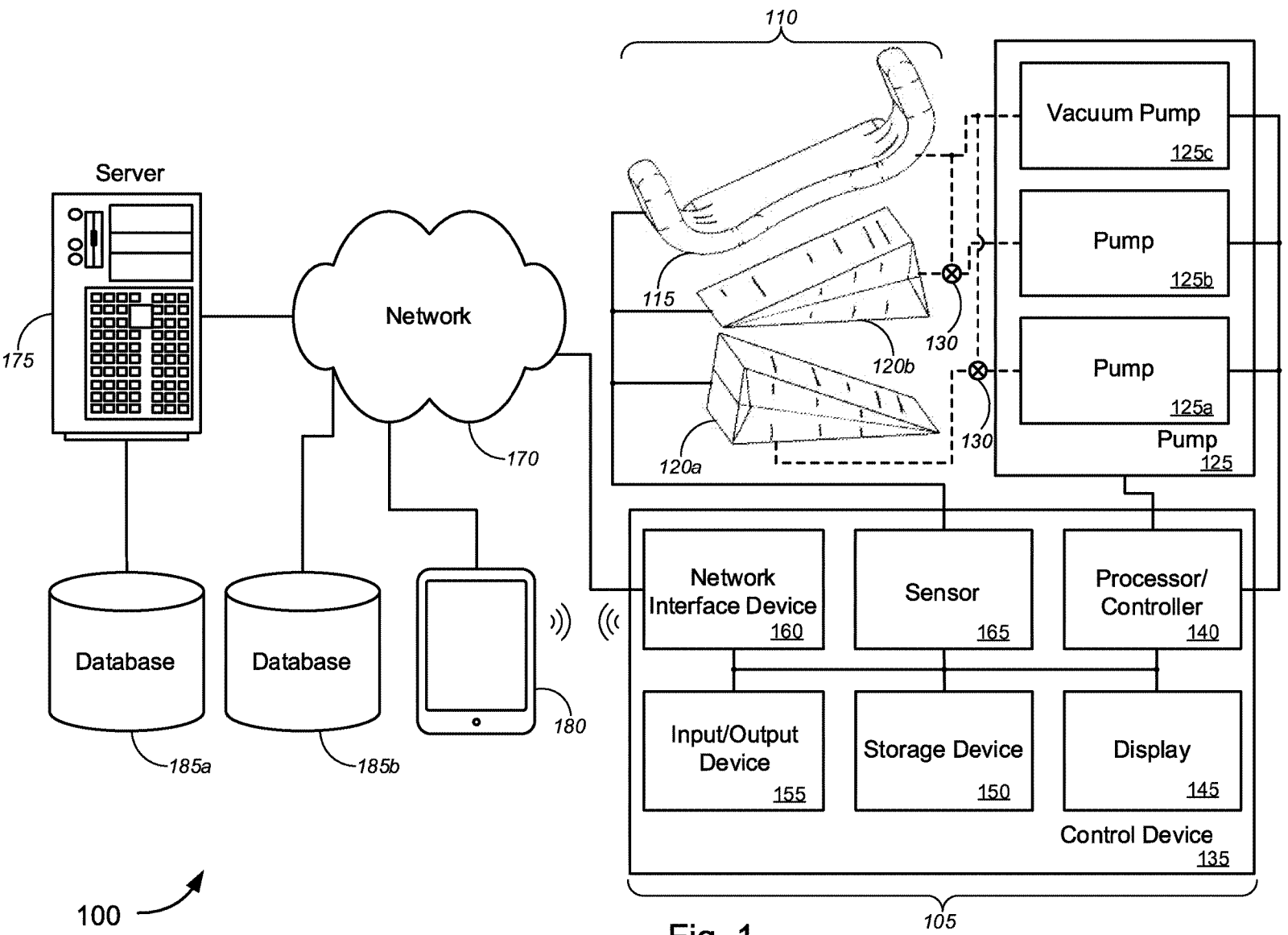
FIG. 1 is a general schematic diagram illustrating a system for implementing automatic patient turning and lifting, in accordance with various embodiments.

As such, an overview of the features, functions and/or configurations of the components depicted in the various figures will now be presented. It should be appreciated that not all of the features of the components of the figures are necessarily described and some of these non-discussed features (as well as discussed features) are inherent from the figures themselves. Other non-discussed features may be inherent in component geometry and/or configuration. Furthermore, wherever feasible and convenient, like reference numerals are used in the figures and the description to refer to the same or like parts or steps. The figures are in a simplified form and not to precise scale.

DETAILED DESCRIPTION

While various aspects and features of certain embodiments have been summarized above, the following detailed description illustrates a few embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. In other instances, certain structures and devices are shown in block diagram form. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers used herein to express quantities, dimensions, and so forth used should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Various embodiments provide techniques for implementing a system, method, and/or apparatus for automatically turning and lifting patients to inhibit and treat wounds caused by patient immobility, including, but not limited to, decubitus ulcers, more commonly known as bedsores.

In some embodiments, a patient turning and lifting device may be used to imitate the movements of a healthy person during sleep. The device may roll the patient from side to side to keep the patient from remaining in one position for too long. In some embodiments, the device may bracket the torso of the patient without bracketing (or otherwise limiting the motion) of the patient's arms. The device, in one embodiment, uses a support structure to bracket the torso of the patient. In some instances, the device may bracket the patient's neck (or head) during the automatic turning and lifting process. The device may rest on a patient supporting surface, including, but not limited to, a bed, a cot, a mattress, a floor, the ground, or the like, and may be configured to be portable so that the device may be moved to different patient supporting surfaces.

The device, in some embodiments, includes left and right turning bladders that, when inflated, cause the device to rotate either to the patient's left side or right side. The shape of each of the left and right turning bladders is configured to facilitate the rotation of the patient to the patient's other side. For example, the left and right turning bladders may each have a general cross-sectional shape that is one of a wedge shape, a trapezoid, a circle, an oval, a triangle, or an irregular polygon. In operation, inflation of the right turning bladder (which is located underneath the patient's right side) will raise the right side of the patient's body relative to the left side of the patient's body, and thus result in rotation of the device (together with the patient) about a longitudinal axis of rotation of the device toward the patient's left side. Similarly, inflation of the left turning bladder (which is located underneath the patient's left side) will function in a similar manner to result in rotation of the device (together with the patient) about a longitudinal axis of rotation of the device toward the patient's right side.

The sequence, intervals, and timing for rotation from left to right, and vice versa, can be controlled by the care giver and/or controlled based on predetermined settings. Operational data regarding the use and history of use of the device to turn the patient may be stored and downloadable, for documentation and patient history information. In some embodiments, the left and right inflatable turning bladders may be configured to be independently inflatable, independently deflatable, jointly inflatable, and/or jointly deflatable.

Herein, the phrase "disposable patient interface layer" refers to a fabric (e.g., linen, etc.), plastic, or other material layer on which a patient may rest, that separates the support structure (and the other portions of the patient turning and lifting device) from direct contact with the patient, e.g., for sanitary and hygiene reasons. Although the patient interface layer, in some embodiments, is intended to be one-time use only and is intended to be discarded after use, the patient interface layer, in other instances, may be laundered and/or otherwise sanitized for future use by the same patient or by other patients.

The term "right inflatable turning bladder" refers to the inflatable turning bladder that is located underneath the right side of the patient's body when the patient is positioned in or on the patient turning and lifting device, while the term "left inflatable turning bladder" refers to the inflatable turning bladder that is located underneath the left side of the patient's body when the patient is positioned in or on the patient turning and lifting device. The left and right inflatable turning bladders may have a variety of cross-sectional shapes that include, but are not limited to, wedge, trapezoid, circle, oval, triangle, and irregular polygon. Each turning bladder may be filled with air, carbon dioxide, nitrogen, water, organic liquids, inert gases, and gas mixtures other than air. The turning bladders may be evacuated of such fluid with the use of an appropriate pump, such as a fluid pump or a vacuum pump. Herein, the term "air" refers to atmospheric air (or the combination of gases constituting atmospheric air), while the term "gas" refers to either a gaseous substance or a combination of gases where the gaseous substance or the combination of gases is other than atmospheric air.

The term "longitudinal axis of rotation" refers to an axis of rotation of the device that is parallel to an axis running through the body of the patient from head to toe, when the patient in positioned in or on the device. The term "longitude" or "longitudinal chambers" refers to a side of a component of the device or chambers in the turning bladders that extends in a direction parallel to the "longitudinal axis of rotation."

We now turn to the embodiments as illustrated by the drawings. FIGS. 1-12 illustrate some of the features of the method, system, and apparatus for the inhibition and treatment of wounds of patient immobility and/or for implementing automatic patient turning and lifting, both as referred to above. The methods, systems, and apparatuses illustrated by FIGS. 1-12 refer to examples of different embodiments that include various components and steps, which can be considered alternatives or which can be used in conjunction with one another in the various embodiments. The description of the illustrated methods, systems, and apparatuses shown in FIGS. 1-12 is provided for purposes of illustration and should not be considered to limit the scope of the different embodiments.

With reference to the figures, FIG. 1 is a general schematic diagram illustrating a system 100 for implementing automatic patient turning and lifting, in accordance with various embodiments. As shown in FIG. 1, system 100 includes a patient turning and lifting system 105, which includes patient turning and lifting device 110, pump system 125, and control device 135. System 100, in some embodiments, includes network 170, server 175, user device 180, and one or more databases 185 (which may include a database 185*a* local to server 175 and/or a database 185*b* remote to server 175 and/or user device 180).

Patient turning and lifting device 110 includes a support structure 115 and at least one set of inflatable turning bladders 120. The at least one set of inflatable bladders 120 may include a right inflatable turning bladder 120*a* and a left inflatable turning bladder 120*b*. Support structure 115 may include an outer casing and a plurality of particles contained within the outer casing. The outer casing may be made of a material including, without limitation, polyurethane, polyvinyl chloride ("PVC"), polyethylene, polypropylene, or some other similar polymeric material, and the like. The plurality of particles may be generally spherical. The particles may be composed of a polymeric material. Specific materials that may be used to form the particles include, but are not limited to, polystyrene, polyurethane, polyamide, polyethylene oxide, polyvinyl chloride, polypropylene, and polyacrylonitrile. In some embodiments the particles may be composed of a foamed polymer, such as polystyrene foam and/or polyurethane foam. The average size of the particles may be approximately ¼ inch (~6.35 mm), ⅛ inch (~3.18 mm), 1/10 inch (~2.54 mm), 3/32 inch (~2.38 mm), or 9/100 inch (~2.29 mm) in diameter, or smaller. Each of the plurality of particles may have smooth or rough surfaces, and may be substantially spherical or irregularly shaped.

Pump system 125 may include one or more pumps. In some embodiments, pump system 125 includes a first pump 125*a*, a second pump 125*b*, and a vacuum pump 125*c*. The first pump 125*a* may be in fluid communication with the right inflatable turning bladder 120*a*, while the second pump 125*b* may be in fluid communication with the left inflatable turning bladder 120*b*. Each of the first and second pumps 125*a*, 125*b* may be a fluid pump that is configured to pump one or more of the following fluids: air, carbon dioxide, nitrogen, water, organic liquids, inert gases, and gas mixtures other than air. In FIG. 1, the fluid communication is represented by dashed lines, with each valve symbol depicting one or more valves 130 or one or more manifolds 130, while electrical or non-fluid communications (either wireless or wired) are represented by solid lines.

The vacuum pump 125*c* may be in fluid communication with the support structure 115, such that, after the vacuum pump 125*c* evacuates air or gas from support structure 115, the plurality of particles (which may be either free flowing within the entire interior of the support structure 115 or held within separated pockets distributed within the interior of support structure 115) compress or compact against each other to form a resilient and/or rigid structure. In some embodiments, the materials mentioned above for the particles (e.g., polystyrene, polyurethane, polyamide, polyethylene oxide, polyvinyl chloride, polypropylene, and polyacrylonitrile) may be selected to facilitate formation of the resilient and/or rigid structure.

In some embodiments, separate fluid pumps 125*a*, 125*b* may be communicatively coupled to each of the left and right inflatable turning bladders 120*a*, 120*b*, and may be coupled to support structure 115, while separate vacuum pumps 125*c* may be communicatively coupled to each of these components of the patient turning and lifting device 110. In some cases, a single fluid pump may be communicatively coupled via either one or more manifold devices 130 and/or one or more valves 130, so as to selectively pump fluid into each of one or more of these components. Similarly, a single vacuum pump may be communicatively coupled via either the one or more manifold devices 130 and/or the one or more valves 130, so as to selectively pump vacuum into (i.e., evacuate fluid out of) each of one or more of these components. According to some embodiments, rather than using separate fluid pump(s) and separate vacuum pump(s), one or more pumps (referred to herein as "two-way pumps") may be configured to pump fluid into the left and/or right inflatable turning bladders when set in a first state, while being configured to reverse the pumping action so as to pump fluid out of the left and/or right inflatable turning bladders and out of the support structure when set in a second state. Such two-way pumps may be coupled to the left and right inflatable turning bladders and the support structure via one or more manifold devices 130 and/or one or more valves 130 (which may be interior or exterior to pump system 125), in a similar manner as described above.

The patient turning and lifting (or more specifically, the inflation and deflation of the components of the patient turning and lifting device 110) may be controlled by the control device 135, which includes a processor/controller 140, and, in some embodiments, one or more of a display 145, a storage device 150, an input/output device 155, a network interface device 160, and one or more sensors 165. The processor/controller 140 may be configured to control the pump system 125 (including any manifold devices 130 and/or valves 130) to inflate and deflate the left and right inflatable turning bladders, so as to automatically turn or rotate the patient about the longitudinal axis of rotation of the device 110, in one or more predetermined sequences of inflation and deflation, which sequences may be stored in storage device 150. The one or more sensors 165 may include, without limitation, pressure sensors, flow sensors, leak sensors, or any other suitable sensors, or the like. In some embodiments, the one or more sensors 165 may further include one or more patient sensors—including, but not limited to, an oximeter, a blood pressure sensor, heart-rate or pulse monitor, or the like—that monitor the patient's status and responses, particularly during the automatic turning and lifting process. In further embodiments, the one or more sensors 165 may further include one or more pressure sensor configured to measure at least a pressure magnitude and distribution, as will be described in further detail with relation to FIG. 20. In some instances, the control device 135 may be communicatively coupled to existing patient monitoring devices that would typically be hooked up to the patient in a hospital setting to monitor blood oxygen levels, blood pressure, heart-rate or pulse, or the like. The measurements or readings from the one or more sensor 165, in some embodiments, are fed back into the processor/controller 140 to select or modify the one or more predetermined sequences of inflation and deflation.

The display 145 may include, without limitation, one or more touchscreen displays, one or more non-touchscreen displays, or a combination of touchscreen and non-touchscreen displays. The storage device 150 and/or database 185 may be any suitable machine readable medium or computer readable medium, including, but not limited to, a disk drive, a drive array, an optical storage device, and a solid-state storage device. The disk drive may include, without limitation, an internal disk drive, a portable disk drive, a floppy disk drive, an optical disk drive (e.g., a compact disc read-only memory ("CD-ROM") drive, a digital versatile disk or digital video disk ("DVD") drive, a Blu-Ray™ disk drive, or the like), a flash drive, or the like. The solid-state storage device includes, but is not limited to, one or more of a random access memory ("RAM") or a read-only memory ("ROM"), which can be programmable, flash-updateable, or the like. Such storage devices may be configured to implement any appropriate data stores, including, without limitation, various file systems, database structures, or the like. In some embodiments, the operational data regarding the use and history of use of the patient turning and lifting device 110, the patient turning and lifting system 105, or both, may be stored in storage device 150, and/or uploadable to database 185*a* or 185*b* for storage therein, for documentation and patient history updates. The operational data may subsequently be accessed or downloaded from storage device 150 and/or database 185*a* or 185*b* by the patient or by the user (e.g., physician, specialist, nurse, or other healthcare professional) to view the patient's use and/or history of use of the device 110 and system 105. In some cases, the patient history of the patient may also be stored in database 185*a* or 185*b*, and may be accessed together with the use and/or history of use of the device 110 and system 105.

The terms "machine readable medium" and "computer readable medium," as used herein, refer to any medium that participates in providing data that causes a machine to operate in a specific fashion. In many implementations, a computer readable medium is a non-transitory, physical, or tangible storage medium. Such a medium may take many forms, including, but not limited to, non-volatile media, volatile media, and transmission media. Non-volatile media includes, for example, optical disks, magnetic disks, or both. Volatile media includes, without limitation, dynamic memory. Transmission media includes, without limitation, coaxial cables, copper wire and fiber optics, including the wires that are part of a bus of the device 135, as well as the various components of the network interface device 160, or the media by which network interface device 160 provides communication with other devices. Hence, transmission media can also take the form of waves, including without limitation radio, acoustic, or light waves, such as those generated during radio-wave and infra-red data communications. Common forms of physical or tangible computer readable media include, for example, a floppy disk, a flexible disk, a hard disk, magnetic tape, or any other magnetic medium; a CD-ROM, DVD-ROM, Blu-Ray™ or any other optical medium; punch cards, paper tape, or any other physical medium with patterns of holes; a RAM, a PROM, an EPROM, a FLASH-EPROM, or any other memory chip or cartridge; a carrier wave; or any other medium from which a computer can read instructions or code.

In an embodiment, the input/output device 155 includes a physical interface, which may include, without limitation, one or more keypads, one or more buttons, one or more switches, one or more toggles, one or more dials, a touchscreen display (e.g., touchscreen display 145, in the case that display 145 includes a touchscreen display), or any combination thereof. The network interface device 160 may be any suitable network interface device including, but not limited to, a modem, a network card (wireless or wired), an infra-red communication device, a wireless communication device or chipset, or the like. The wireless communication device may include, but is not limited to, a Bluetooth™ device, an 802.11 device, a WiFi device, a WiMax device, a WWAN device, cellular communication facilities, or the like. The network interface device 160 may permit data to be exchanged with a network (such as network 170, to name an example), with other devices (e.g., user device 180), with any other devices described herein, or with any combination of network, systems, and devices. According to some embodiments, network 170 may include a local area network ("LAN"), including without limitation a fiber network, an Ethernet network, a Token-Ring™ network, and the like; a wide-area network ("WAN"); a wireless wide area network ("WWAN"); a virtual network, such as a virtual private network ("VPN"); the Internet; an intranet; an extranet; a public switched telephone network ("PSTN"); an infra-red network; a wireless network, including without limitation a network operating under any of the IEEE 802.11 suite of protocols, the Bluetooth™ protocol, or any other wireless protocol; or any combination of these or other networks.

In some instances, the actual sequences of inflation and deflation of the patient turning device 110—as determined based on the instructions provided by processor/controller 140 to pump system 125, based on the measurements or readings of the one or more sensors, or both—may be stored in storage device 150, which may include a storage capacity sufficient to record such use of the device 110 for at least three months, with the storage device 150 being upgradable to higher storage capacities for storing records of use for longer durations and/or for storing records of use for more than one patient. Alternatively, or additionally, such records of use may be sent or backed-up over network 170 to be stored on one or more databases 185 remote from control device 135.

According to some embodiments, a user (such as a physician, medical specialist, nurse, orderly, or other healthcare professional, or other caregiver) may manually interact with the patient turning and lifting system 105, by interacting with input/output device 155 (and/or, in the case that display 145 is a touchscreen display, touchscreen display 145). Alternatively, or in addition, the same user or a different user (who may also be a physician, medical specialist, nurse, orderly, or other healthcare professional, or other caregiver) may interact remotely with the patient turning and lifting system 105, via server 175 or user device 180 over network 170, via the network interface device 160. The user device 180, in some cases, may include, without limitation, a desktop computer, a laptop computer, a tablet computer, a smart phone, a mobile phone, a personal digital assistant ("PDA"), or a remote control device, and the like. In some cases, the user device 180 may be communicatively coupled to the network interface device 160 either wirelessly (e.g., according to any of the IEEE 802.11 suite of protocols, the Bluetooth™ protocol, or any other wireless protocol) or via wired connection, and either directly with the network interface device 160 or via network 170. In some examples, user device 180 may interact with the patient turning and lifting system 105 via a secure website hosted on server 175 that may be communicatively coupled to control device 135 via network 170. In any event, server 175 and/or user device 180 may be provided with not only control of the patient turning and lifting system 105, but also access to the records of use of the patient turning and lifting system 105 by the one or more patients being treated using the patient turning and lifting device 110, and/or access to patient records.

We now turn to FIGS. 2A-2H (collectively, "FIG. 2"), which are general schematic diagrams illustrating various views of a portable device 200 for automatic patient turning and lifting, in accordance with various embodiments. In FIG. 2, patient turning and lifting device 200 comprises a support structure 205, one or more sets of inflatable turning bladders 210, one or more pairs of lifting straps 215, and a disposable patient interface layer 225.

Support structure 205 includes sidewalls 205*a* and 205*b* that serve to bracket the torso of a patient, without bracketing the arms of the patient. Support structure 205 also includes a main body 205*c* on which the patient's body is intended to rest, particularly when the patient turning and lifting device 200 is not rotated (i.e., not activated). Support structure 205 also includes an outer casing and a plurality of particles contained within the outer casing. The outer casing may be made of any suitable material including, but not limited to, polyurethane, polyvinyl chloride ("PVC"), polyethylene, polypropylene, or some other similar polymeric material, and the like. The plurality of particles may be generally spherical. The particles may be composed of a polymeric material. Specific materials that may be used to form the particles include, but are not limited to, polystyrene, polyurethane, polyamide, polyethylene oxide, polyvinyl chloride, polypropylene, and polyacrylonitrile. In some embodiments the particles may be composed of a foamed polymer, such as polystyrene foam and/or polyurethane foam. The average size of the particles may be approximately ¼ inch (~6.35 mm), ⅛ inch (~3.18 mm), 1/10 inch (~2.54 mm), 3/32 inch (~2.38 mm), or 9/100 inch (~2.29 mm) in diameter, or smaller. Each of the plurality of particles may have smooth or rough surfaces, and may be substantially spherical or irregularly shaped. In some cases, support structure 205 may be composed of a plurality of separate pockets distributed throughout the interior of the outer casing. Each of the separate pockets includes a plurality of particles. The separate pockets may be made of any suitable material that is able to hold the particles, while allowing air or gas to pass therethrough. Suitable materials for forming pockets in the support structure include, but are not limited to, cotton, linen, and perforated plastics (such as perforated versions of the material used for the outer casing), or the like.

In a first state, support structure 205 is substantially flat or at least non-rigid (i.e., flexible or floppy), with air or gas held within the outer casing, such that the plurality of particles are free to move about the interior of support structure 205 and/or free to move relative to each other. In a second state, when the air or gas is caused to be evacuated from the outer casing (e.g., via pump system 125, as described above), the plurality of particles are forced to compact or compress against each other, so as to form a resilient and/or substantially rigid structure. In some embodiments, prior to evacuating the air or gas from support structure 205, a user (such as a doctor, nurse, orderly, or other healthcare professional, or other caregiver) lifts the portions of the support structure that are intended to form the sidewalls 205*a* and 205*b* so that these portions are substantially perpendicular to the main body 205*c*. After evacuation of the air or gas, the resilient and/or substantially rigid structure holds the shape of the sidewalls 205*a* and 205*b*.

According to some examples, the outer casing of support structure 205 may include stitching or other suitable fabric/material limiting structures that cause the portions that are intended to form the sidewalls 205*a* and 205*b* to automatically lift into place substantially perpendicular to the main body 205*c* upon evacuation of the air or gas, without any need for manual manipulation of any portion of support structure 205 by a user. For example, the side of support structure 205 that is facing the patient may be provided with slightly less material compared with the side facing the inflatable turning bladders 210 (or the patient support surface (e.g., mattress, bed, cot, floor, ground, etc.)).

In the illustrated embodiment, the one or more sets of inflatable turning bladders 210 include right inflatable turning bladders 210*a* and left inflatable turning bladders 210*b*. In the example of FIG. 2, the right and left inflatable turning bladders 210*a* and 210*b* have a triangular, bellow-shaped profile (or cross-sectional shape), and substantially completely overlap one on top of the other (e.g., as depicted in the exploded view of FIG. 2F). The right and left inflatable turning bladders 210*a* and 210*b* include one or more gas or pump interfaces 220 (including, for example, a gas or air nipple, a gas or air valve, a gas pipe, or the like) for interfacing with fluid hoses or pipes that connect to one or more pumps (e.g., fluid and/or vacuum pumps of pump system 125, as described above). According to some embodiments, each of the right and left inflatable turning bladders 210*a* and 210*b* are composed of a single chamber that may be filled with fluid to turn and/or lift a side of the patient. In alternative embodiments, each of the right and left inflatable turning bladders 210*a* and 210*b* include a plurality of longitudinal chambers, one chamber being nested within an adjacent outer chamber, the plurality of longitudinal chambers being configured to be inflatable sequentially from an innermost chamber to an outermost chamber, and being configured to inflate less than all of the plurality of longitudinal chambers. Such nested longitudinal chambers may provide, for example, greater support along the longitudinal axis (i.e., the longitudinal axis of the patient extending from head to toe) of the patient turning and lifting device 200, as the inflatable bladder is being inflated or deflated. In some embodiments, the longitudinal chambers may have a general profile or cross-sectional shape that is the same or similar to the overall profile or cross-sectional shape of each of the left and right inflatable turning bladders 210*a* and 210*b*.

The one or more pairs of lifting straps 215 each include a strap body 215*a* with one or more handles 215*b* formed therein. Two or more of: support structure 205; inflatable turning bladders 210; or lifting straps 215 that may, in some instances, be attachable to each other via one or more fasteners, in either a releasable, semi-permanent, or permanent manner. For a releasable attachment, the one or more fasteners may include, without limitation, hook and loop fasteners, adhesive, buttons, and/or tabs. For semi-permanent, or permanent, attachment, the one or more fasteners may include, but are not limited to, adhesive, welding material, stitching, and heat-activated sealant. In one embodiment, two or more of: support structure 205; inflatable turning bladders 210; or lifting straps 215 are affixed to each other via welding (such as radio-frequency ("RF") welding), or the like. The one or more pairs of lifting straps 215 allow one or more users (e.g., healthcare professionals) to lift the patient turning and lifting device 200 with the patient secured therein, such as to transfer the patient from one patient support surface (e.g., bed, cot, floor, ground, etc.) to another patient support surface, or to reposition the patient on the same patient support surface. In some instances, strap body 215*a* may be made of a non-stretchable material to facilitate lifting.

The disposable patient interface layer 225 may be any suitable layer that serves to separate support structure 205 (or the patient turning and lifting device 200) from the patient (i.e., to prevent direct contact with the patient's body), for sanitary and/or hygiene reasons. In one embodiment, disposable patient interface layer 225 includes a main layer body 225*a* that substantially covers main body 205*c* of support structure 205 and wing portions 225*b* that extend from either side of the main layer body 225*b* that substantially covers sidewalls 205*a* and 205*b*. In some cases, wing portions 225*b* include pockets 225*c* that are configured to fit over corresponding sidewalls 205*a* and 205*b* (as depicted, e.g., in FIG. 2H), so as to prevent substantial movement of the disposable patient interface layer 225 with respect to support structure 205.

In operation, the user (e.g., physician, medical specialist, nurse, orderly, or other healthcare professional, or other caregiver) interacts with the control device (e.g., control device 135) of patient turning and lifting device 200 so as to cause the pump system (e.g., pump system 125) to inflate and deflate right and left inflatable turning bladders 210*a* and 210*b* in one or more predetermined sequences of inflation and deflation (as described in detail above with respect to FIG. 1, either directly or indirectly, either wirelessly or in a wired manner, or the like). During the one or more predetermined sequences of inflation and deflation, right inflatable turning bladders 210*a* are filled with fluid (including, without limitation, air, carbon dioxide, nitrogen, water, organic liquids, inert gases, and gas mixtures other than air), which causes the right side of the patient's body to be lifted with respect to the patient support surface, while the left side remains close to the patient support surface (see, e.g., FIGS. 2B and 2C). In other words, inflation of the right inflatable turning bladders 210*a* causes rotation of patient turning and lifting device 200 (and the patient secured thereon) about a longitudinal axis of rotation of the device 200, so that the patient is rotated or turned onto or toward the patient's left side. During a different portion of the one or more predetermined sequences of inflation and deflation, left inflatable turning bladders 210*b* are filled with fluid (including, without limitation, air, carbon dioxide, nitrogen, water, organic liquids, inert gases, and gas mixtures other than air), which causes the left side of the patient's body to be lifted with respect to the patient support surface, while the right side remains close to the patient support surface (see, e.g., FIGS. 2D and 2E). In other words, inflation of left inflatable turning bladder 210*b* causes rotation of patient turning and lifting device 200 (and the patient secured thereon) about a longitudinal axis of rotation of the device 200, so that the patient is rotated or turned onto or toward the patient's right side. During other parts of the one or more predetermined sequences of inflation and deflation, patient turning and lifting device 200 (and the patient secured thereon) may be in a state of rotation between the full right rotation and full left rotation.

According to some embodiments, full rotation (or full inflation) of each inflatable turning bladders may result in a maximum angle of rotation (in the corresponding direction) of about 25 degrees and, in some cases, about 20 degrees, about 30 degrees, or about 35 degrees. In some examples, a height side of each inflatable turning bladder 210*a* or 210*b* at full inflation may be about 8 to 10 inches (~20.3 cm to 25.4 cm), and each inflatable turning bladder 210*a* or 210*b* may have a base width of about 15 inches (38.1 cm), 20 inches (50.8 cm), or more depending on the size of the patient. As an example, an inflatable turning bladder with a base width of 20 inches (50.8 cm) and a side height of 10 inches (25.4 cm), at full inflation, may result in a maximum angle of rotation of about 26.6 degrees, while an inflatable turning bladder with a base width of 20 inches (50.8 cm) and a side height of 8 inches (~20.3 cm), at full inflation, may result in a maximum angle of rotation of about 21.8 degrees. An inflatable turning bladder with a base width of 15 inches (38.1 cm) and a side height of 10 inches (25.4 cm), at full inflation, may result in a maximum angle of rotation of about 33.7 degrees, while an inflatable turning bladder with a base width of 15 inches (38.1 cm) and a side height of 8 inches (~20.3 cm), at full inflation, may result in a maximum angle of rotation of about 28.1 degrees. In some instances, the inflatable turning bladder may be selected to have a side height and a base to fit the size of the patient. The inflatable turning bladder may also be adjustable to set the maximum angle of rotation to ensure that the patient can be turned safely and comfortably, while inhibiting or treating wounds (e.g., bedsores and the like) caused by patient immobility.

Examples of the one or more predetermined sequences of inflation and deflation may include, without limitation, a sacrum sore cycle, a left sore cycle, a right sore cycle, and a preventive mode. The sacrum sore cycle, in some embodiments, may include inflation of right inflatable turning bladder 210*a* over 10 minutes of inflation, followed by a hold of 20 minutes at full inflation, followed by deflation of right inflatable turning bladders 210*a* over 10 minutes of deflation. Halfway into deflation (i.e., at about 5 minutes after the start of deflation), the sacrum sore cycle may include inflation of left inflatable turning bladder 210*b* over 10 minutes of inflation, followed by a hold of 20 minutes at full inflation, followed by deflation of left inflatable turning bladder 210*b* over 10 minutes of deflation. Halfway into deflation (i.e., at about 5 minutes after the start of deflation), the cycle may repeat itself (i.e., with inflation/hold/deflation of right inflatable turning bladder 210*a* and with inflation/hold/deflation of left inflatable turning bladders 210*b*, each side being initiated halfway through the deflation of the prior side).

The left sore cycle, in some embodiments, may include inflation of left inflatable turning bladders 210*b* over 10 minutes of inflation, followed by a hold of 20 minutes at full inflation, followed by deflation of left inflatable turning bladders 210*b* over 10 minutes of deflation, followed by a hold of 20 minutes in the flat position, for a total of 60 minutes per cycle. Similarly, the right sore cycle, in some embodiments, may include inflation of right inflatable turning bladders 210*a* over 10 minutes of inflation, followed by a hold of 20 minutes at full inflation, followed by deflation of right inflatable turning bladders 210*a* over 10 minutes of deflation, followed by a hold of 20 minutes in the flat position, for a total of 60 minutes per cycle.

The preventive mode, according to some embodiments, may include a single cycle which includes inflation of right inflatable turning bladders 210*a* over 10 minutes of inflation, followed by a hold of 20 minutes at full inflation, followed by deflation of right inflatable turning bladders 210*a* over 10 minutes of deflation, followed by a hold of 20 minutes in the flat position, followed by inflation of left inflatable turning bladders 210*b* over 10 minutes of inflation, followed by a hold of 20 minutes at full inflation, followed by deflation of left inflatable turning bladders 210*b* over 10 minutes of deflation, for a total of 100 minutes per cycle.

Figure 2A:
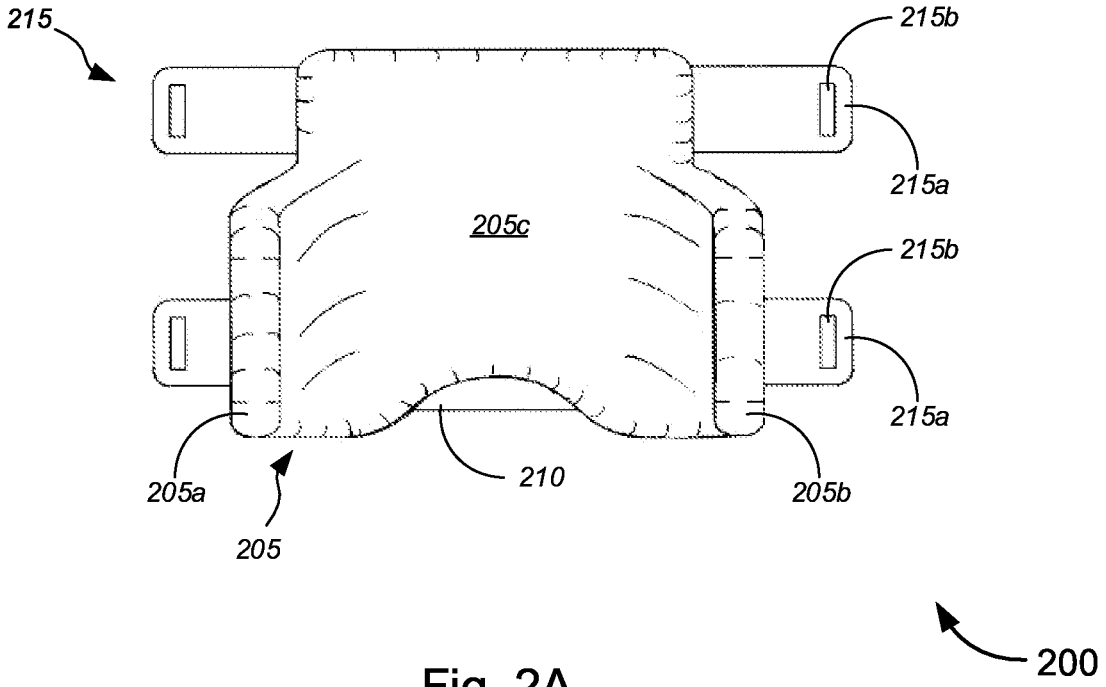
FIGS. 2A-2H are general schematic diagrams illustrating various views of an embodiment of a portable device for automatic patient turning and lifting.
Figure 2B:
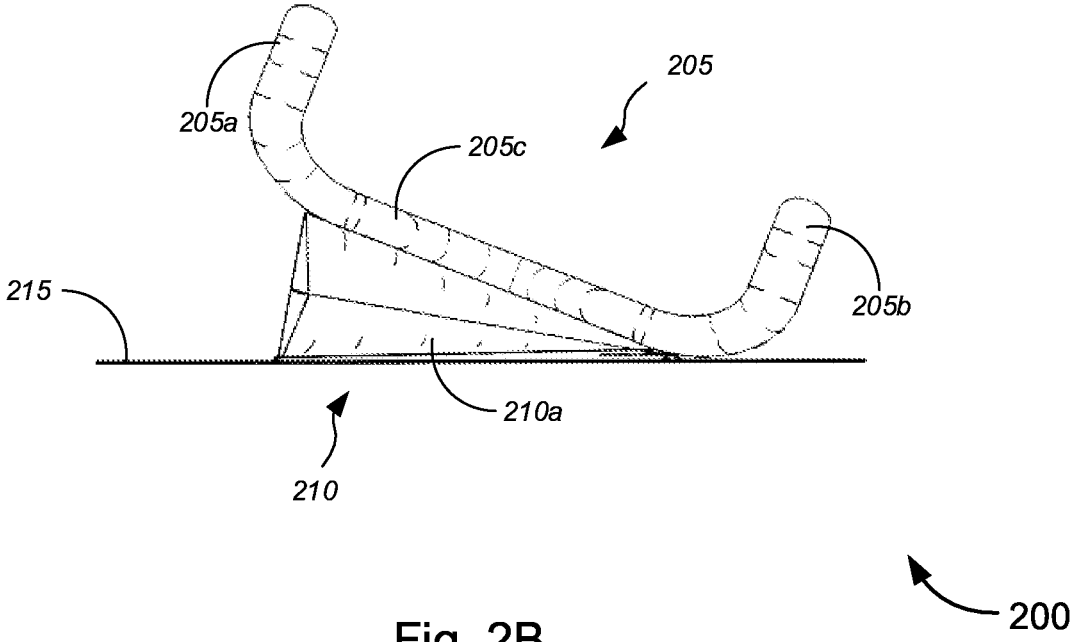
Figure 2C:
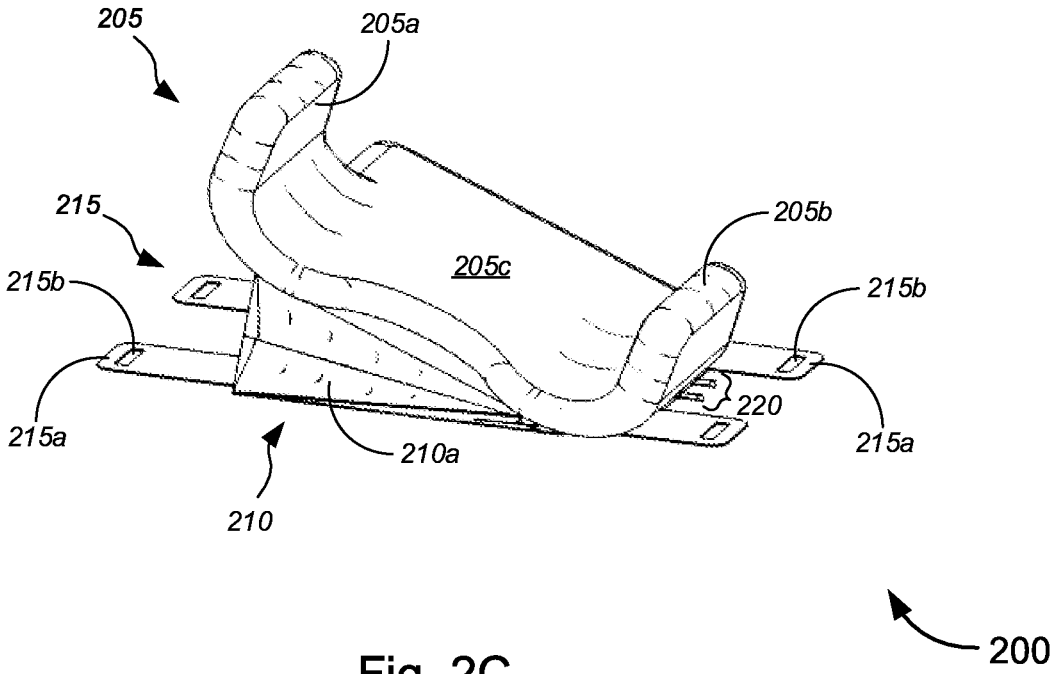
Figure 2D:
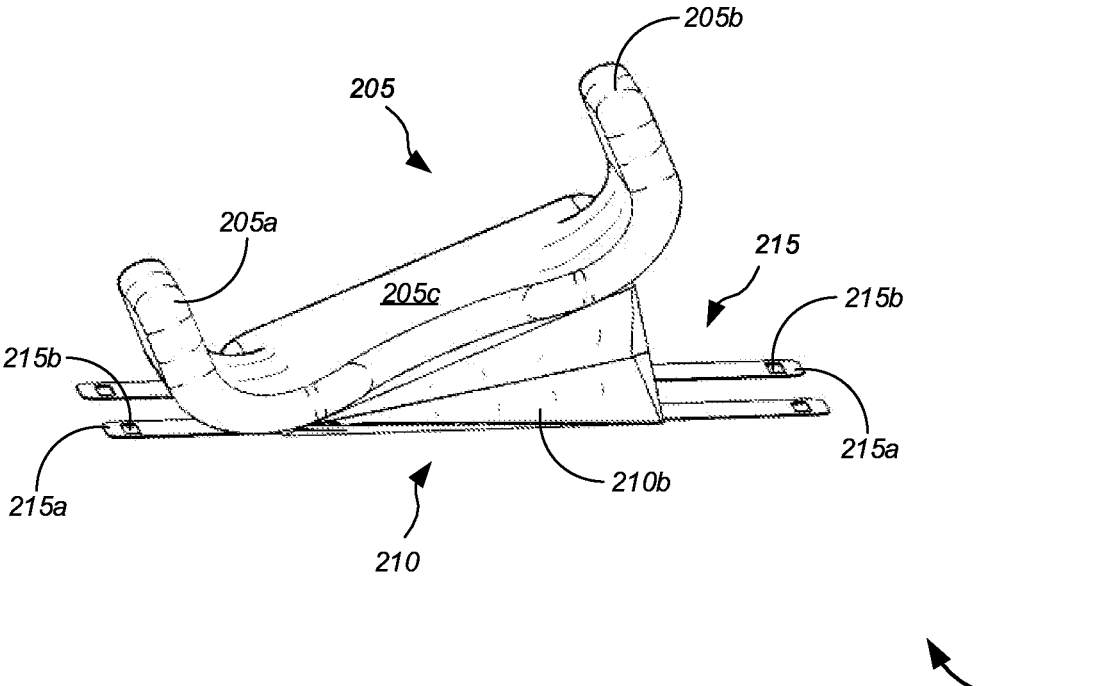
Figure 2E:
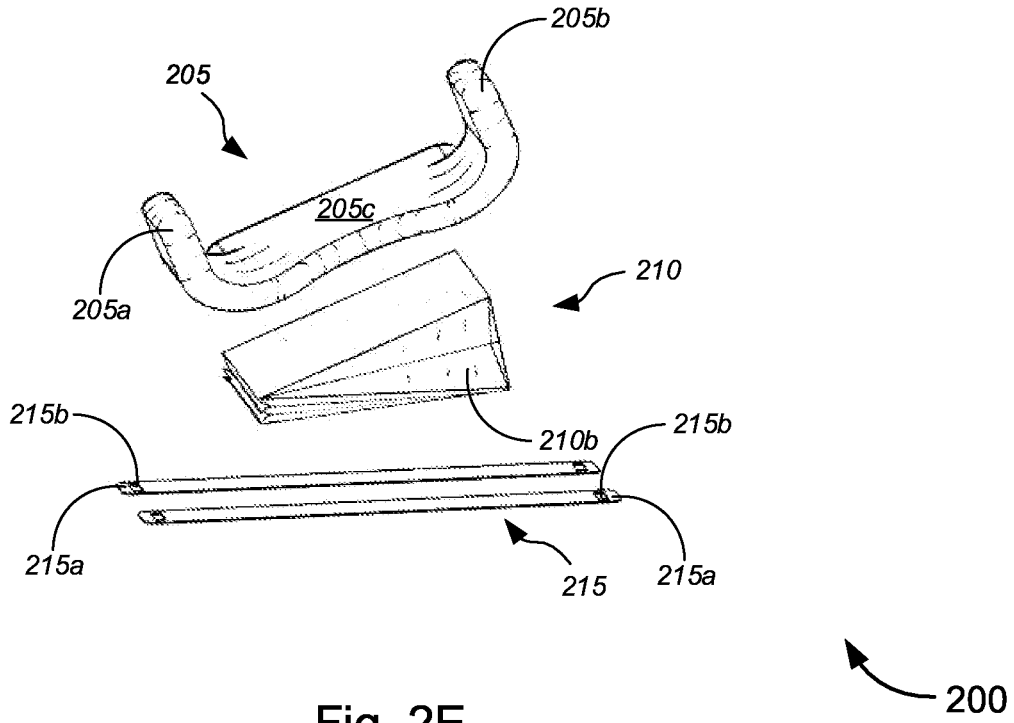
Figure 2F:
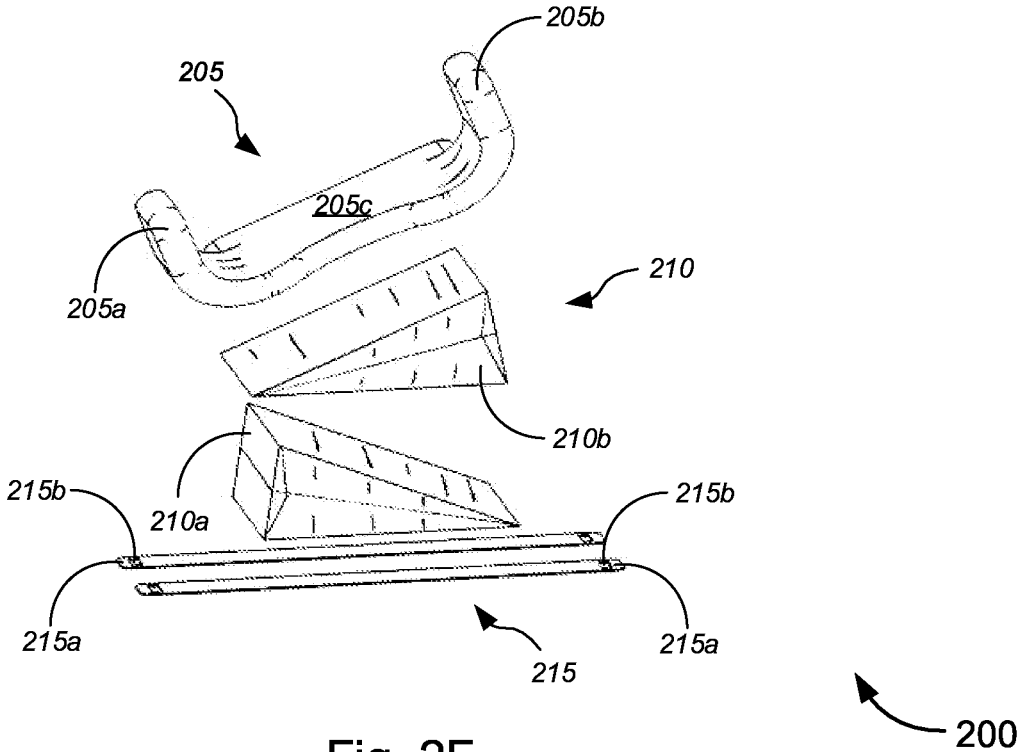
Figure 2G:
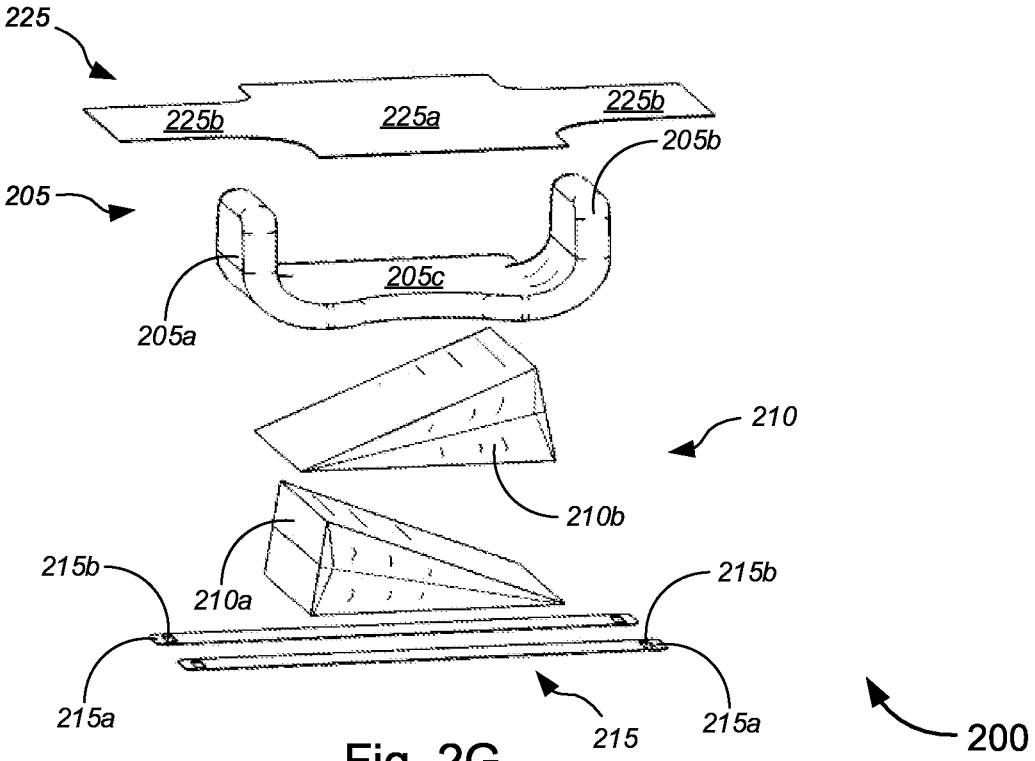
Figure 2H:
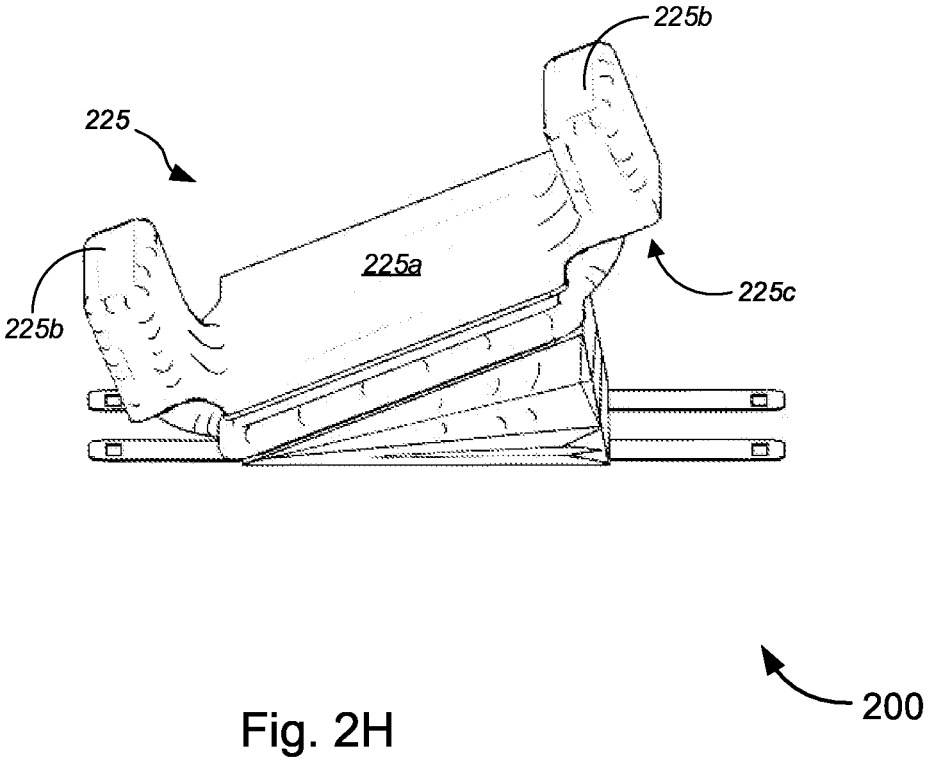
Figure 3A:
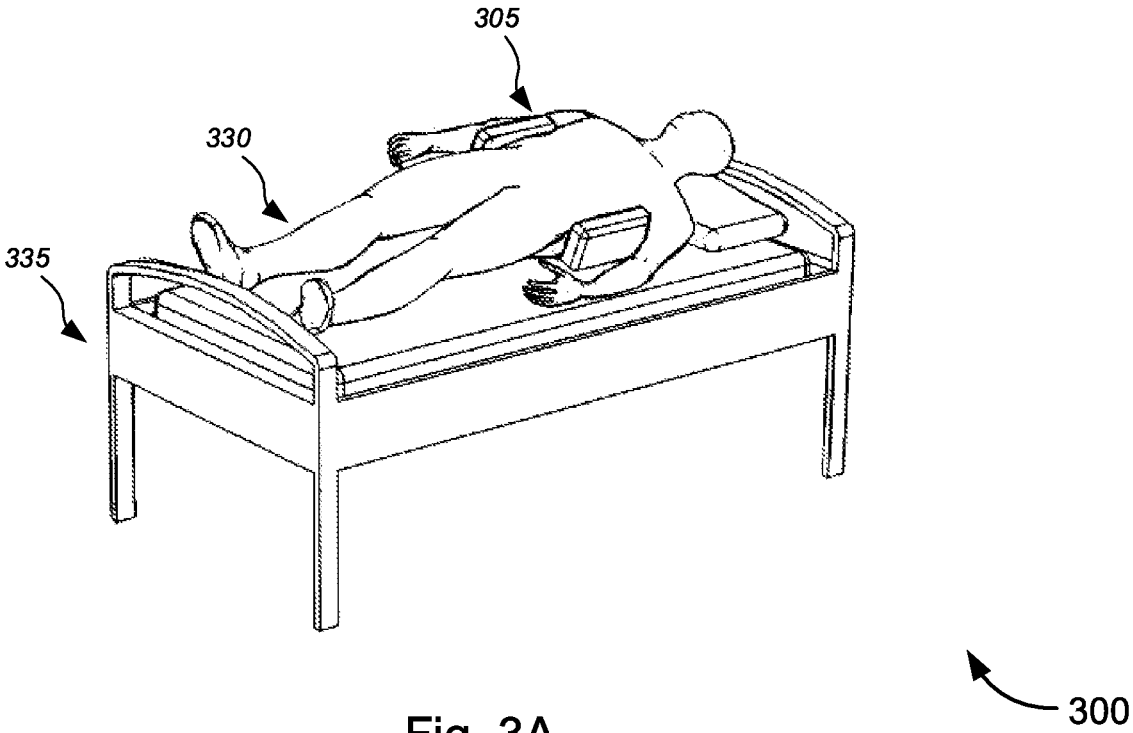
FIGS. 3A-3B are general schematic diagrams illustrating various views of a portable device for automatic patient turning and lifting, as shown in use with a patient positioned thereon, in accordance with various embodiments.
Figure 3B:
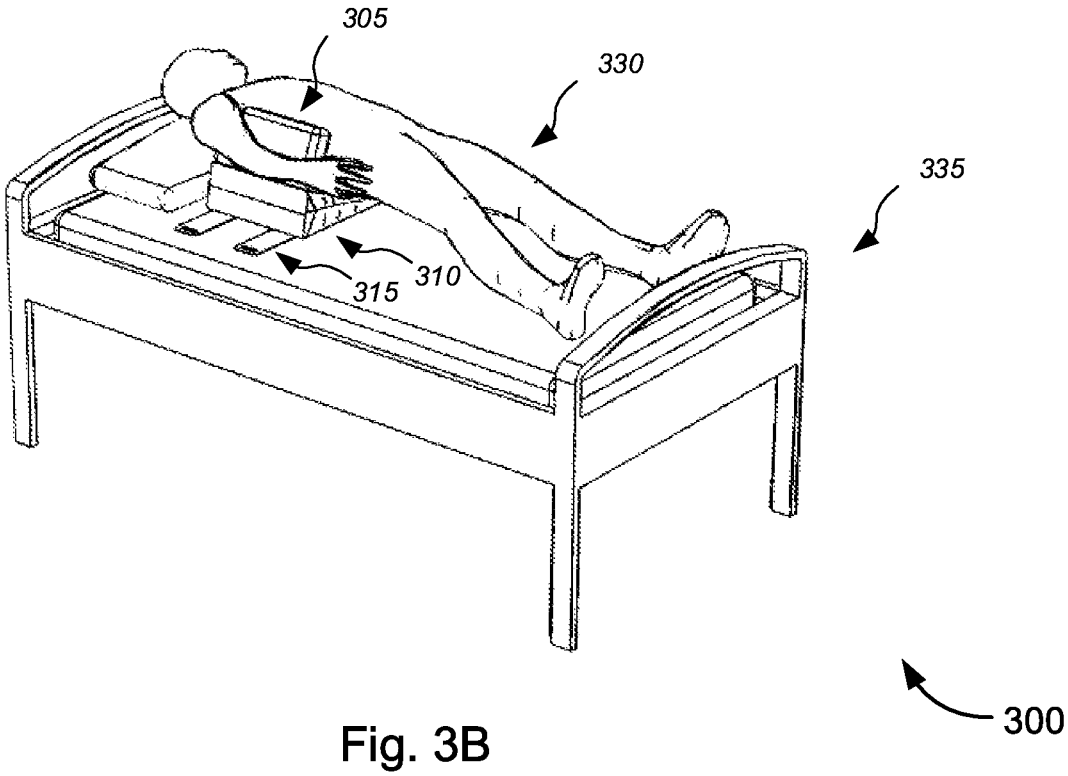
Figure 4A:
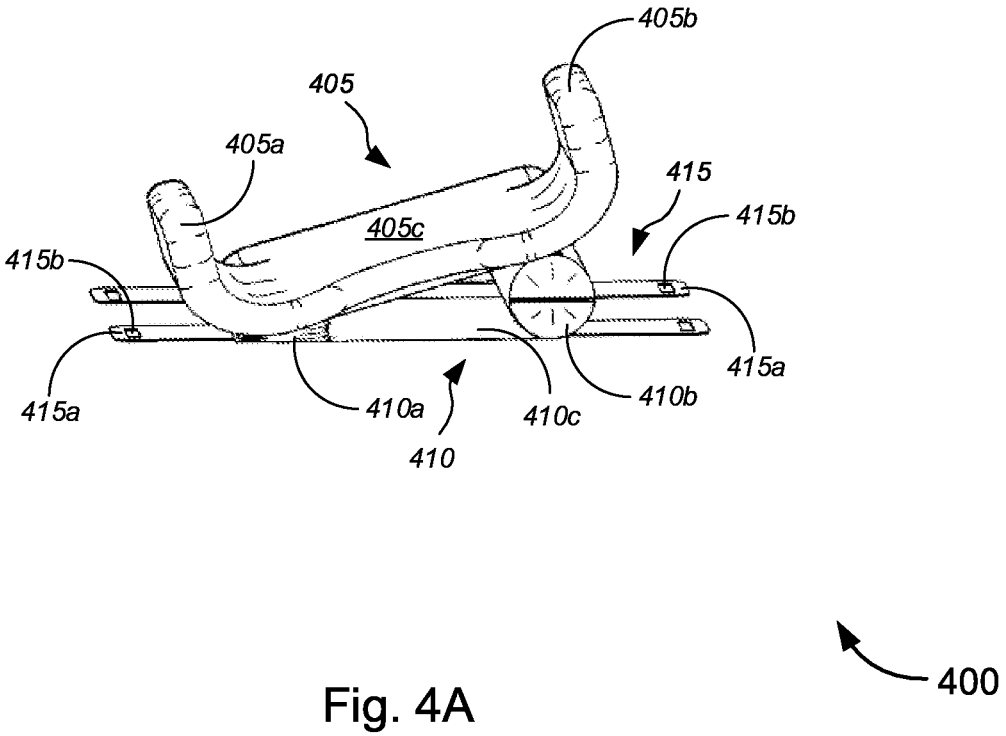
FIGS. 4A-4D are general schematic diagrams illustrating various views of another embodiment of a portable device for automatic patient turning and lifting.
Figure 4B:
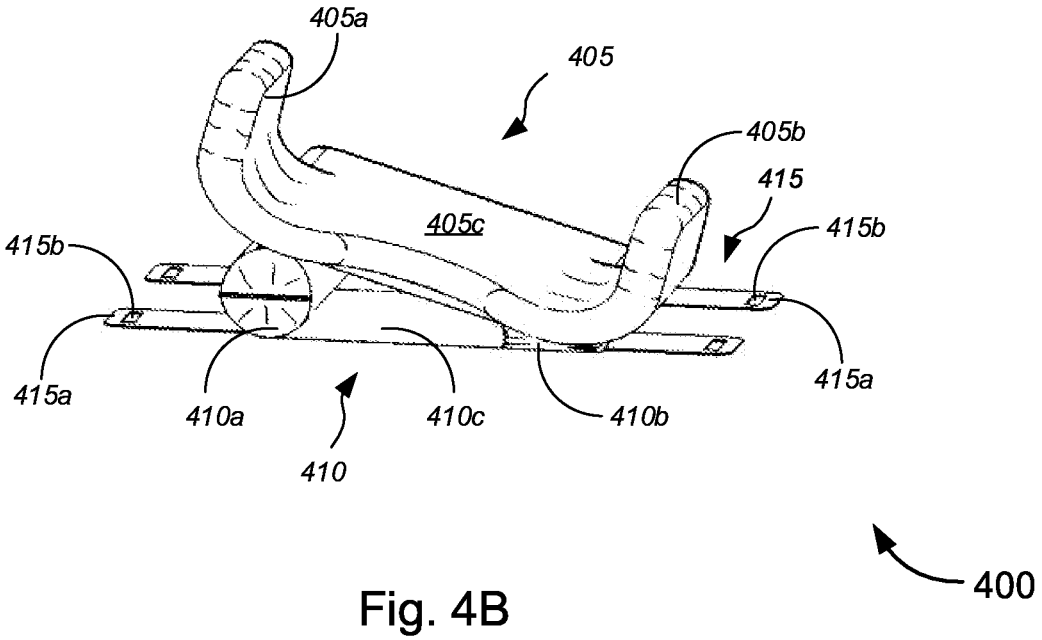
Figure 4C:
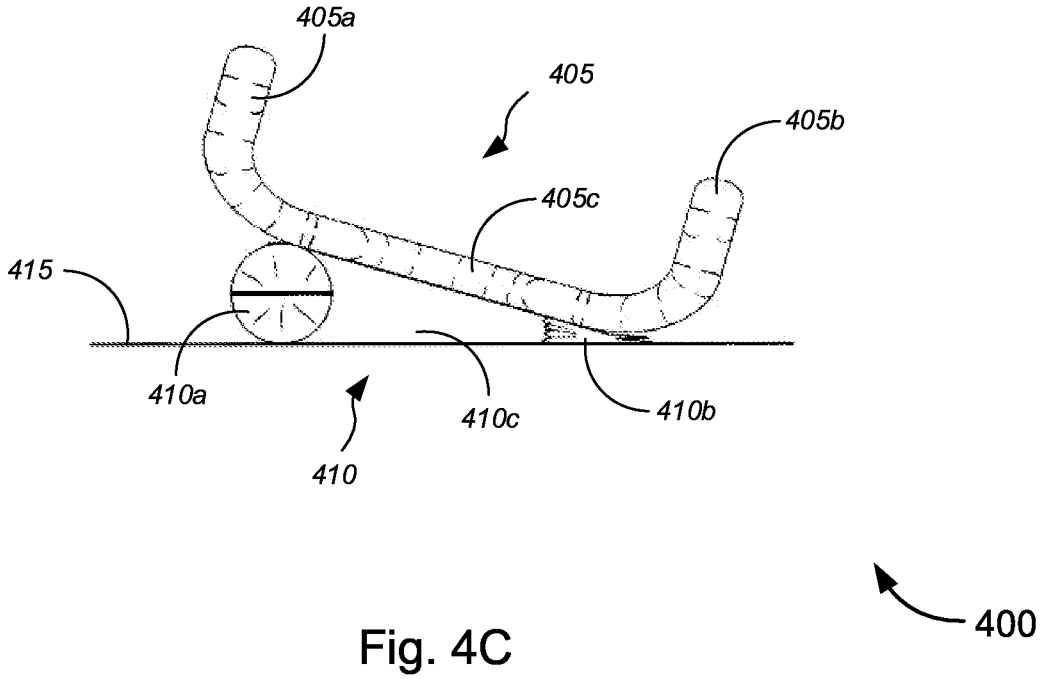
Figure 4D:
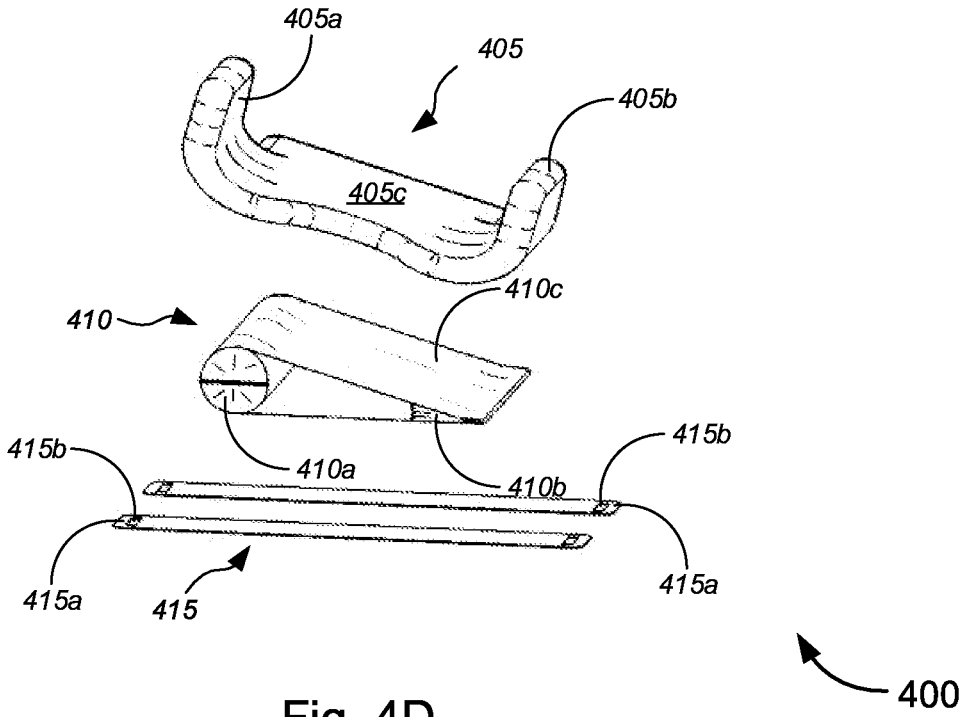
Figure 5A:
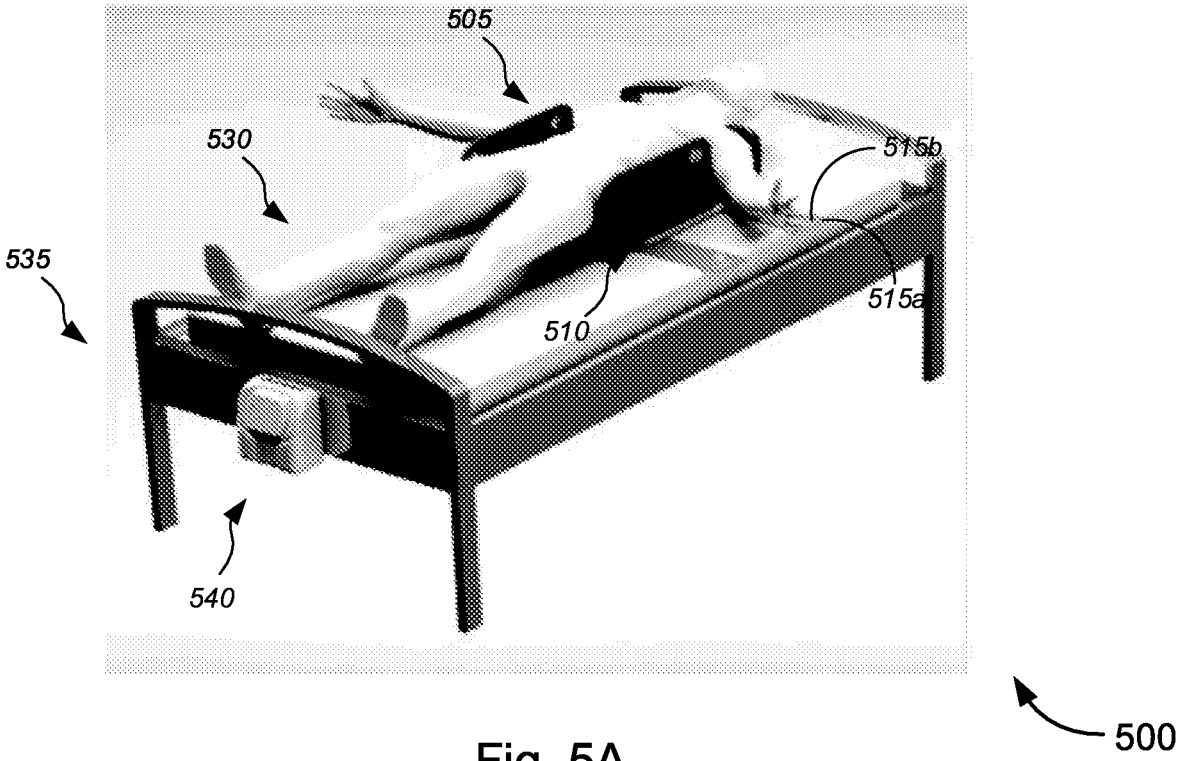
FIGS. 5A-5F are general schematic diagrams illustrating various views of an embodiment of a system for automatic patient turning and lifting.
Figure 5B:
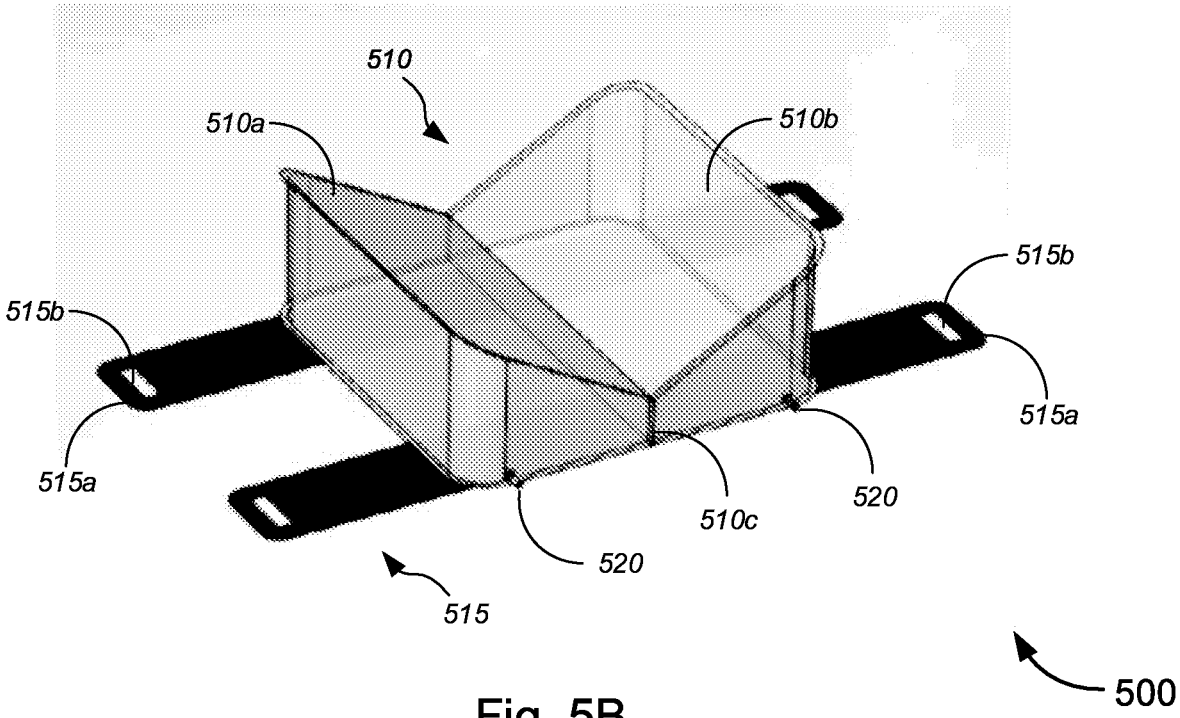
Figure 5C:
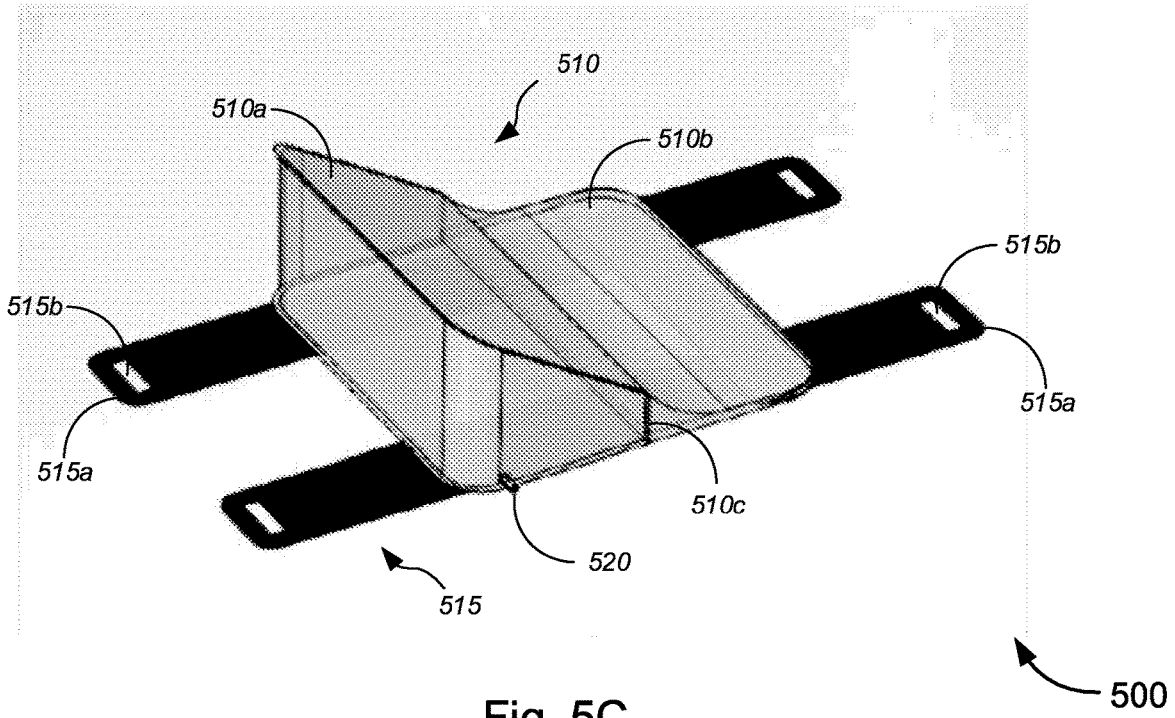
Figure 5D:
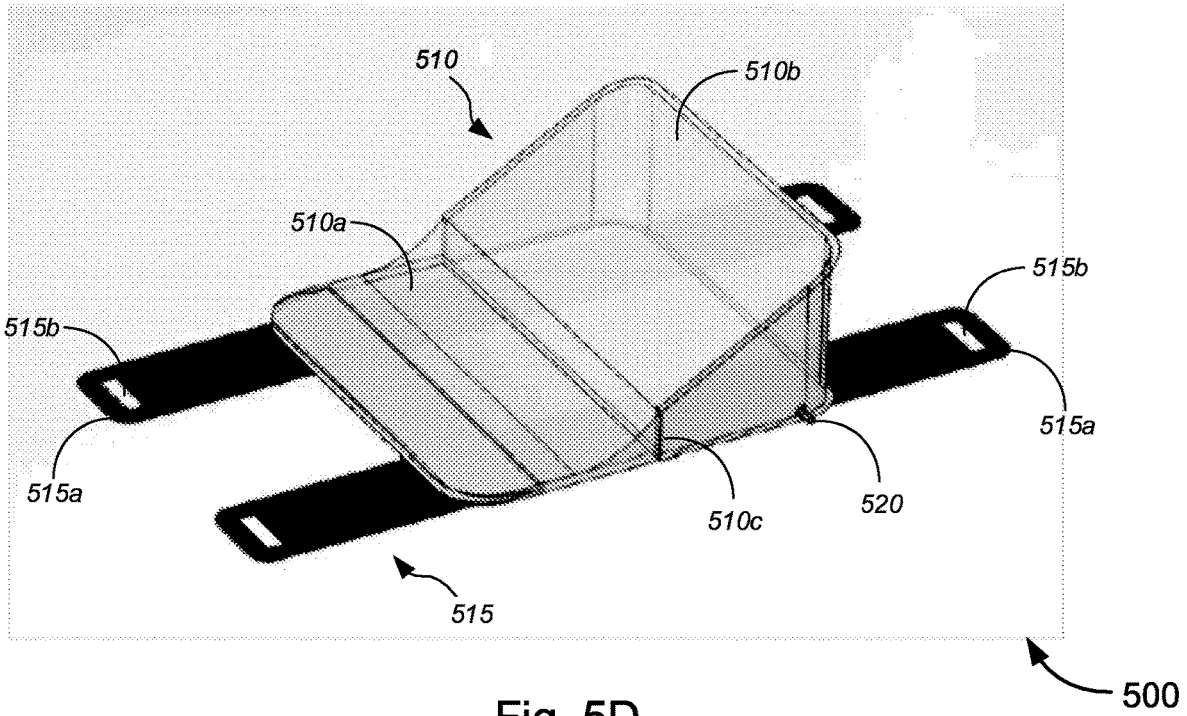
Figure 5F:
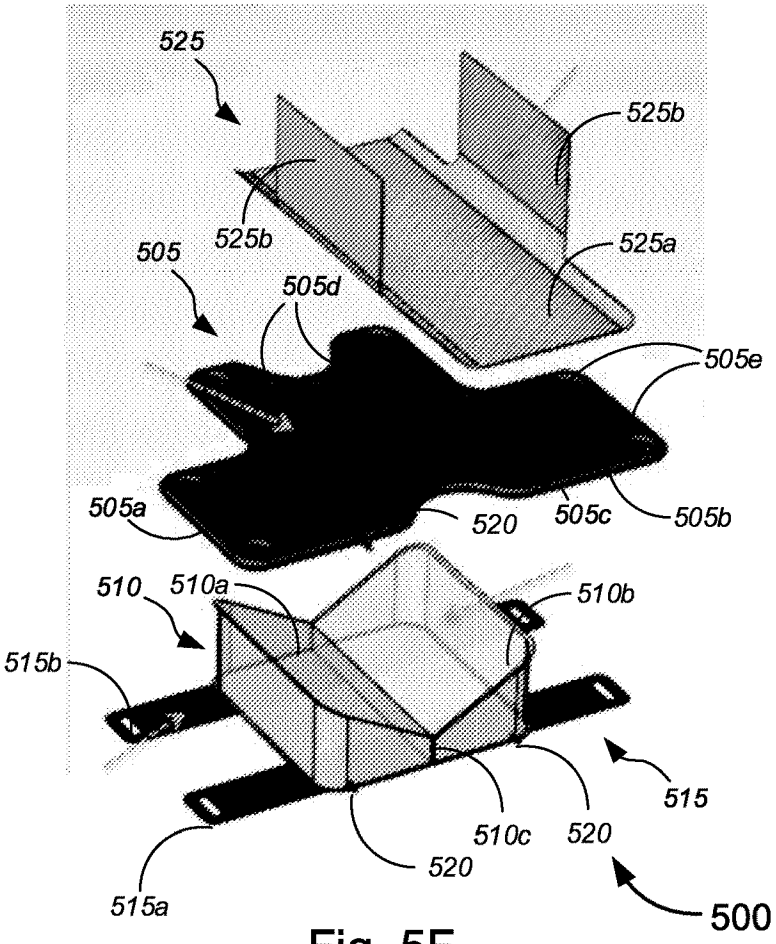
Figure 5E:
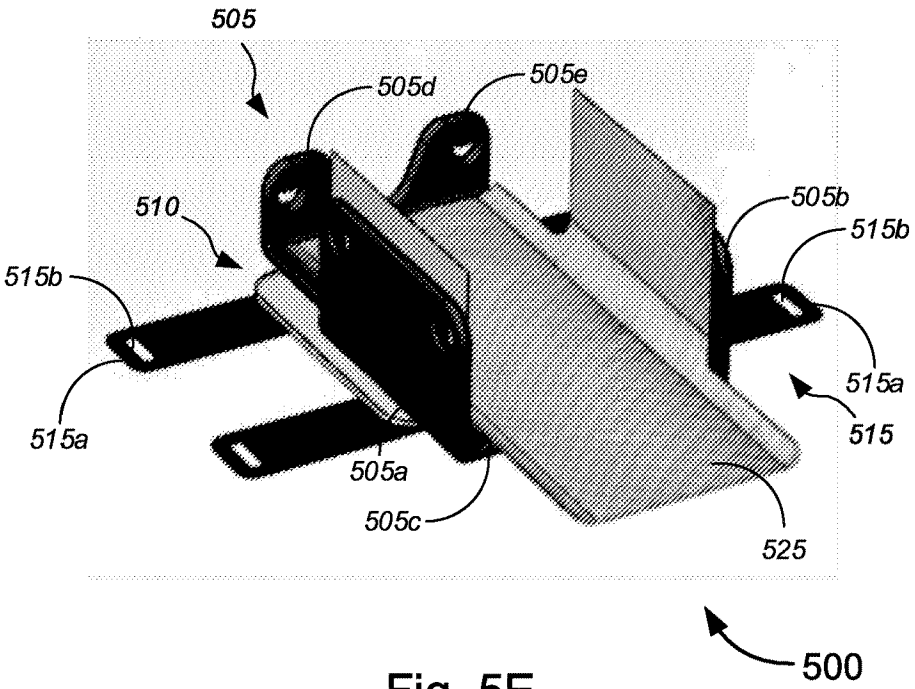

FIGS. 3A-3B (collectively, "FIG. 3") are general schematic diagrams illustrating various views of a portable device 300 for automatic patient turning and lifting, as shown in use with a patient positioned thereon, in accordance with various embodiments. In FIG. 3, patient turning and lifting system 300, support structure 305, one or more sets of inflatable turning bladders 310, and one or more pairs of lifting straps 315 correspond to the same components of patient turning and lifting system 100 or patient turning and lifting device 200, as shown and described in detail above with respect to FIGS. 1 and 2.

As shown in FIG. 3, a patient 330 is shown in various states of rotation, as described in detail above. Patient 330 and patient turning and lifting system 300 are shown positioned on patient support surface 335 (which may include, without limitation, a bed, a mattress, a cot, a floor, or the ground, etc.). The process of automatically turning and lifting the patient, as well as the patient turning and lifting system, of FIG. 3 may otherwise be similar, if not identical, to the process of automatically turning and lifting the patient, as well as the patient turning and lifting system, as described in detail above with respect to FIGS. 1 and 2.

FIGS. 4A-4D (collectively, "FIG. 4") are general schematic diagrams illustrating various views of another embodiment of a portable device for automatic patient turning and lifting 400. In FIG. 4, patient turning and lifting device 400, support structure 405*c* having sidewalls 405*a*, 405*b*, and one or more pairs of lifting straps 415*a* with handles 415*b* correspond to the same components of patient turning and lifting device 200 as shown and described with respect to FIG. 2.

Patient turning and lifting device 400 differs from patient turning and lifting device 200 in that the one or more sets of inflatable turning bladders 410 have a circular cross-section and extend longitudinally, in the shape of a cylinder instead of the bellow configuration of the one or more sets of turning bladders 210 of FIG. 2. In particular, inflatable turning bladders 410, as shown in FIG. 4, include right and left inflatable bladders 410*a* and 410*b* each having a substantially circular profile (or cross-sectional shape; i.e., having a generally cylindrical shape), with right and left inflatable turning bladders 410*a* and 410*b* separated by a predetermined gap, yet connected with each other via a connecting portion 410*c*. In some embodiments, connecting portion 410*c* is a loop of fabric or material that surrounds right and left inflatable turning bladders 410*a* and 410*b*, and is affixed to portions of right and left inflatable turning bladders 410*a* and 410*b* that are in contact with the inner surface of the connecting portion 410*c* (as depicted, e.g., in FIG. 4D).

Patient turning and lifting system 400, as well as the process of automatically turning and lifting the patient, is otherwise similar, if not identical, to the patient turning and lifting system, as well as the process of automatically turning and lifting the patient, as described in detail above with respect to FIGS. 1-3.

FIGS. 5A-5F (collectively, "FIG. 5") are general schematic diagrams illustrating various views of yet another embodiment of a system for automatic patient turning and lifting 500. In FIG. 5, support structure 505, one or more pairs of lifting straps 515*a* having one or more pairs of corresponding handles 515*b*, one or more gas or pump interfaces 520, and disposable patient interface layer 525 correspond to the same components of patient turning and lifting systems 200 and 300 as shown and described with respect to FIGS. 2 and 3.

As shown in FIG. 5, support structure 505, one or more sets of inflatable turning bladders 510, and one or more pairs of lifting straps 515, with the patient 530 positioned thereon, lie on a patient supporting surface 535, which may include, without limitation, a mattress, a bed, a cot, a floor, the ground, or the like. In the example of FIG. 5, patient turning and lifting system 500 also includes control device 540 that may be either releasably attachable to patient supporting surface 535 or positioned adjacent to or near patient support surface 535. Control device 540 may correspond to a combination of pump system 125 and control device 135, as described in detail above with respect to FIG. 1, and may otherwise operate in a similar, or identical, manner as each of those components. Although not specifically shown in the figure, fluid connection tubes or pipes couple control device 540 (or more particularly, the pump system incorporated therein) with each of the one or more gas or pump interfaces 520 for each of support structure 505 and one or more sets of inflatable turning bladders 510 (which include right and left inflatable turning bladders 510*a* and 510*b*).

Patient turning and lifting system 500 of FIG. 5 differs from patient turning and lifting device 200 and patient turning and lifting device 400 in that the one or more sets of inflatable turning bladders 510 are of a different configuration compared to the one or more sets of inflatable turning bladders 210 of FIG. 2 and the one or more sets of inflatable turning bladders 410 of FIG. 4. In particular, the one or more sets of inflatable turning bladders 510, as shown in FIG. 5, include right and left inflatable bladders 510*a* and 510*b* each having a substantially truncated triangular profile (or cross-sectional shape; i.e., having a general wedge shape), with the right and left inflatable turning bladders 510*a* and 510*b* separate but joined at interface or connecting portion 510*c*. As shown in FIG. 5, right and left inflatable turning bladders 510*a* and 510*b* appear in sectional view to be two overlapping triangles with the overlapping corners of the two triangles being removed and the resultant truncated portions of each triangle defining the interface or connecting portion 510*c*. In some cases, connecting portion 510*c* may include adhesives or RF welding material to permanently join the right and left inflatable turning bladders 510*a* and 510*b* together.

Support structure 505 also differs from support structures 205, 305, or 405 in that support structure 505 includes—in addition to the sidewalls 505*a* and 505*b* and main body 505*c*—a neck support 505*d* and a plurality of plastic inserts 505*e*. Neck support 505*d* may be lifted in position (i.e., substantially perpendicular to the main body 505*c*) in a similar manner as described in detail above with respect to FIG. 2 (namely, either by manual manipulation or by virtue of the structure and/or stitching of an outer casing of support structure 505). Neck support 505*d*, in some cases, serves not only to comfortably support the neck of the patient 530, but also to prevent (in conjunction with sidewalls 505*a* and 505*b*) the patient 530 from wandering in any lateral direction (i.e., along a plane parallel to a plane defined by the main body 505*c*) with respect to support structure 505.

The disposable pad or disposable patient interface layer 525 may differ from disposable patient interface layer 225 of FIG. 2 in that although disposable patient interface layer 525 comprises main layer body 525*a* and wing portions 525*b*, disposable patient interface layer 525 may not possess pockets that are configured to fit over corresponding sidewalls 505*a* and 505*b*. Rather, wing portions 525*b* may simply rest against a patient-facing (or inner) surface of each of sidewalls 505*a* and 505*b*, and in some cases may also fold over to rest against an outer surface of each of sidewalls 505*a* and 505*b* (the outer surface being the surface on the opposite side of support structure 505 from the patient-facing or inner surface).

The patient turning and lifting system, as well as the process of automatically turning and lifting the patient, of FIG. 5 may otherwise be similar, if not identical, to the patient turning and lifting system, as well as the process of automatically turning and lifting the patient, as described in detail above with respect to FIGS. 1-4.

Turning to FIGS. 6A-6D (collectively, "FIG. 6"), general schematic diagrams 600 are provided illustrating different states of a support structure 605, in accordance with various embodiments. In FIG. 6, support structure 605 corresponds to the support structure 205 of FIG. 2.

Figure 6A:
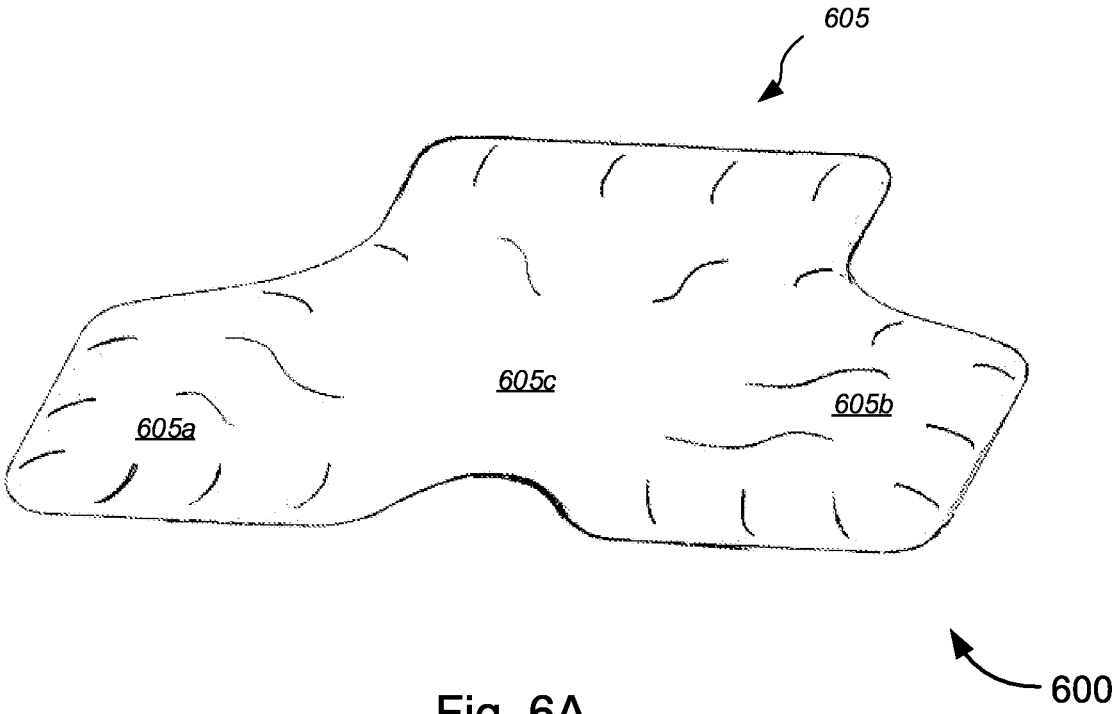
FIGS. 6A-6D are general schematic diagrams illustrating different states of support structure, in accordance with various embodiments.
Figure 6B:
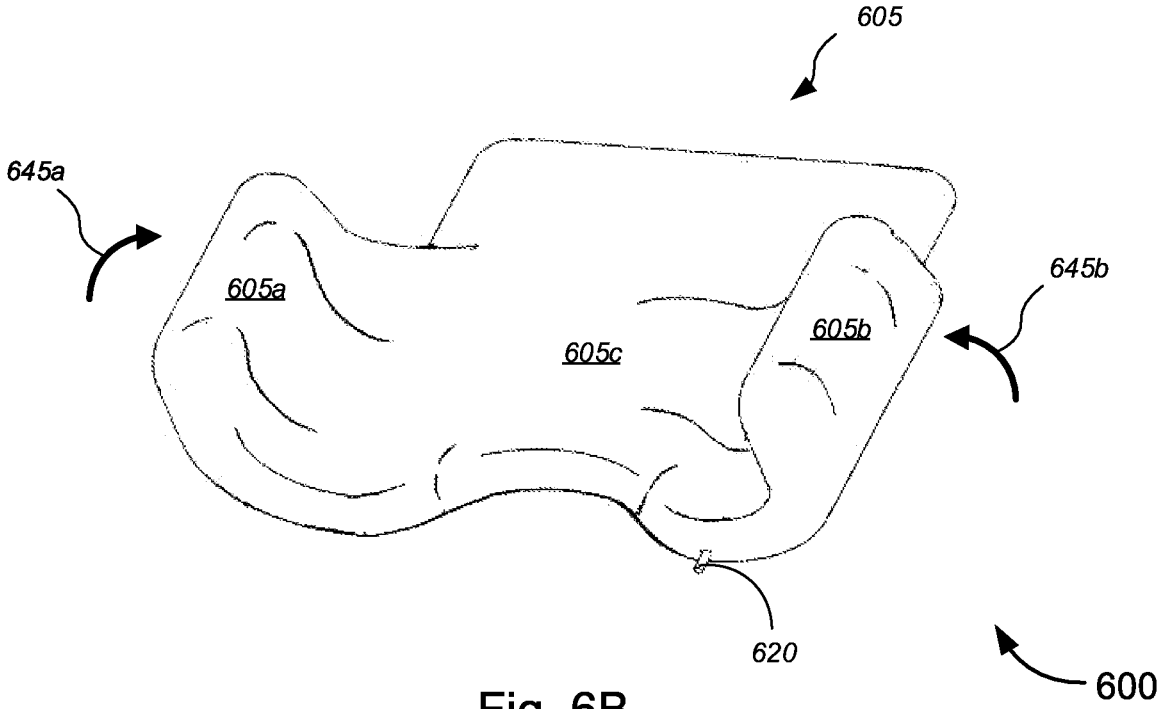
Figure 6C:
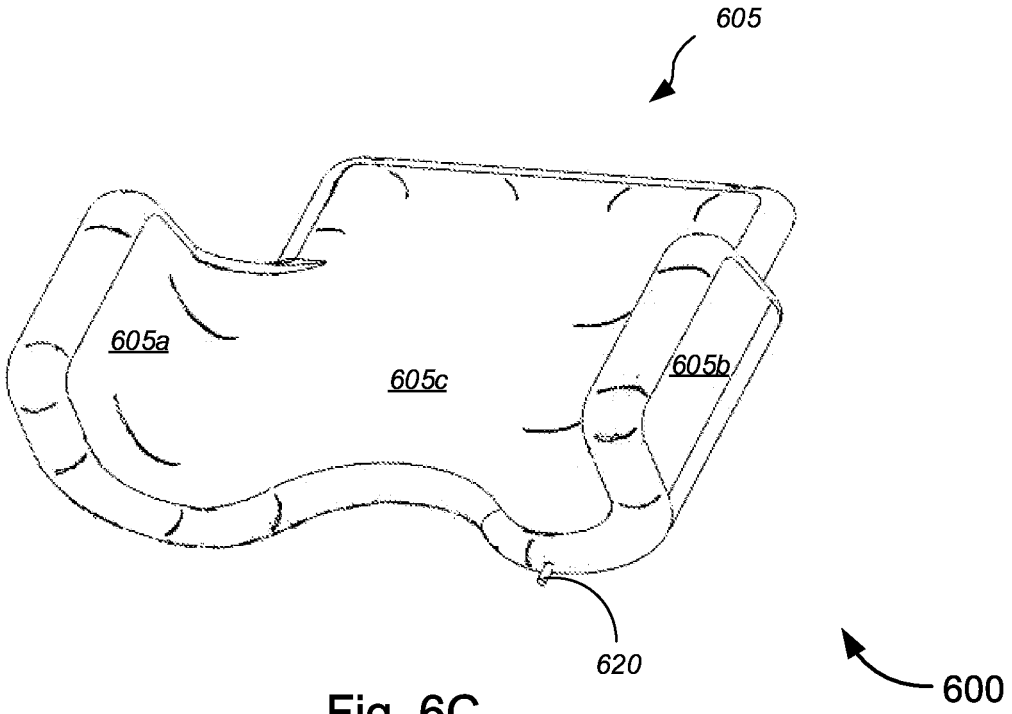
Figure 6D:
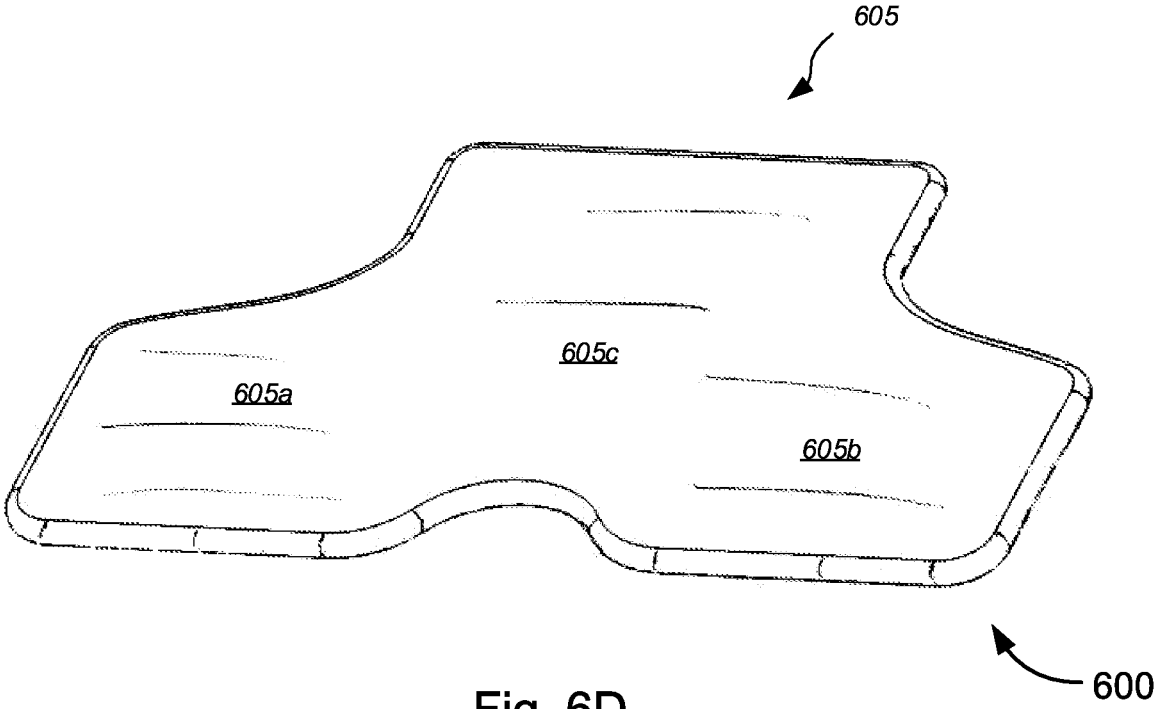

As described above with respect to FIG. 2, in a first state (as shown, e.g., in FIG. 6A), the support structure 605 is substantially flat or at least non-rigid (and in some cases, "floppy"), with air or gas held within the outer casing, such that the plurality of particles are free to move about the interior of the support structure 605 or free to move relative to each other. In some cases, support structure 605, in the first state, may have a structure that is non-rigid and foldable. As such, sidewall portions 605*a* and 605*b* move about freely with respect to main body 605*c*. In a second state, when the air or gas is caused to be evacuated from the outer casing through gas or pump interface 620 (e.g., via pump system 125, as described above), the plurality of particles are forced to compact or compress against each other, so as to form a resilient and/or substantially rigid structure (as shown, e.g., in FIG. 6C). In some embodiments, prior to evacuating the air or gas from support structure 605, a user (such as a physician, nurse, orderly, or other healthcare professional, or other caregiver) lifts the portions of support structure 605 that are intended to form sidewalls 605*a* and 605*b* along respective directions depicted by arrows 645*a* and 645*b*, so that these portions become substantially perpendicular to the main body 605*c* (as shown, e.g., in FIG. 6B). After evacuation of the air or gas, the resilient and/or substantially rigid structure holds the shape of the sidewalls 605*a* and 605*b*. With reference to FIGS. 6B and 6C, with the air or gas evacuated from the interior of support structure 605 in FIG. 6C, the outer casing appears to be held taut across a seemingly solid or rigid structure underneath it, as compared to the loose outer casing shown in FIG. 6B. In contrast to FIGS. 6B and 6C, FIG. 6D shows an embodiment of support structure 605 in a state similar to that of FIG. 6C with the air or gas evacuated therefrom, except that the portions of support structure 605 that are intended to form the sidewalls 605*a* and 605*b* have not been lifted as shown in FIG. 6B. The resultant structure is a resilient and/or substantially rigid structure that is flat (i.e., with portions 605*a* and 605*b* substantially parallel with main body 605*c*, instead of substantially perpendicular as in FIG. 6C).

According to some alternative embodiments, the outer casing of support structure 605 may include stitching or other suitable fabric/material limiting structures that cause the portions that are intended to form sidewalls 605*a* and 605*b* to automatically lift into place, substantially perpendicular to main body 605*c*, upon evacuation of the air or gas, without any need for manual manipulation of any portion of the support structure 605 by a user. For example, the side of support structure 605 that is facing the patient may be provided with slightly less material compared with the side facing the inflatable turning bladders (or the patient support surface (e.g., mattress, bed, cot, floor, ground, etc.)). In some cases, rather than less material, appropriate stitching may be provided in select portions of the patient-facing side to result in an effect similar to that described above for the patient-facing side having less material.

Figure 7:
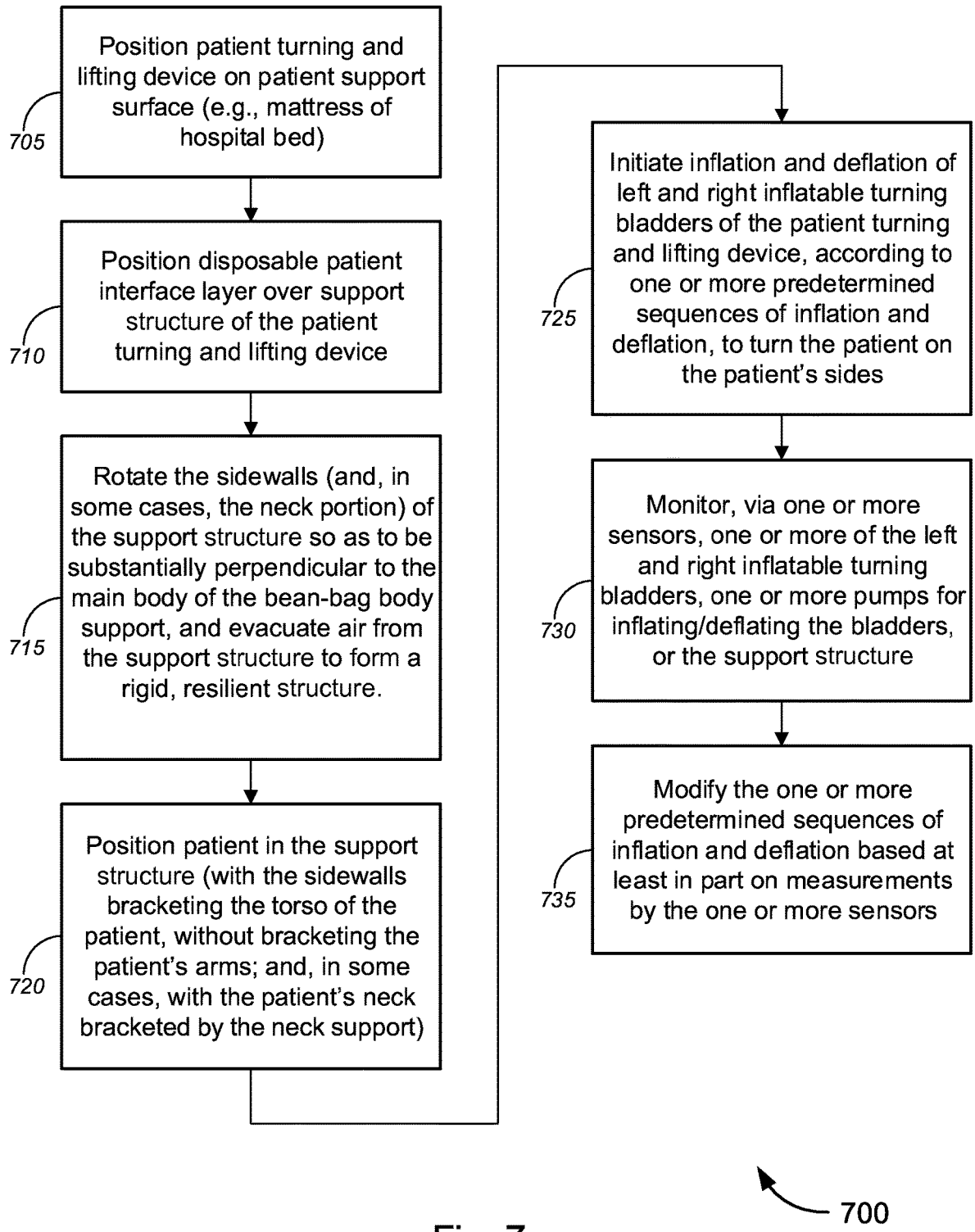
FIG. 7 is a general schematic flow diagram illustrating a method for implementing automatic patient turning and lifting, in accordance with various embodiments.

With reference to FIG. 7, a general schematic flow diagram is provided illustrating a method 700 for implementing automatic patient turning and lifting, in accordance with various embodiments.

At block 705, method 700 includes positioning the patient turning and lifting device (e.g., patient turning and lifting device 200, 300, 400 or 500) on a patient support surface (e.g., support surface 535, which may include, without limitation, a mattress, bed, cot, floor, or the ground, etc.). A disposable patient interface layer (e.g., disposable patient interface layer 225) is positioned so as to lie over (or cover) a support structure (e.g., support structure 205) of the patient turning and lifting device (block 710).

The method 700, at block 715, includes rotating or lifting the sidewalls (and, in some cases, the neck portion as well) of the support structure so as to be substantially perpendicular to the main body of the support structure, and evacuating air or gas from the support structure so that the plurality of particles within the support structure (whether freely contained with the entire interior of the support structure or held within a plurality of separate pockets distributed throughout the interior of the support structure) compact or compress together to form a resilient and/or substantially rigid structure. As described in detail above with respect to FIGS. 2 and 6, rotating or lifting the sidewalls (and/or the neck portion) may be accomplished by manual manipulation or by virtue of the structure and/or stitching of the outer casing of the support structure.

At block 720, a patient is positioned in or on the support structure, with the disposable patient interface layer separating the support structure and the patient to prevent direct contact between patient and the support structure, e.g., for sanitary or hygiene reasons. With the patient in position in or on the support structure, the torso of the patient may be bracketed by the sidewalls of the patient, while the arms of the patient are free to move about with respect to the support structure. In some cases, the neck of the patient may also be comfortably supported and bracketed by the neck support (if any) of the support structure. The neck support (if any) and the sidewalls may work in conjunction to prevent the patient from wandering during automatic patient turning and lifting (i.e., during the one or more sequences of inflation and deflation as described below with respect to block 725 and as described in detail above with respect to FIG. 2).

With the patient comfortably secured in the patient turning and lifting device, inflation and deflation of the left and right inflatable turning bladders of the patient turning and lifting device is initiated, at block 725, according to one or more predetermined sequences of inflation and deflation, in order to turn the patient on the patient's side(s) (i.e., onto one side of the patient, from one side to another side of the patient, and/or from one side of the patient to a flat state, etc.). For example, the one or more predetermined sequences of inflation and deflation may include, without limitation, one or more of a sacrum sore cycle, a left sore cycle, a right sore cycle, and a preventive mode, as described in detail above with respect to FIG. 2.

One or more of the left and right inflatable turning bladders, one or more pumps (including fluid pumps and/or vacuum pumps, etc.) for inflating/deflating the inflatable turning bladders, or the support structure are monitored, at block 730, via one or more sensors including, without limitation, pressure sensors, flow sensors, leak sensors, or any other suitable sensors, or the like. In some instances, the one or more sensors may further include one or more patient sensors or may be communicatively coupled to existing patient monitoring devices typically connected to the patient for monitoring blood oxygen levels, blood pressure, heart-rate or pulse, or the like.

At block 735, the one or more predetermined sequences of inflation and deflation are selected or modified based at least in part on measurements by the one or more sensors. Throughout the process 700, a user (including, without limitation, a doctor, nurse, orderly, or other healthcare professional, or other caregiver) may manually interact with the control device (e.g., control device 135 or 540) using input devices on the control device or remotely interact with the control device (e.g., control device 135 or 540) either wirelessly or in a wired manner, either directly or indirectly over a network and/or server (such as network 170 and/or server 175), as described in detail above with respect to FIG. 1.

Figure 8A:
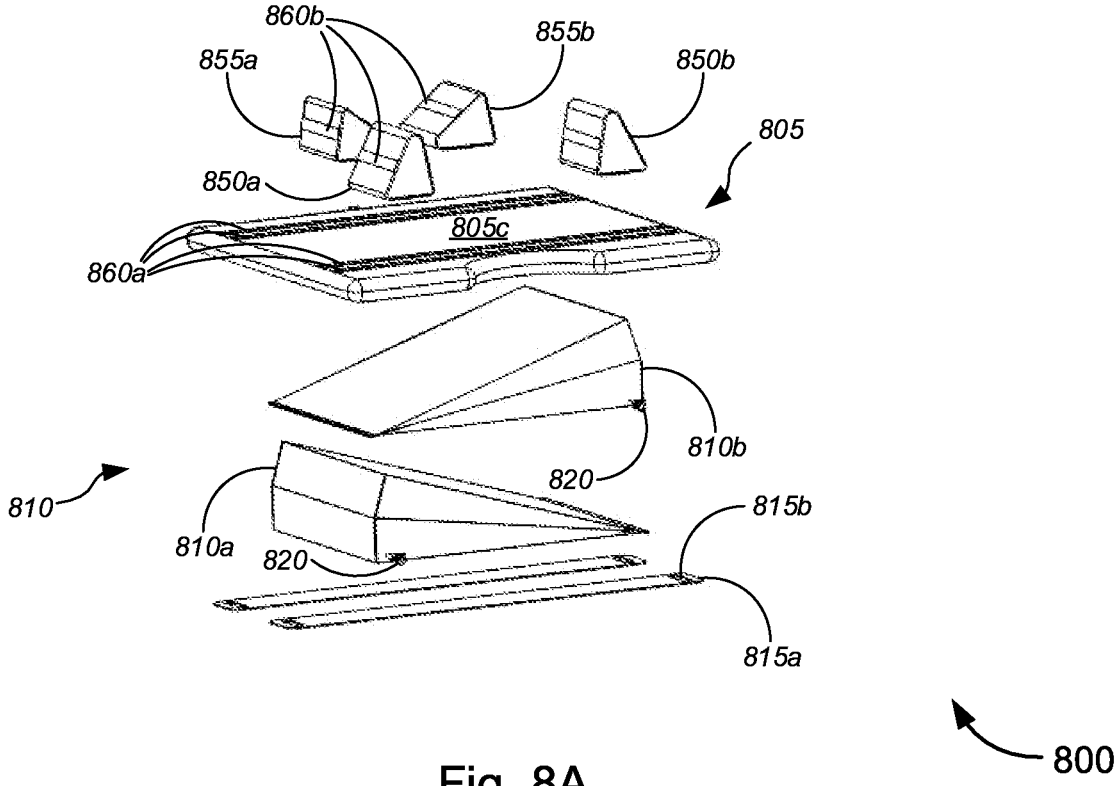
FIGS. 8A-8P are general schematic diagrams illustrating various views of yet another embodiment of a portable device for automatic patient turning and lifting.
Figure 8B:
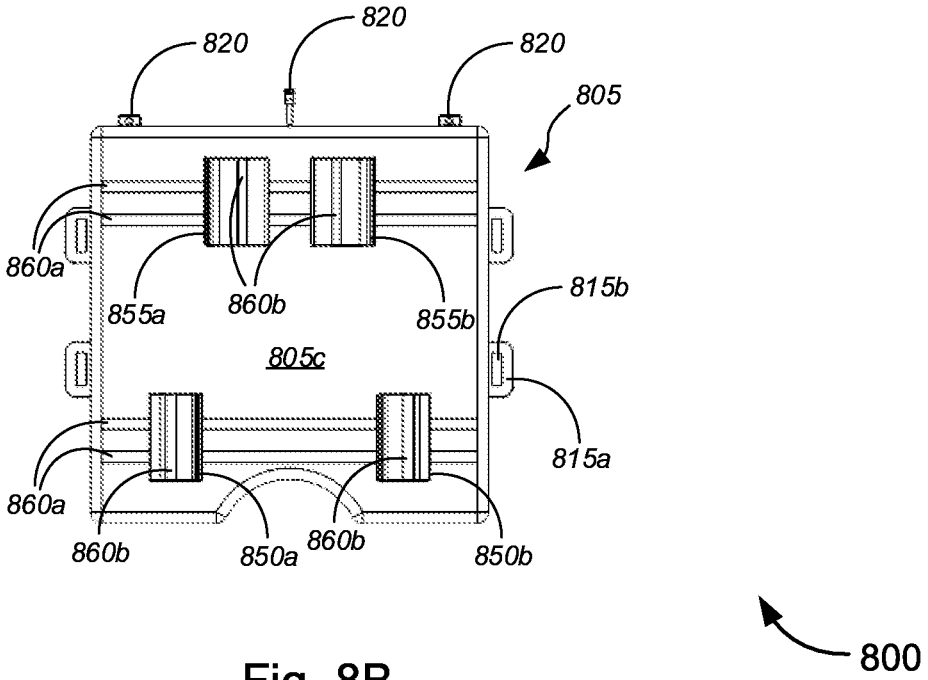
Figure 8C:
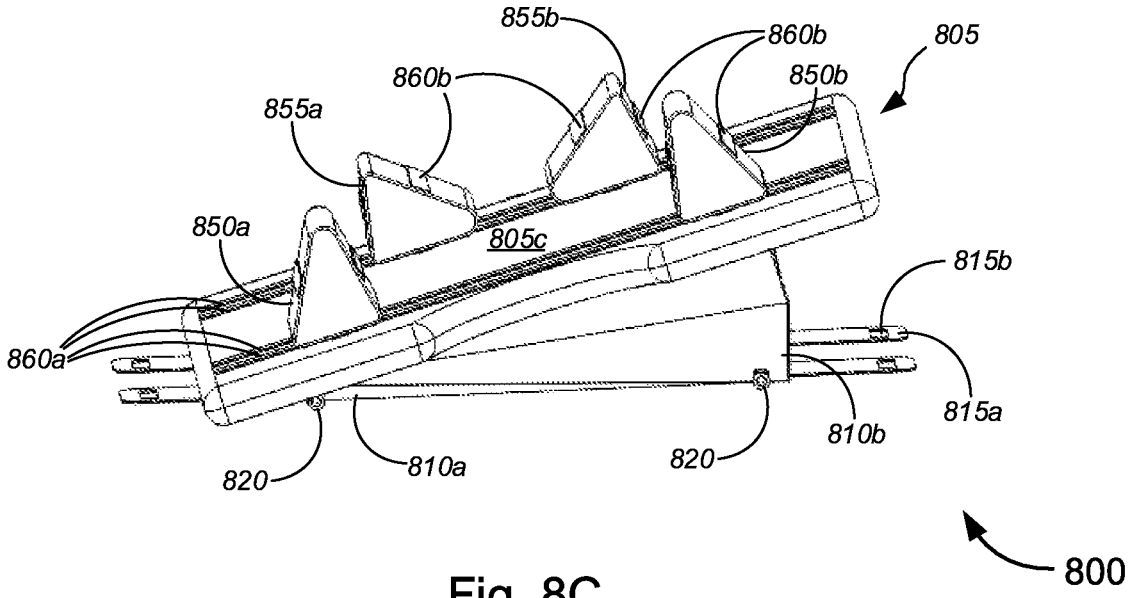
Figure 8D:
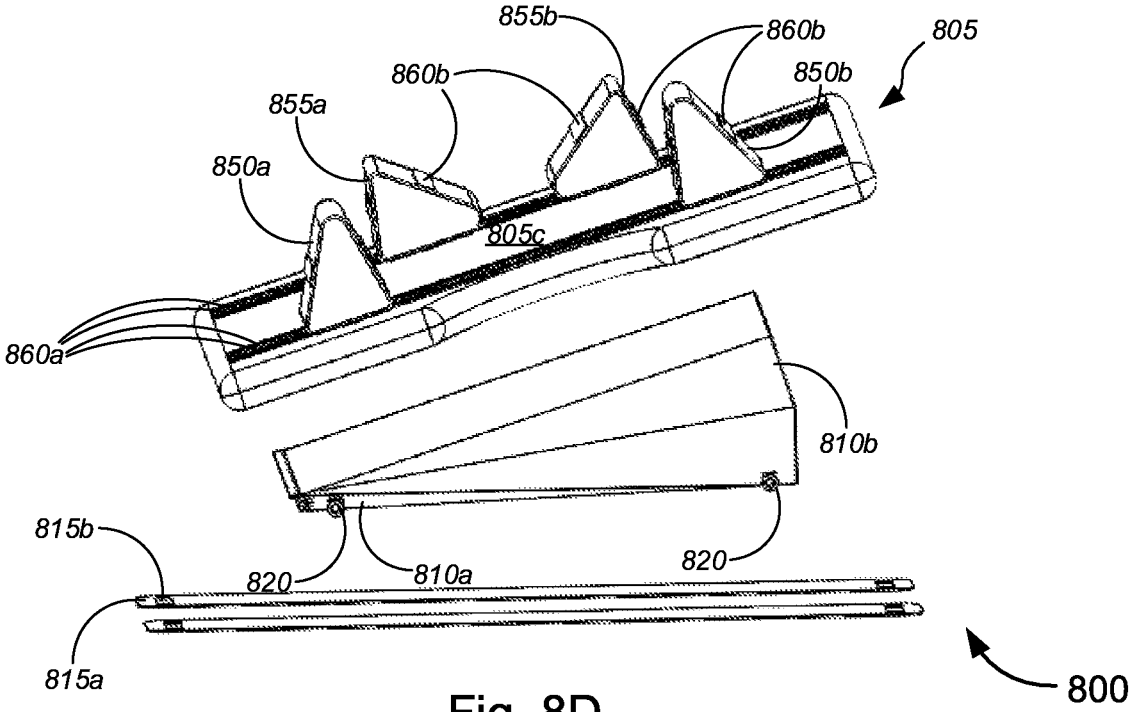
Figure 8E:
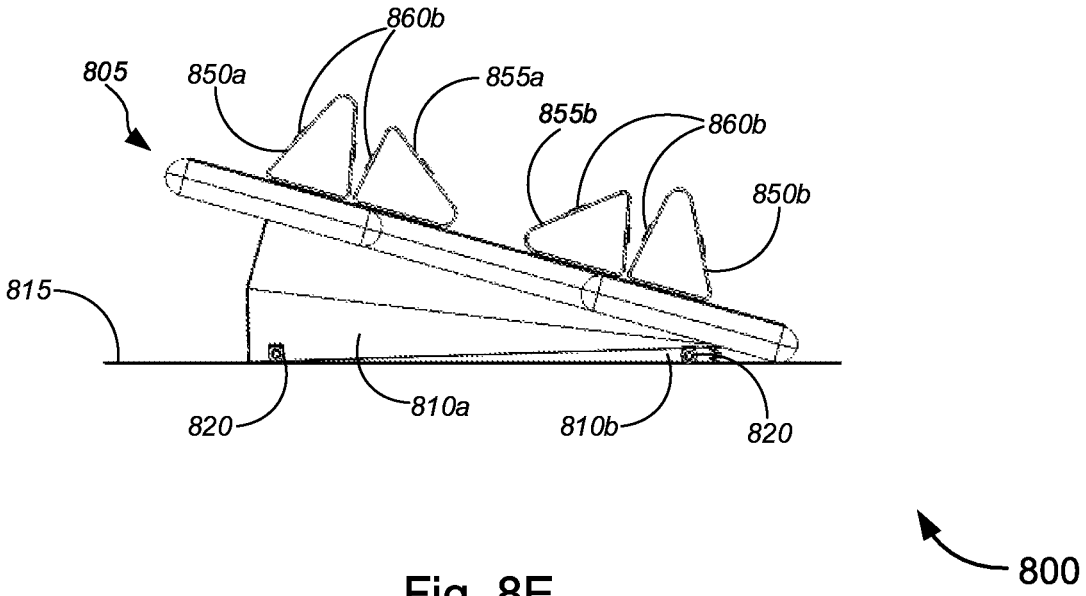
Figure 8F:
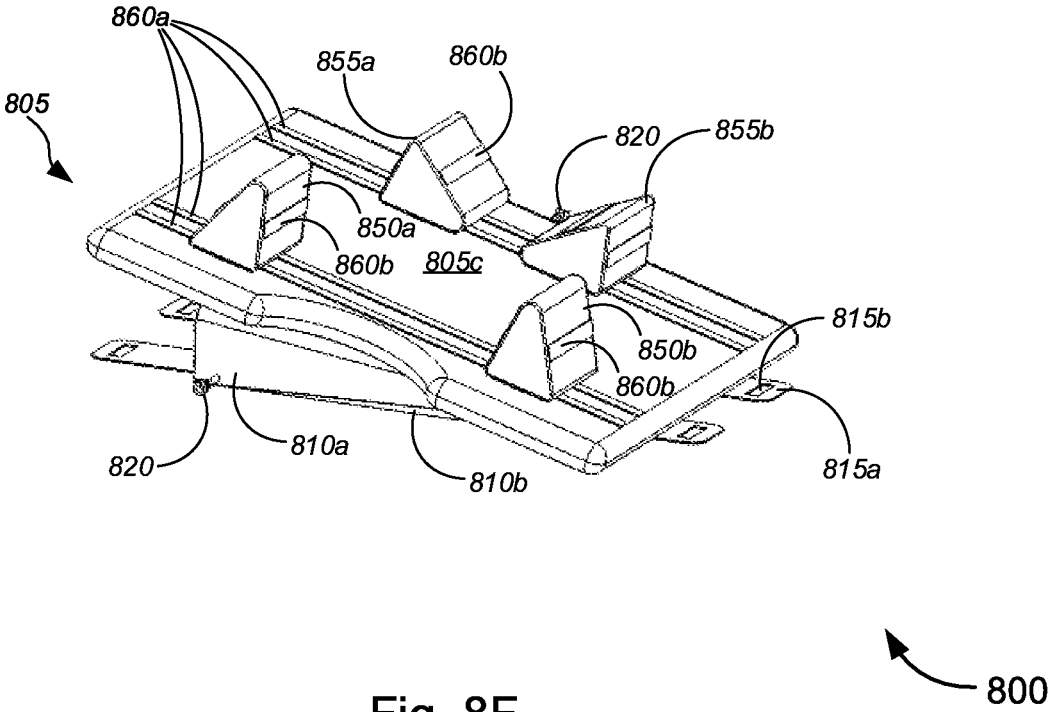
Figure 8G:
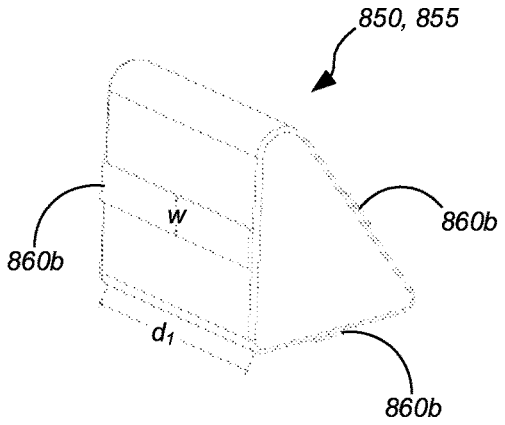
Figure 8H:
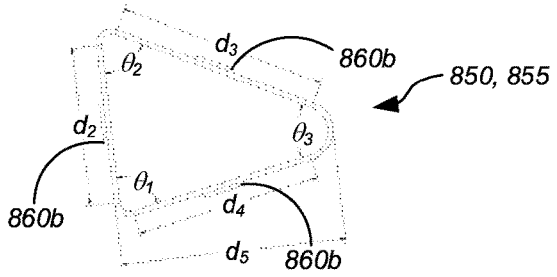
Figure 8I:
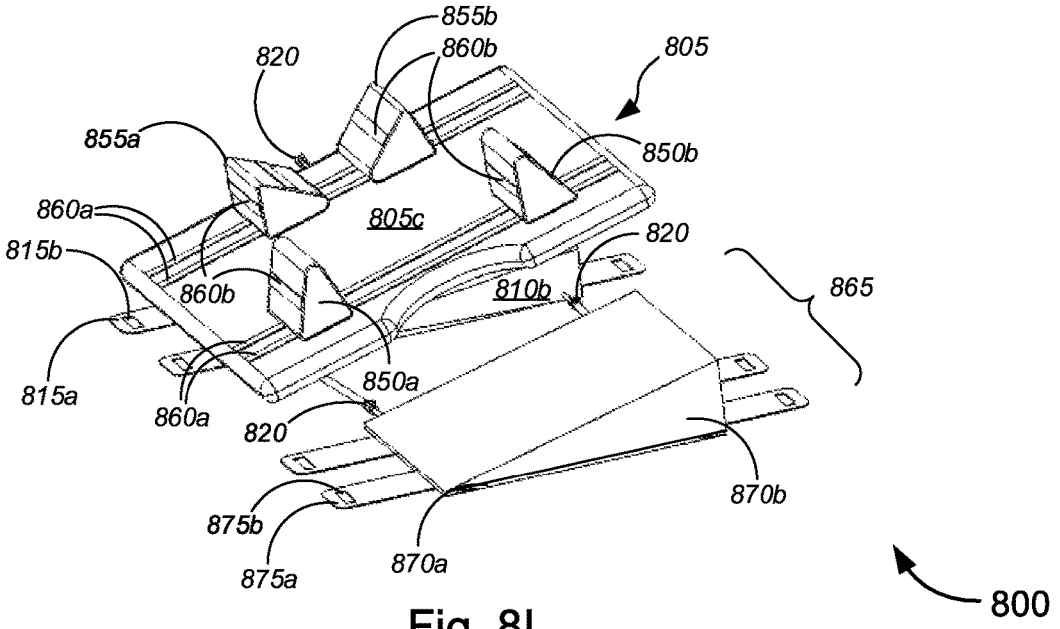
Figure 8J:
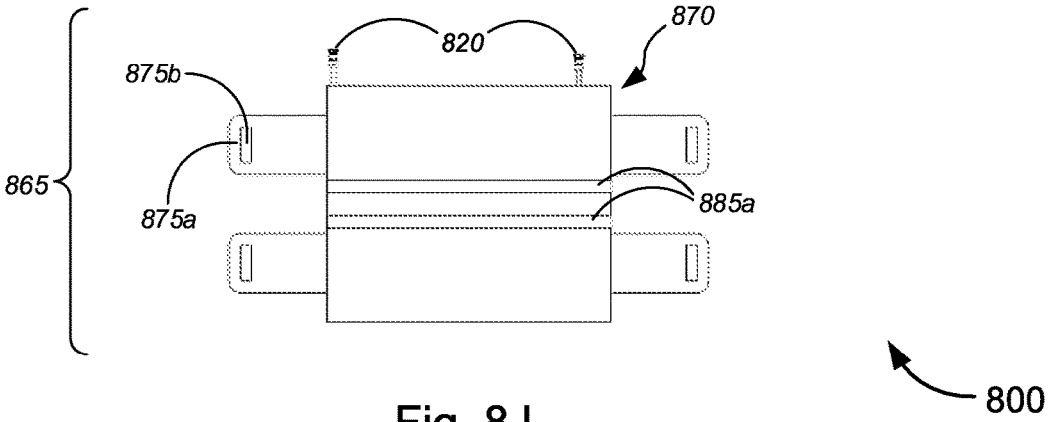
Figure 8K:
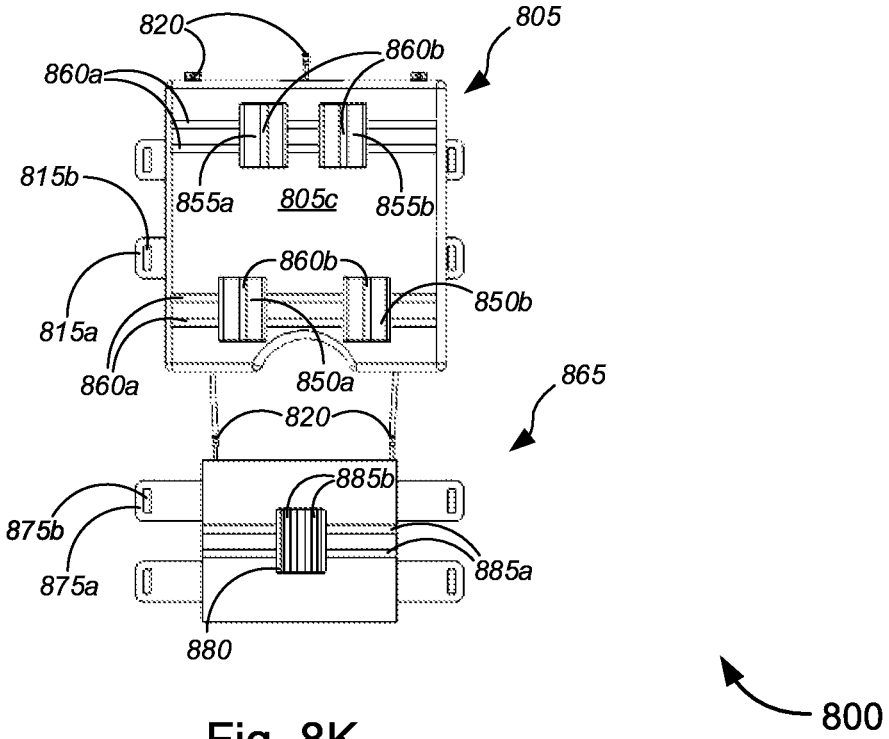
Figure 8L:
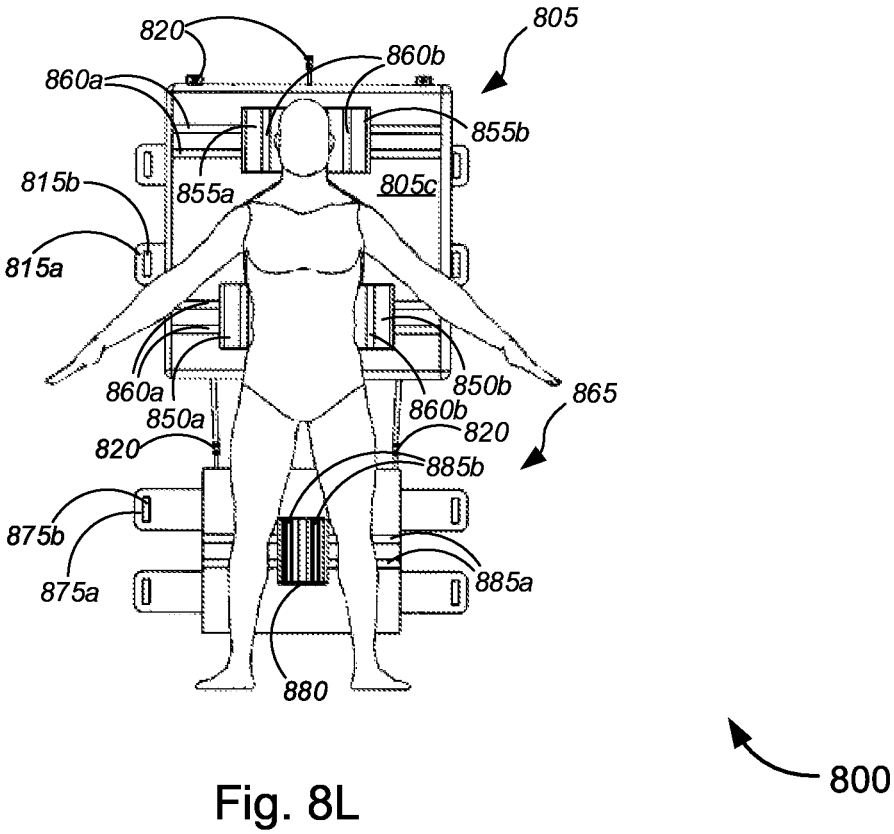
Figure 8O:
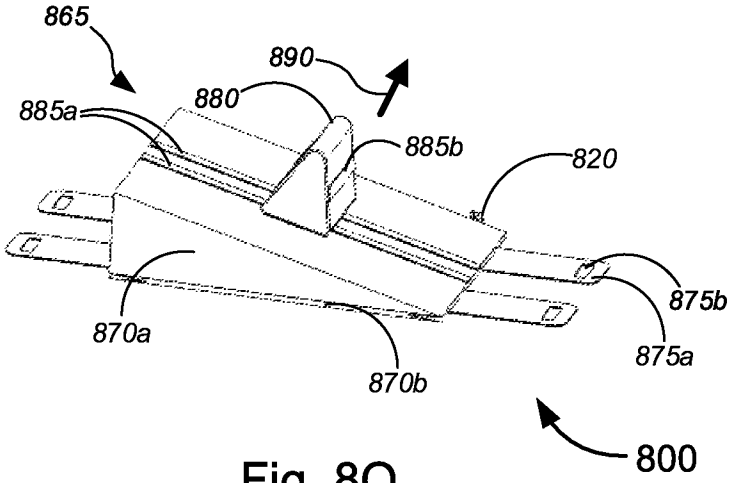
Figure 8P:
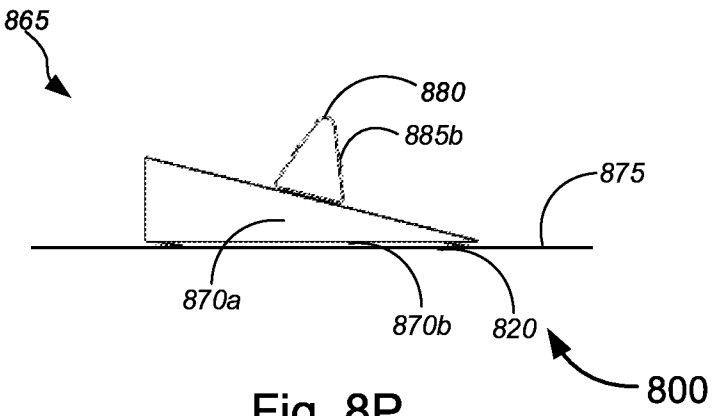

Turning to FIGS. 8A-8P (collectively, "FIG. 8"), general schematic diagrams are shown illustrating various views of yet another embodiment of a portable device for automatic patient turning and lifting 800. In FIG. 8, patient turning and lifting device 800, support structure 805, one or more sets of inflatable turning bladders 810, and one or more pairs of lifting straps 815*a* with corresponding pair of one or more handles 815*b* generally correspond to the same components of the patient turning and lifting system 100 or device 200 as shown and described in detail above with respect to FIGS. 1 and 2.

As shown in FIG. 8, rather than using sidewalls 205*a* and 205*b*, patient body support blocks 850*a* and 850*b* are used to bracket the torso of a patient. Likewise, rather than using neck support 505*d*, patient head support blocks 855*a* and 855*b* are used to bracket and support the head of the patient. Support structure 805 may include one or more strips of fasteners 860*a* on surface 805*c*. Alternatively, a substantial (e.g., at least half) or an entire portion of surface 805*c* may comprise fastener 860*a*. Each patient body support block 850*a* and 850*b* (collectively, "blocks 850"), and each patient head support block 855*a* and 855*b* (collectively, "blocks 855") may comprise a corresponding fastener 860*b* on a side surface thereof. Fasteners 860*a* and 860*b* may be any suitable releasably engageable fasteners, including, but not limited to, hook and loop fasteners, or the like. In some instances, fastener 860*a* may comprise the loop of the hook and loop fastener, while fastener 860*b* may comprise the hook of the hook and loop fastener. In other cases, fastener 860*a* may comprise the hook of the hook and loop fastener, while fastener 860*b* may comprise the loop of the hook and loop fastener.

In some embodiments, each block 850 or each block 855 may have a triangular prism shape (as shown, e.g., in FIG. 8), having two triangular end surfaces and three rectangular side surfaces that define the length of the block. In other embodiments, blocks 850 and/or 855 have other cross-sectional shapes, including, but not limited to a rectangle, a square, rhombus, trapezoid, other regular polygons, or irregular polygons, or the like. Each rectangular side surface may be separated from adjacent rectangular side surfaces, and attached to the adjacent rectangular side surfaces, by curved rectangular corner surfaces, a sectional view of each of which defines a rounded corner of the triangle. The curved rectangular corner surfaces may serve to eliminate pointed edges that could inadvertently poke or scrap the body of the patient, while serving to strengthen the integrity of the block structure against wear and tear. Each of blocks 850 and 855, according to some embodiments, may be composed of any suitable resilient, yet slightly deformable, material—including, without limitation, polystyrene, polyurethane, polyamide, polyethylene oxide, polyvinyl chloride, polypropylene, and polyacrylonitrile—that is shaped as a single piece block. In some embodiments the blocks may be composed of a foamed polymer, such as polystyrene foam and/or polyurethane foam. Each block 850 and 855 may further comprise an exterior layer covering the resilient, yet slightly deformable, material. The exterior layer may comprise any suitable material including, but not limited to, polyurethane, polyvinyl chloride ("PVC"), polyethylene, polypropylene, or some other similar polymeric material.

Each rectangular side surface is provided with one of the corresponding fasteners 860*b* (i.e., as a strip on, on a substantial portion of, or on an entire portion of an outer surface of the exterior layer), each of which affixes to fastener 860*a* when placed in contact with fastener 860*a*. In such a manner, blocks 850 and 855 may be rotated such that a different rectangular side surface is in contact with (and affixed via fasteners 860*a* and 860*b*) surface 805*c*. For triangular blocks 850 and 855 having different angles between each adjacent pair of rectangular side surfaces, such rotational functionality allows for interchangeability, modularity, and flexibility. In other words, blocks 850 and 855 could be made to be identical, and with a simple rotation, the blocks can be used to bracket the torso of the patient's body with a substantially vertical and long rectangular side surface, while a different rotation of a similar (or same block) can be used to support the head of the patient on slightly slanted rectangular side surfaces, as shown in FIG. 8. The ability to position each pair of blocks relative to each other on surface 805*c* allows for vast (or practically unlimited) combinations of positions of the blocks to fit any size patient, to support the patients' torso and head during patient turning and lifting (as described in detail above).

With reference to FIGS. 8G and 8H, a length of each rectangular side surface ("$d_1$"), a width of a first through third rectangular side surface ("$d_2$," "$d_3$," and "$d_4$"), a distance ("$d_5$") between the shortest width rectangular side surface ("$d_2$") and the opposing corner or apex of the triangular block may be predetermined as appropriate to accommodate a range of sizes of patients Likewise, the angles between adjacent rectangular side surfaces ("$\theta_1$" "$\theta_2$," and "$\theta_3$") may be predetermined as appropriate to accommodate angles necessary for comfortably and securely bracketing patients' torsos and supporting patients' heads (and/or necks), with the widths $d_2$, $d_3$, and $d_4$ dependent on the angles $\theta_1$, $\theta_2$, and $\theta_3$, and vice versa. In some embodiments, length $d_1$ may range from 5 inches (~12.7 cm) to 10 inches (~25.4 cm), and, in at least one non-limiting example, is about 7.75 inches (~19.7 cm). Angles $\theta_1$, $\theta_2$, and $\theta_3$, may range from 75° to 90°, from 45° to 70°, and from 30° to 45°, respectively, and, in at least one non-limiting example, are about 79°, 63°, and 38°, respectively. Widths d $d_2$, $d_3$, and $d_4$ may range from 3.5 to 4.5 inches (~8.9 to ~11.4 cm), from 4.5 to 7.5 inches (~11.4 to ~19.1 cm), and 4 to 6 inches (~10.2 to ~15.2 cm), respectively, and, in at least one example, are about 4 inches (~10.2 cm), 5.2 inches (~13.2 cm), and 4.6 inches (~11.7 cm), respectively. Distance $d_5$, in at least one non-limiting example, is about 5.6 inches (~14.2 cm).

Where the support structures 205, 305, 405, 505, or 605 are, in some embodiments, sized to fit particular sizes of patients, with different size support structures for each size group (e.g., extra small, small, medium, large, extra-large, extra-extra-large, extra-extra-extra-large, and the like), support structure 805 is intended to fit most, if not all, patients. As such, support structure 805 is configured as a 3 foot (~91.4 cm) by 3 foot (~91.4 cm) structure. As shown in FIG. 8L, this large size comfortably allows the head of most patients to fit on the blocks 855, while the patient's torso is bracketed by blocks 850, without bracketing the patient's arms. The triangular profile of the blocks 850 also allow bracketing of the torso while allowing the patient's arms to fold relatively close to the patient's sides, resulting in a comfortable arm position.

With reference to FIGS. 81-8P, patient turning and lifting device 800 may further include patient leg turning device 865, which includes one or more sets of inflatable leg turning bladders 870 and one or more pairs of lifting straps 875. The one or more sets of inflatable leg turning bladders 870 may include right and left leg turning bladders 870*a* and 870*b*, which function in a similar manner as right and left turning bladders 810*a* and 810*b* or right and left turning bladders 210*a* and 210*b* (as described in detail above with respect to FIG. 2). Likewise, the one or more pairs of lifting straps 875 may each include a strap body 875*a* with one or more handles 875*b* formed therein, similar to the strap body 215*a* and the one or more handles 215*b* as described in detail above with respect to FIG. 2. For inflating and deflating bladders 870*a*, for example, one or more gas or pump interfaces 820 may connect a gas and/or vacuum line from a pump (e.g., pump 125 shown and described with respect to FIG. 1) to bladders 810*a*, and from bladders 810*a* to bladders 870*a*. Similarly, one or more gas or pump interfaces 820 may connect a gas and/or vacuum line from a pump (e.g., pump 125 shown and described with respect to FIG. 1) to bladders 810*b*, and from bladders 810*b* to bladders 870*b*. In this manner, inflation/deflation of bladders 810*a* (or 810*b*) will result in a corresponding (or concurrent) inflation/deflation of bladders 870*a* (or 870*b*). At least one of the one or more gas or pump interfaces 820 may connect a gas and/or vacuum line from the pump (e.g., pump 125, which may include vacuum pump 125*c*) to support structure 805, so that when air or gas is evacuated from within the support structure 805, the particles within the support structure 805 compress against each other to form a resilient flat structure (not unlike support structures 205, 305, 405, 505, and 605 (as described in detail above).

Figure 8M:
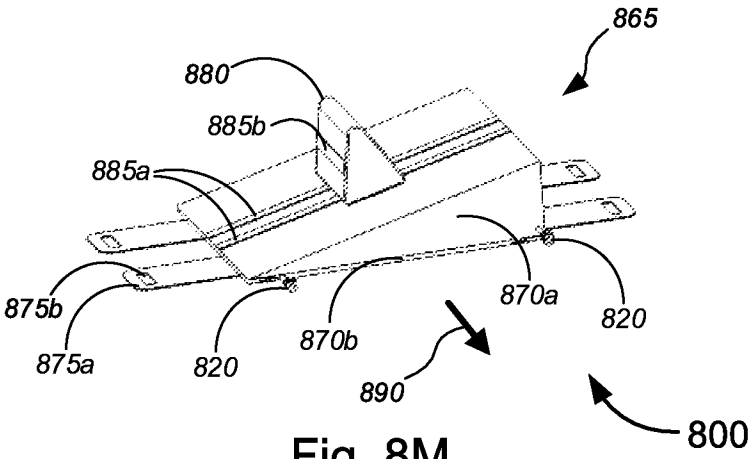
Figure 8N:
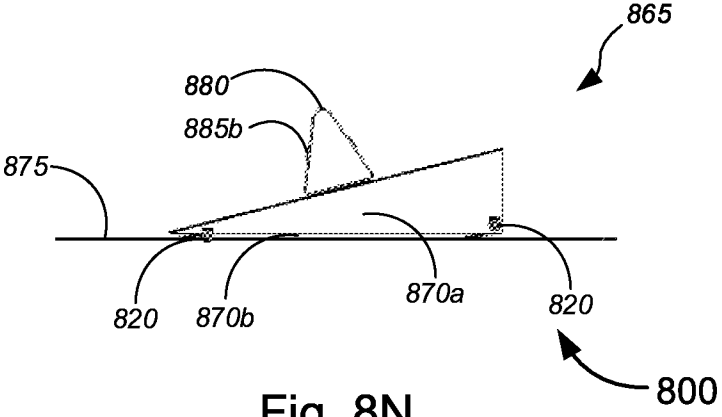

In some instances, each gas inlet and tube of the one or more gas or pump interfaces 820 may be color coded. For example, the hose from the pump 125 to the right turning bladders 810*a* (and the corresponding inlet) may have a first color, the hose from the pump 125 to the left turning bladders 810*b* (and the corresponding inlet) may have a second color, the tube from the right turning bladders 810*a* to the right leg turning bladders 870*a* (and the corresponding inlets) may have a third color, and the tube from the left turning bladders 810*b* to the left leg turning bladders 870*b* (and the corresponding inlets) may have a fourth color. In at least one embodiment, the first and third colors may be similar but of different shade (e.g., one being a lighter shade of the same color, while the other being a darker shade of the same color). Similarly, the second and fourth colors may be similar but of different shade (e.g., one being a lighter shade of the same color, while the other being a darker shade of the same color). The first (and third) color may be distinctly different from the second (and fourth) color. Alternatively, all four colors may be distinctly different from each other. The hose from the pump 125 (and/or vacuum pump 125*c*) to the support structure 805 (and corresponding inlet) may have a fifth color distinctly different from any of the first through fourth colors. With reference to FIGS. 8M and 8O, with the color coding system, a caregiver can easily assemble the hoses to the proper bladders, by connecting the appropriate tubes from the patient leg turning bladders 870 toward bladders 810, in the direction of arrow 890.

In some embodiments, patient leg turning device 865 may further comprise one or more patient leg retention blocks 880. Fastener 885*a* may be affixed to a top surface of the bladders 870, either as one or more strips, on a substantial portion, or on an entire portion of the top surface. Corresponding fastener 885*b* may be provided on one or more surfaces of each patient leg retention block 880. Patient leg retention block 880 may have an isosceles or equilateral triangular profile, as opposed to the right or irregular triangular profile of the blocks 850 or 855, but would otherwise be similar, or identical, to the blocks 850 or 855 as described in detail above. In FIGS. 8K-8P, although one patient leg retention block 880 is shown, the various embodiments are not so limited, and a pair of blocks 880 may be used to retain both of the patient's legs together or three blocks 880 may be used with two outer blocks to bracket the two legs and a middle block separating the two legs. The leg retention blocks 880 serve a similar function as blocks 850—namely, the leg retention blocks 880 serve to prevent the patient's legs from wandering while the patient turning and lifting device 800 (and thus the patient leg turning device 865) is in operation, turning the patient (and her legs) from side to side. In some cases, U-shaped blocks may be used, with the fastener 885*b* on the bottom surface of the base of the "U" and each of the patient's legs fitting over the opening of the "U" to be bracketed by the sides of the "U."

In FIG. 8, the semi-circular indentation or cut-out in support structure 805 that faces opposite patient leg turning device 865 allows the patient's sacrum to be supported, without applying pressure directly on the sacrum while the patient is lying on the support structure 805 (a similar structure is shown, e.g., in support structures 205, 305, 405, 505, and 605).

The patient turning and lifting device 800 including the support structure 805, the bladders 810, the lifting straps 815, the blocks 850 and 855, and the various hoses and tubes connecting pumps to the one or more gas or pump interfaces 820, in some embodiments, are intended to be disposable, to serve a similar purpose as disposable pad or disposable patient interface layer 225 or 525—namely, for sanitary and/or hygiene reasons. Likewise, the patient leg turning device 865 including the bladders 870, the lifting straps 875, the blocks 880, and the various hoses and tubes connecting the bladders 810 to the bladders 870, in some cases, are intended to be disposable, for similar reasons.

The patient turning and lifting system, as well as the process of automatically turning and lifting the patient, of FIG. 8 may otherwise be similar, if not identical, to the patient turning and lifting system, as well as the process of automatically turning and lifting the patient, as described in detail above with respect to FIGS. 1-7.

Figure 9:
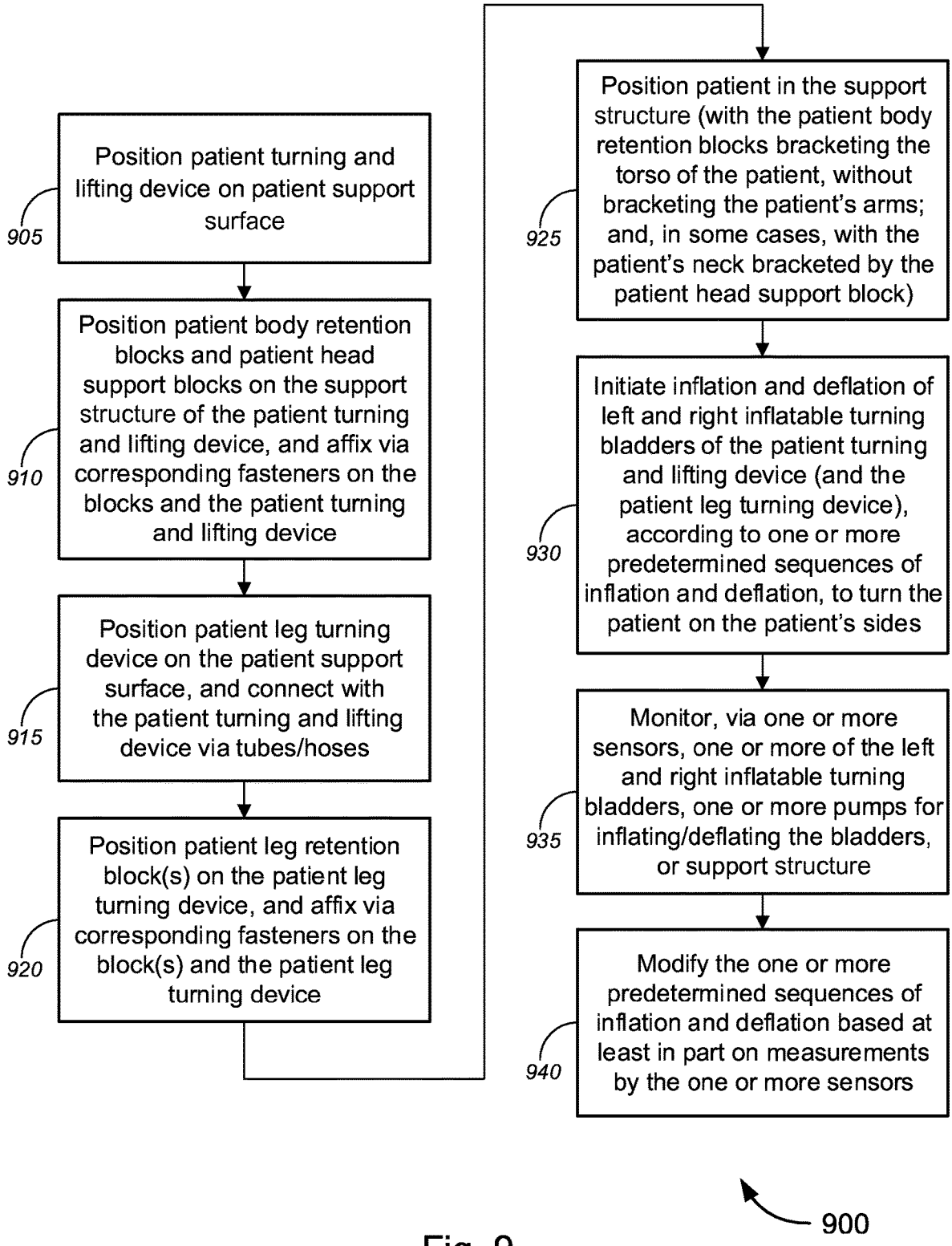
FIG. 9 is a general schematic flow diagram illustrating an alternative method for implementing automatic patient turning and lifting, in accordance with various embodiments.

In FIG. 9, a general schematic flow diagram is shown illustrating an alternative method 900 for implementing automatic patient turning and lifting, in accordance with various embodiments. At block 905, method 900 comprises positioning the patient turning and lifting device (e.g., patient turning and lifting device 800) on a patient support surface (e.g., support surface 535, which may include, without limitation, a mattress, bed, cot, floor, or the ground, etc.). Method 900, at block 910, includes positioning patient body retention blocks (e.g., blocks 850) and patient head support blocks (e.g., blocks 855) on the support structure (e.g., support structure 805) of the patient turning and lifting device, and affixing the blocks to the patient turning and lifting device via the corresponding fasteners (e.g., fasteners 860*a* and 860*b*).

Method 900 may optionally comprise positioning patient leg turning device (e.g., patient leg turning device 865) on the patient support surface, and connecting the patient leg turning device with the patient turning and lifting device via appropriate hoses and tubes (e.g., hoses and tubes of the one or more gas and vacuum interfaces 820) (block 915). At block 920, method 900 may optionally include positioning one or more patient leg retention blocks (e.g., one or more blocks 880) on the patient leg turning device, and affixing the blocks to the patient leg turning device via corresponding fasteners (e.g., fasteners 885*a* and 885*b*).

At block 925, method 900 comprises positioning the patient in the support structure—with the patient body retention blocks bracketing the torso of the patient. In some instances, the patient's torso may be bracketed by the patient body retention blocks, without bracketing the patient's arms. In some cases, the patient's neck and head may be bracketed by the patient head support block. Because the retention blocks are configured to be removably attachable to the support structure, the blocks may be adjusted in terms of position and orientation to comfortably and securely bracket the patient's torso (and, in some cases, also the patient's head and/or neck), without significantly restricting movement of the patient's arms.

With the patient comfortably secured in the patient turning and lifting device, inflation and deflation of the left and right inflatable turning bladders of the patient turning and lifting device (and the left and right bladders of the patient leg turning device, if applicable) is initiated, at block 930, according to one or more predetermined sequences of inflation and deflation, in order to turn the patient on the patient's side(s) (i.e., onto one side of the patient, from one side to another side of the patient, and/or from one side of the patient to a flat state, etc.). For example, the one or more predetermined sequences of inflation and deflation may include, without limitation, one or more of a sacrum sore cycle, a left sore cycle, a right sore cycle, and a preventive mode, as described in detail above with respect to FIG. 2.

One or more of the left and right inflatable turning bladders (and the left and right bladders of the patient leg turning device, where appropriate), one or more pumps (including fluid pumps and/or vacuum pumps, etc.) for inflating/deflating the bladders, or the support structure are monitored, at block 935, via one or more sensors. In some instances, the one or more sensors may further include one or more patient sensors or may be communicatively coupled to existing patient monitoring devices typically connected to the patient for monitoring blood oxygen levels, blood pressure, heart-rate or pulse, or the like.

At block 940, the one or more predetermined sequences of inflation and deflation are selected or modified based at least in part on measurements by the one or more sensors. Throughout the process 900, a user (including, without limitation, a doctor, nurse, orderly, or other healthcare professional, or other caregiver) may manually interact with the control device (e.g., control device 135 or 540) using input devices on the control device or remotely interact with the control device (e.g., control device 135 or 540) either wirelessly or in a wired manner, either directly or indirectly over a network and/or server (such as network 170 and/or server 175), as described in detail above with respect to FIG. 1.

Figure 10A:
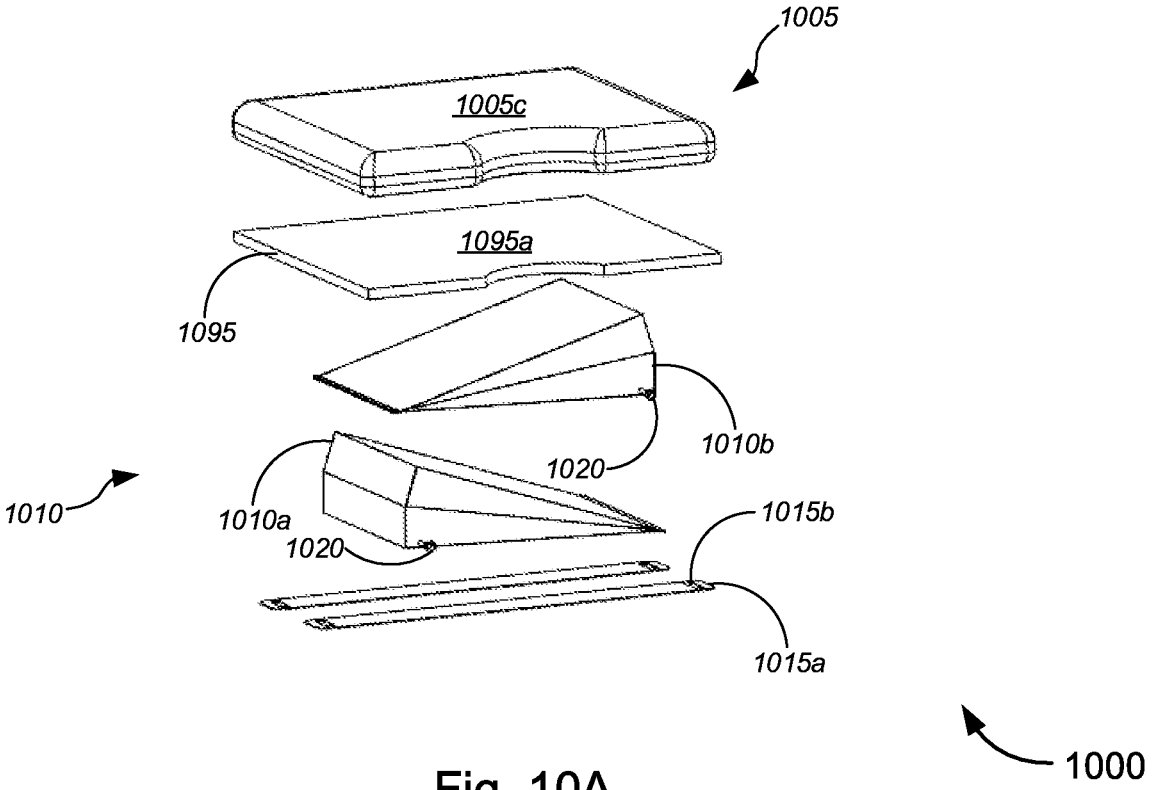
FIGS. 10A-10N are general schematic diagrams illustrating various views of still another embodiment of a portable device for automatic patient turning and lifting.
Figure 10B:
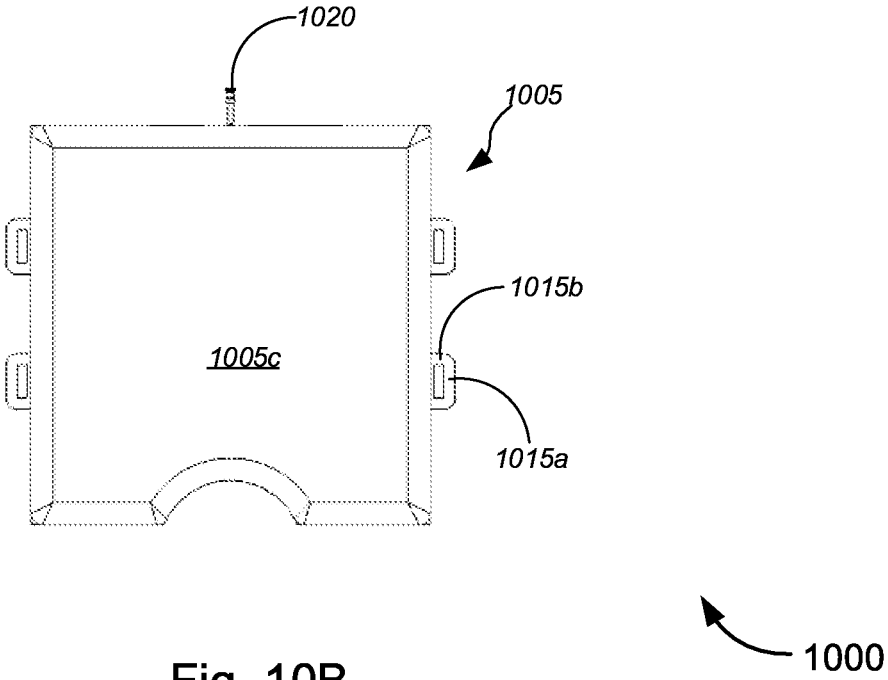
Figure 10C:
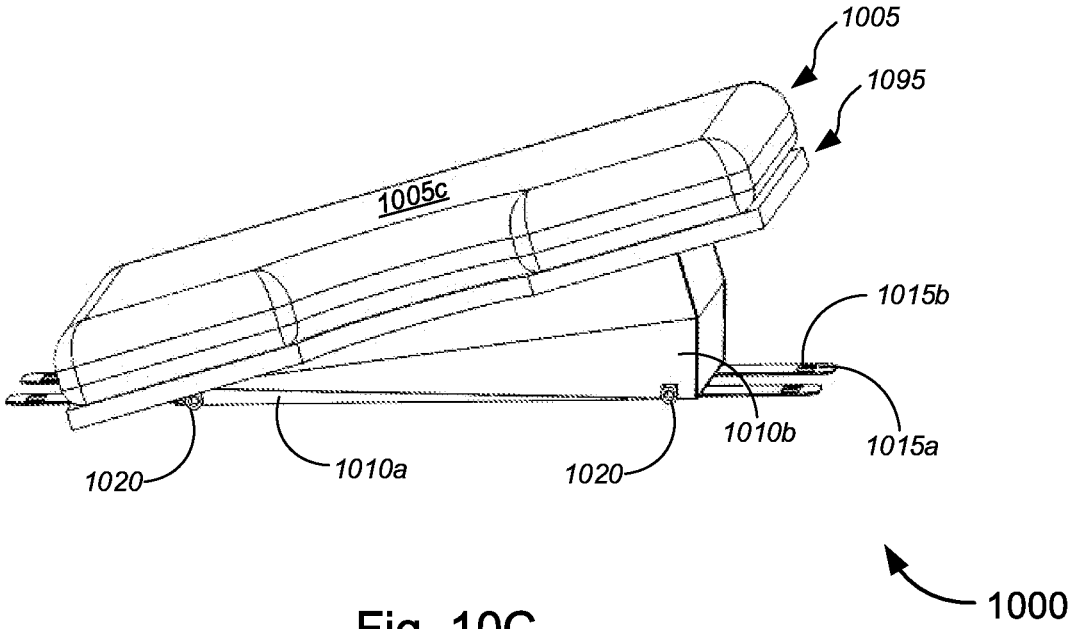
Figure 10D:
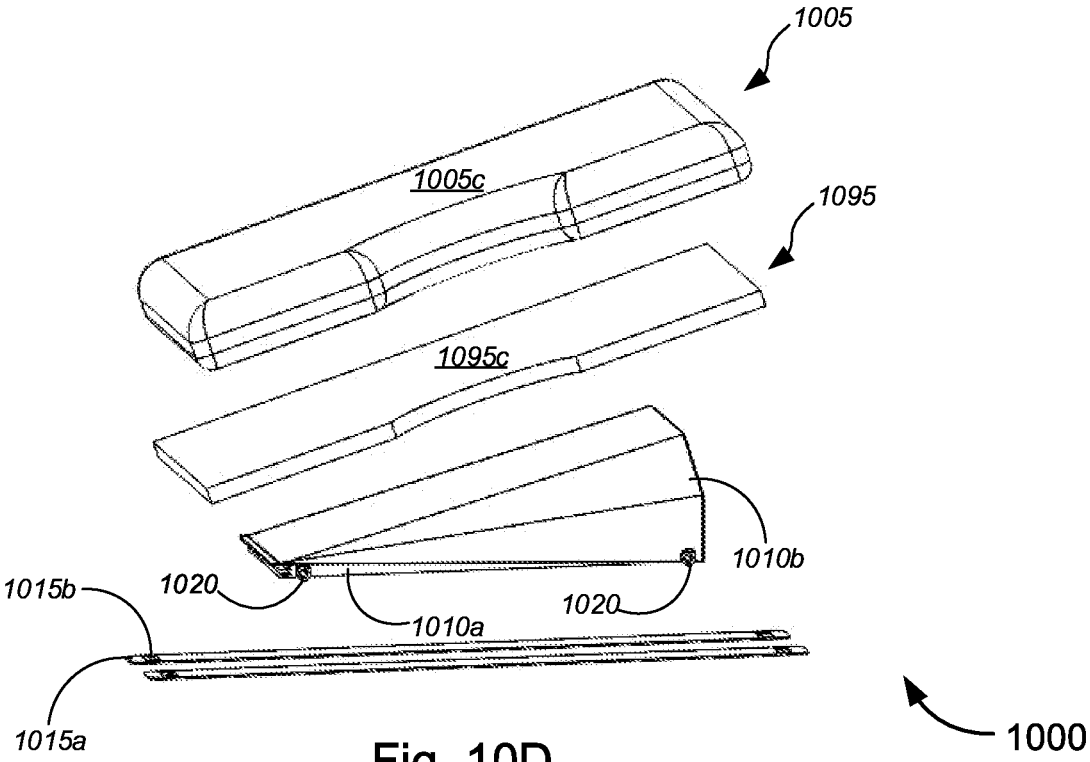
Figure 10E:
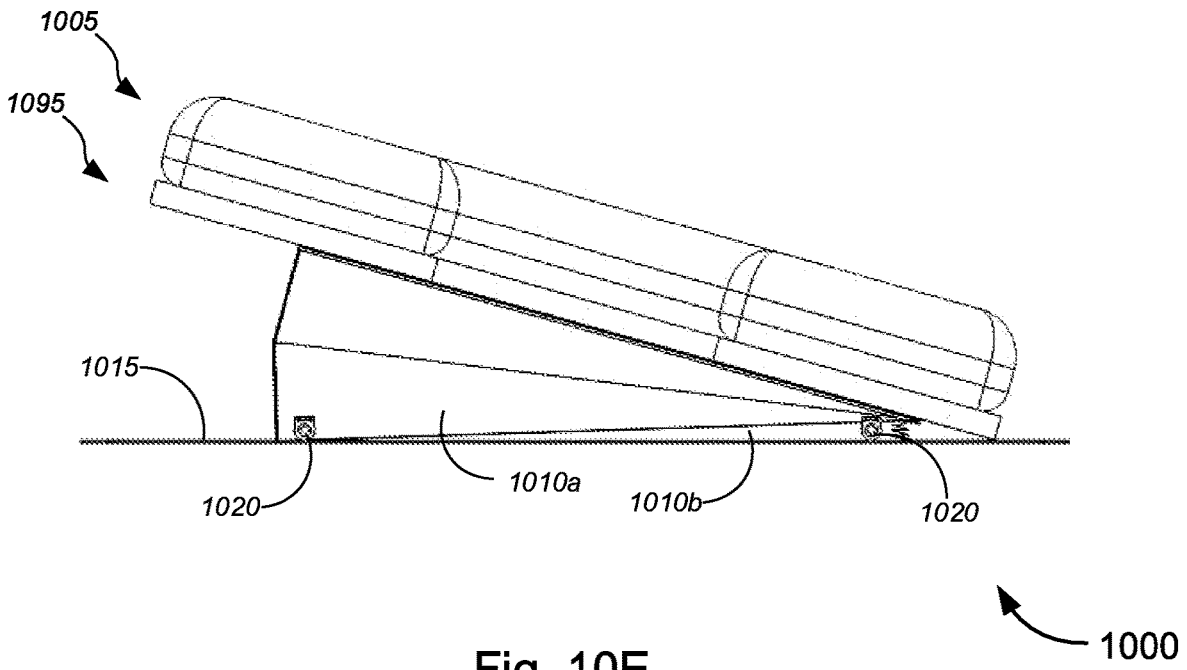
Figure 10F:
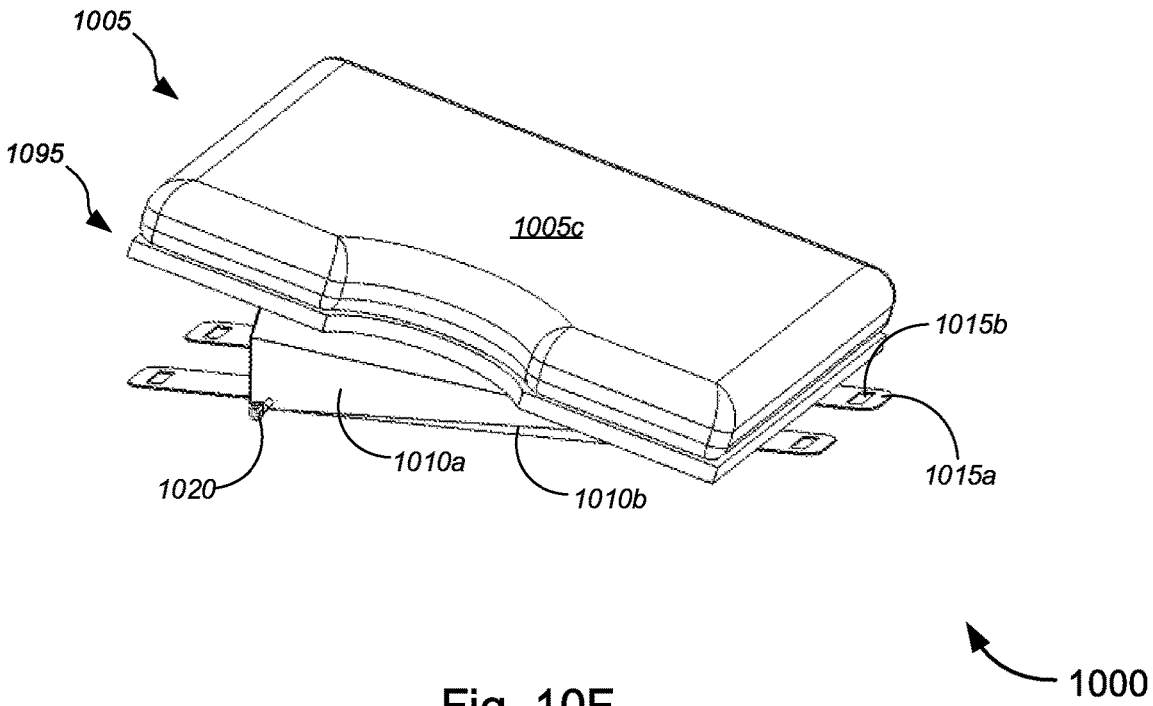
Figure 10G:
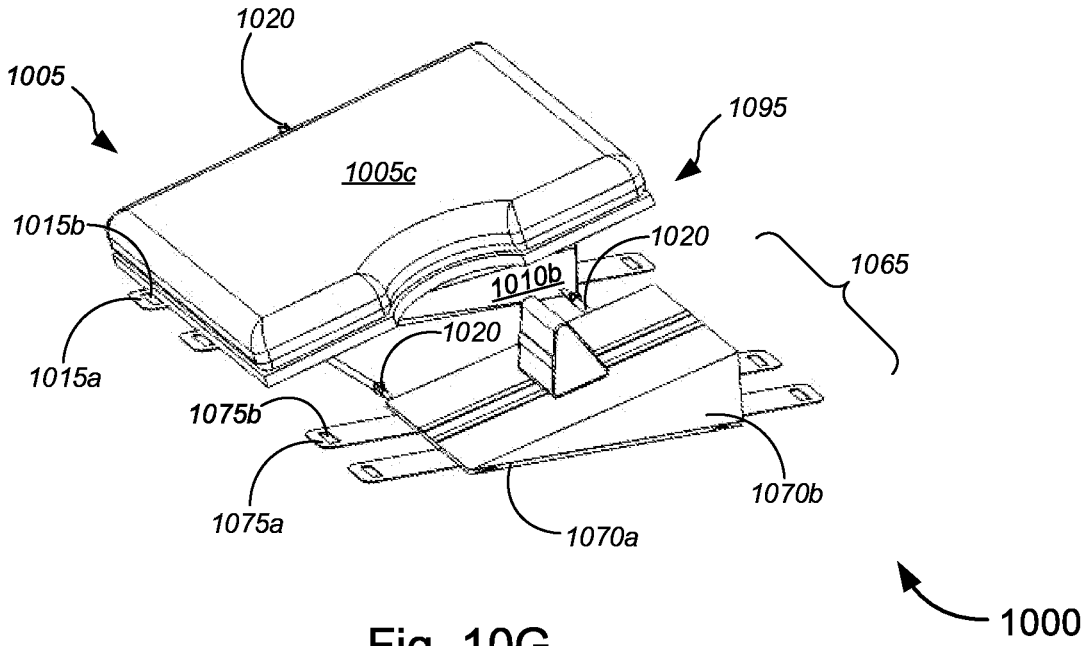
Figure 10H:
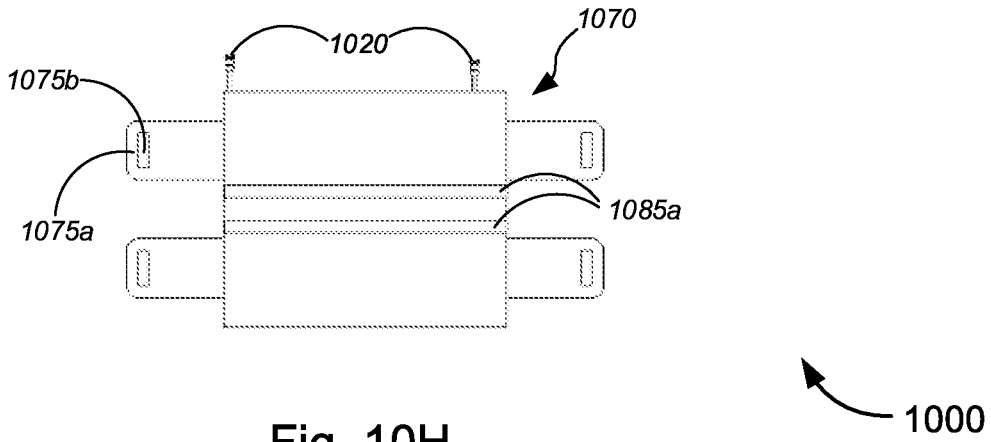
Figure 10I:
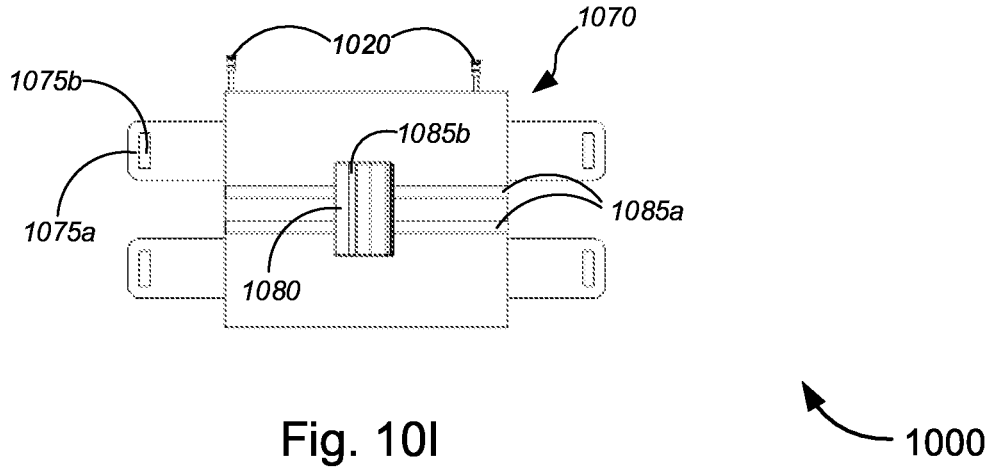
Figure 10J:
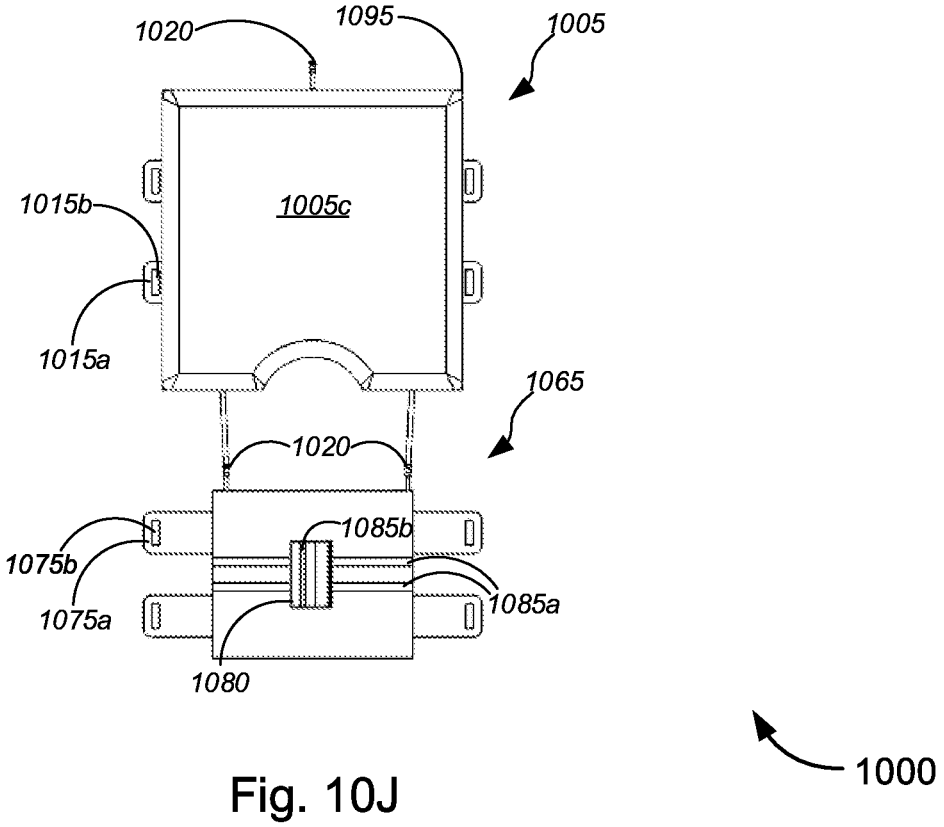
Figure 10K:
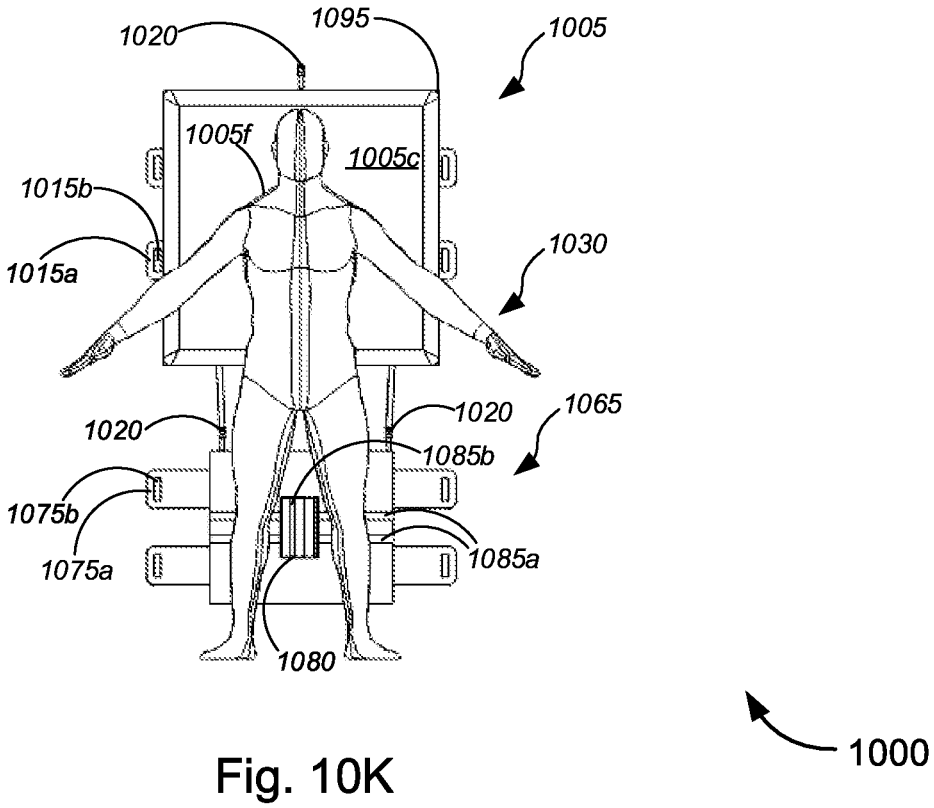
Figure 10L:
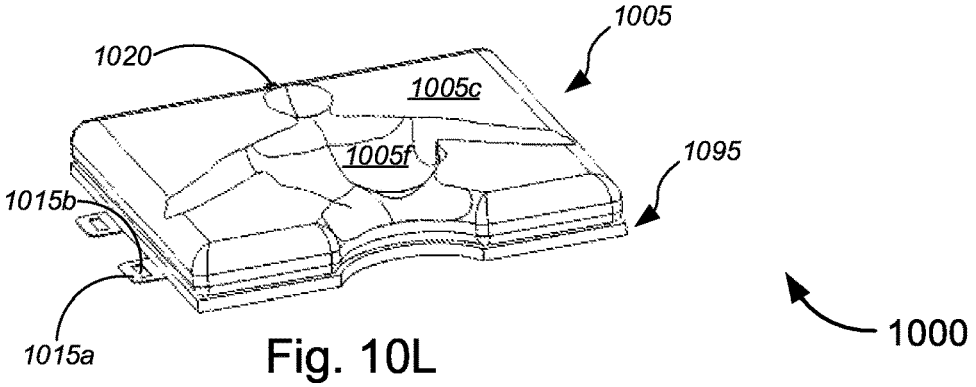
Figure 10M:
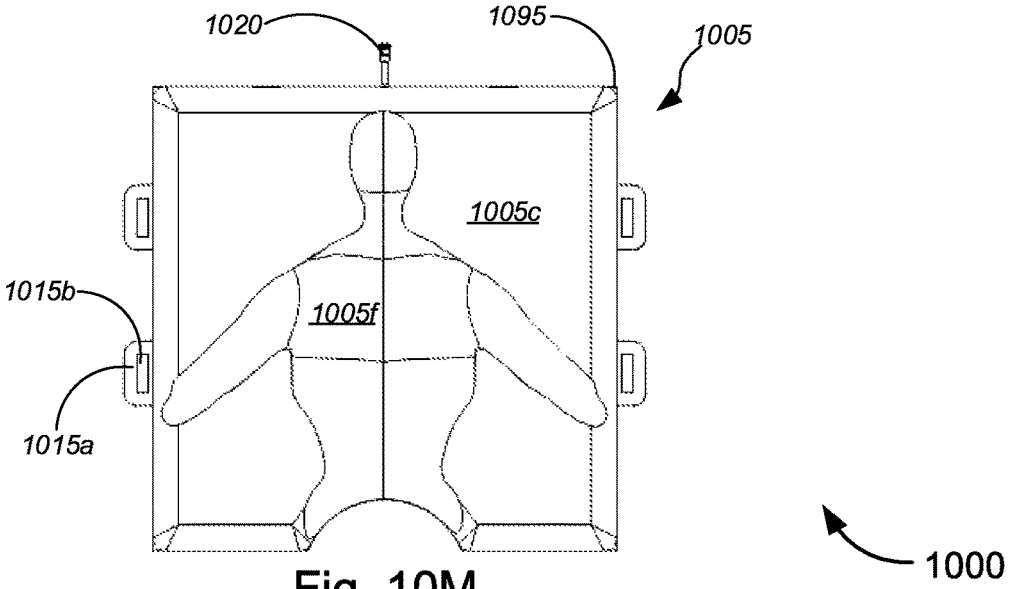
Figure 10N:
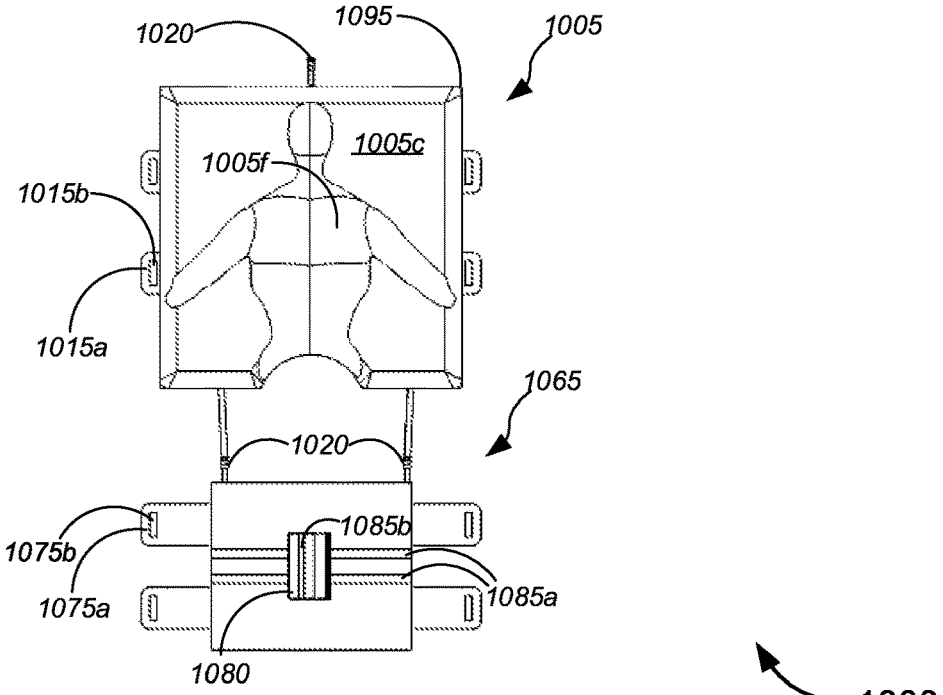

Turning to FIGS. 10A-10N (collectively, "FIG. 10"), general schematic diagrams are shown illustrating various views of still another embodiment 1000 of a portable device for automatic patient turning and lifting. In FIG. 10, patient turning and lifting device 1000, support structure 1005, one or more sets of inflatable turning bladders 1010, one or more pairs of lifting straps 1015, one or more gas or pump interfaces 1020, patient leg turning device 1065, inflatable leg turning bladders 1070, one or more pairs of lifting straps 1075*a* each including one or more handles 1075*b* formed therein, one or more patient leg retention blocks 1080, and fasteners 1085*a* and 1085*b* generally correspond to the same components of patient turning and lifting device 800 as shown and described in detail above with respect to FIG. 8. As in embodiment 800, in some instances, patient turning and lifting device 1000 may include patient leg turning device 1065, while, in other cases, patient turning and lifting device 1000 may function without patient leg turning device 1065.

Patient turning and lifting device may further comprise a rigid board 1095 having length and width dimensions substantially matching the length and width dimensions of support structure 1005 (including the semi-circular indentation or cut-out for the patient's sacrum), although the height dimension of the board 1095 may be significantly smaller compared with the height dimension of the support structure 1005. The rigid board may be made of any rigid material including, but not limited to, wood, wood composites, metal, plastics, etc. In some cases, the rigid board 1095 may be a support structure similar to support 1005, except thinner; the board 1095 becomes rigid by evacuating the air or gas from within the support structure of the board 1095.

With reference to FIGS. 10K-10N, rather than the use of blocks 850 and 855 (and corresponding fasteners 860*a* and 860*b*), support structure 1005 may itself be used to prevent patient wandering during the patient turning and lifting operation. In particular, with patient turning and lifting device 1000 (and in some embodiments, also with patient leg turning device 1065) assembled and positioned on a patient support surface (e.g., a mattress, bed, cot, floor, or the ground, etc.), a patient may be positioned on the device 1000, while support structure 1005 still retains some air or gas. With the patient's weight causing a depression 1005*f* in the support structure, the particles within the support structure (as constrained by the external material of the support structure itself together with the weight of the patient's body) would loosely conform to the shape of the patient's body that is in contact with the support structure. By evacuating the air or gas from support structure 1005, after loose conformation of the shape of support structure 1005 with the shape of the patient's body (i.e., with the patient still positioned on support structure 1005), the particles would compress against each other (and the patient's body) to form a resilient structure having a depression 1005*f* (more firmly or fully) conforming to the shape of the patient's body.

In some embodiments, support structure 1005 may be partitioned or may include separate pockets distributed throughout the interior of an outer casing of the support structure, each partitioned portion or separate pocket being configured to hold a plurality of particles, not unlike the separate pockets as described above with respect to FIG. 2. The partitioned portions or separate pockets may be made of any suitable material that is able to hold the particles, while allowing air or gas to pass therethrough; such suitable material may include, but is not limited to, cotton, linen, perforated polymers (such as perforated versions of the material used for the outer casing), or the like.

With the patient positioned within the depression 1005*f* that fully conforms to the portion of the patient body in contact with the support structure 1005, any wandering of the patient during patient turning and lifting may be inhibited, in a similar manner as with the use of the blocks 850 and 855.

The patient turning and lifting system, as well as the process of automatically turning and lifting the patient, of FIG. 10 may otherwise be similar, if not identical, to the patient turning and lifting system, as well as the process of automatically turning and lifting the patient, as described in detail above with respect to FIGS. 8 and 9 (as well as FIGS. 1-7).

Figure 11:
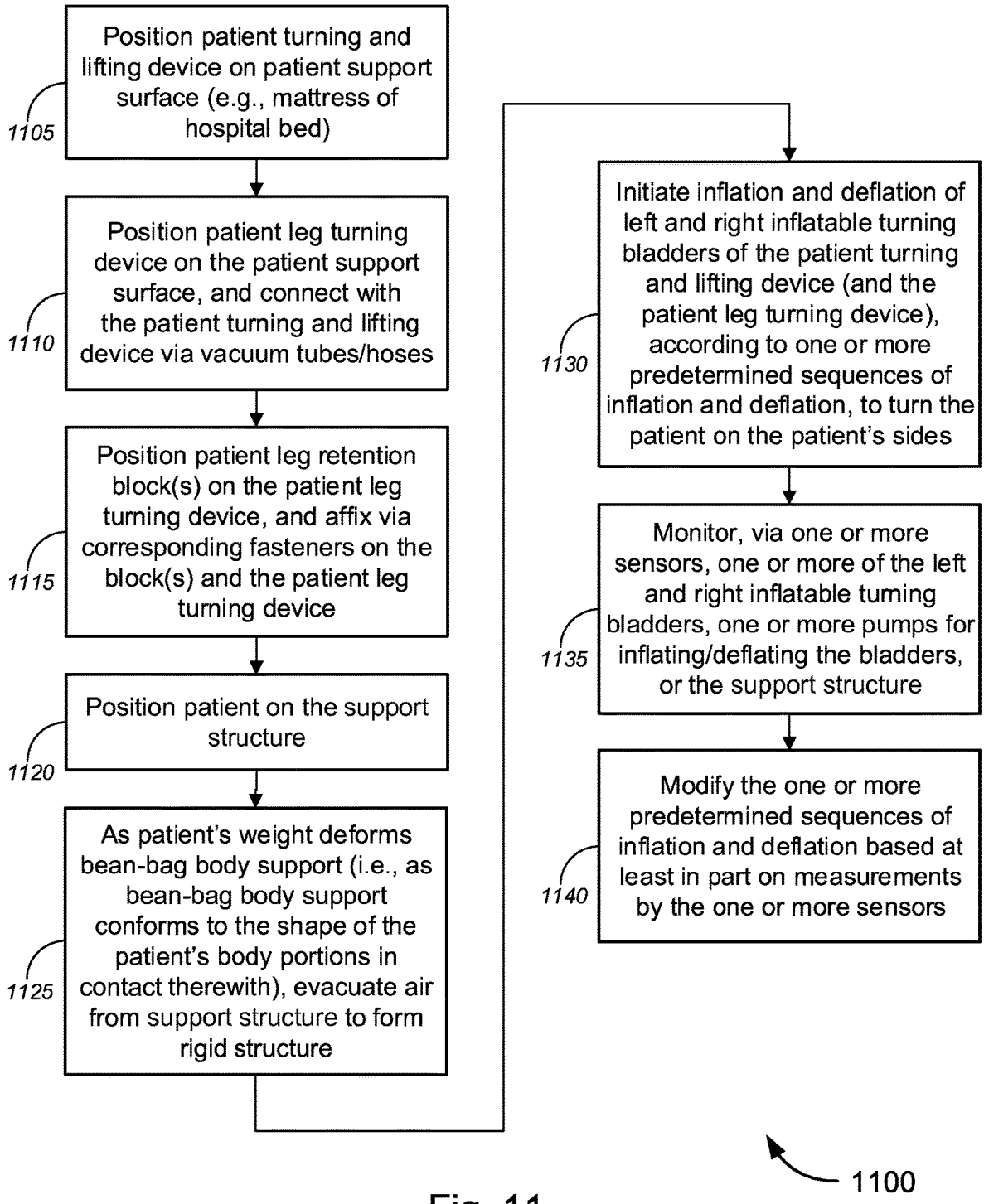
FIG. 11 is a general schematic flow diagram illustrating another alternative method for implementing automatic patient turning and lifting, in accordance with various embodiments.

In FIG. 11, a general schematic flow diagram illustrating another alternative method 1100 for implementing automatic patient turning and lifting, in accordance with various embodiments. At block 1105, method 1100 comprises positioning the patient turning and lifting device (e.g., patient turning and lifting device 1000) on a patient support surface (e.g., support surface 535, which may include, without limitation, a mattress, bed, cot, floor, or the ground, etc.).

Method 1100 may optionally include positioning patient leg turning device (e.g., patient leg turning device 1065) on the patient support surface, and connecting the patient leg turning device with the patient turning and lifting device via appropriate hoses and tubes (e.g., hoses and tubes of the one or more gas and vacuum interfaces 1020) (block 1110). At block 1115, method 1100 may optionally include positioning one or more patient leg retention blocks (e.g., one or more blocks 1080) on the patient leg turning device, and affixing the blocks to the patient leg turning device via corresponding fasteners (e.g., fasteners 1085*a* and 1085*b*).

Method 1100 comprises, at block 1120, positioning a patient on the support structure. As the patient's weight deforms the support structure (i.e., so as to loosely conform to the shape of the patient's body portions that are in contact therewith), method 1100 comprises evacuating air from the support structure to form a rigid structure having a depression (e.g., depression 1005*f*) having a shape (more firmly or fully) conforming to the patient's body portions (block 1125).

With the patient comfortably secured in the patient turning and lifting device, inflation and deflation of the left and right inflatable turning bladders of the patient turning and lifting device (and the left and right bladders of the patient leg turning device, if applicable) is initiated, at block 1130, according to one or more predetermined sequences of inflation and deflation, in order to turn the patient on the patient's side(s) (i.e., onto one side of the patient, from one side to another side of the patient, and/or from one side of the patient to a flat state, etc.). For example, the one or more predetermined sequences of inflation and deflation may include, without limitation, one or more of a sacrum sore cycle, a left sore cycle, a right sore cycle, and a preventive mode, as described in detail above with respect to FIG. 2.

One or more of the left and right inflatable turning bladders (and the left and right bladders of the patient leg turning device, where appropriate), one or more pumps (including fluid pumps and/or vacuum pumps, etc.) for inflating/deflating the bladders, or the support structure are monitored, at block 1135, via one or more sensors. In some instances, the one or more sensors may further include one or more patient sensors or may be communicatively coupled to existing patient monitoring devices typically connected to the patient for monitoring blood oxygen levels, blood pressure, heart-rate or pulse, or the like.

At block 1140, the one or more predetermined sequences of inflation and deflation are selected or modified based at least in part on measurements by the one or more sensors. Throughout the process 1100, a user (including, without limitation, a doctor, nurse, orderly, or other healthcare professional, or other caregiver) may manually interact with the control device (e.g., control device 135 or 540) using input devices on the control device or remotely interact with the control device (e.g., control device 135 or 540) either wirelessly or in a wired manner, either directly or indirectly over a network and/or server (such as network 170 and/or server 175), as described in detail above with respect to FIG. 1.

Figure 12A:
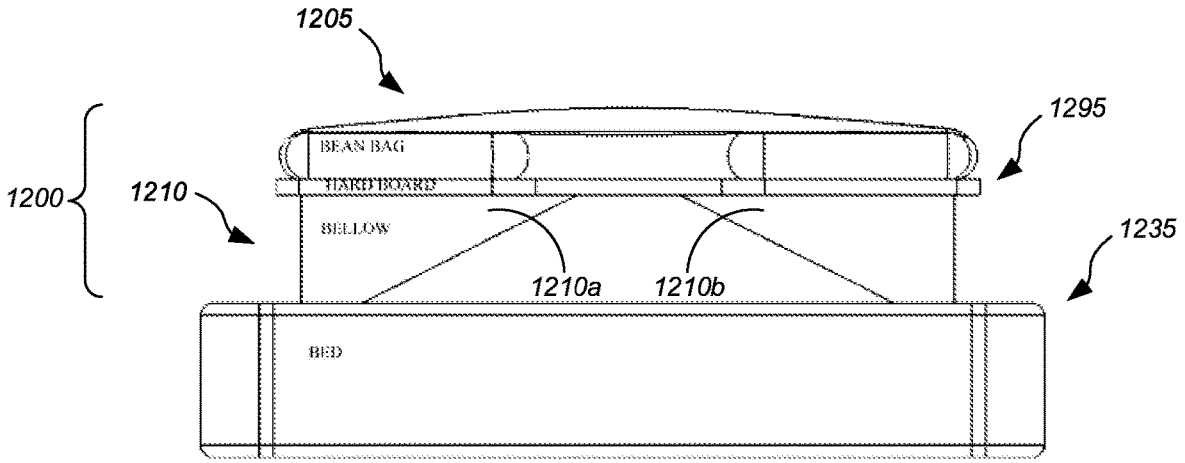
FIGS. 12A-12B are general schematic diagrams illustrating various views of another embodiment of a system for automatic patient turning and lifting.
Figure 12B:
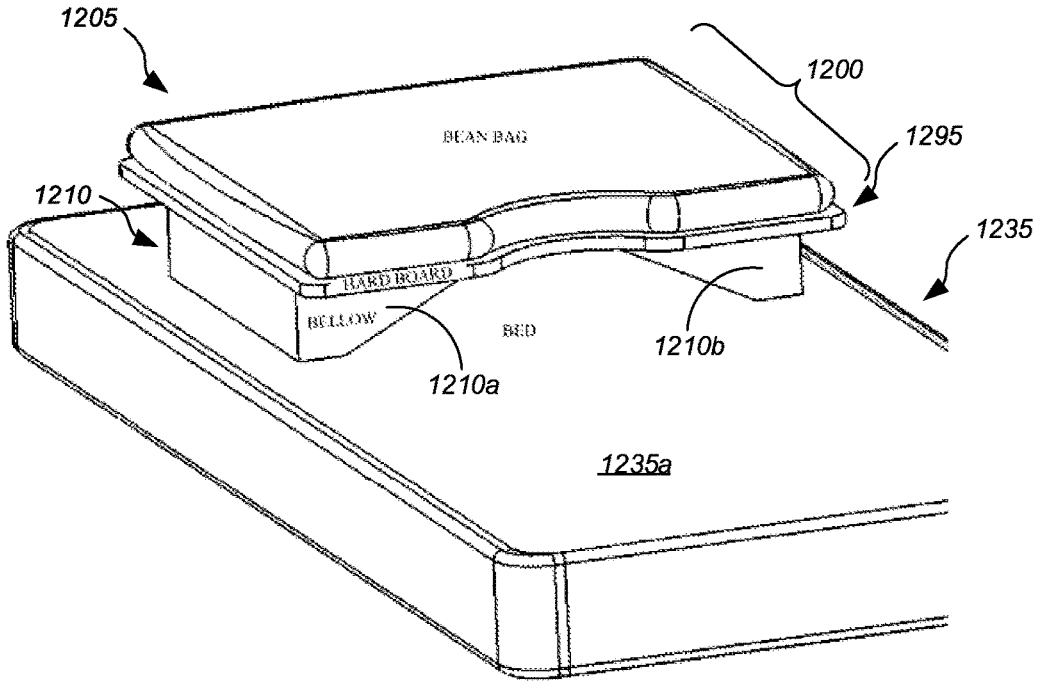

With reference to FIGS. 12A and 12B (collectively, "FIG. 12"), general schematic diagrams are shown illustrating various views of another embodiment of a system for automatic patient turning and lifting. In FIG. 12, patient turning and lifting device 1200, support structure 1205, one or more sets of inflatable turning bladders 1210, and rigid board 1295 generally correspond to the same components of patient turning and lifting device 1000 as shown and described in detail above with respect to FIG. 10. As in embodiments 800 and 1000, in some instances, patient turning and lifting device 1200 may include a patient leg turning device (as shown, e.g., in FIGS. 8 and 10), while, in other cases, patient turning and lifting device 1200 may function without a patient leg turning device.

In FIG. 12, patient turning lifting device 1200 rests on top surface 1235*a* of patient support surface 1235 (which includes, without limitation, a bed, a cot, a mattress, a floor, the ground, or the like). Rather than the overlapping wedge-shaped turning bladders 810, the turning bladders 1210 are each shaped as triangular prisms (in some cases, right-angled triangular prisms) having one side edge (having a rectangular surface) abutting an underside of rigid board 1295, with other side edge substantially perpendicular to the top surface 1235*a* (and/or substantially perpendicular to the planar surface of the rigid board 1295). The triangular prism is truncated across said other side edge so as to form a flat surface (instead of a "point" of the triangle (actually a corner edge of the three-dimensional structure)) in contact with top surface 1235*a*, the flat surface being substantially parallel with the one side edge abutting the underside of the rigid board 1295. When fully inflated, both bladders 1210*a* and 1210*b* form supporting "legs" on either side of support structure 1205.

The patient turning and lifting system, as well as the process of automatically turning and lifting the patient, of FIG. 12 may otherwise be similar, if not identical, to the patient turning and lifting system, as well as the process of automatically turning and lifting the patient, as described in detail above with respect to FIGS. 10 and 11 (as well as FIGS. 1-9).

Figure 13A:
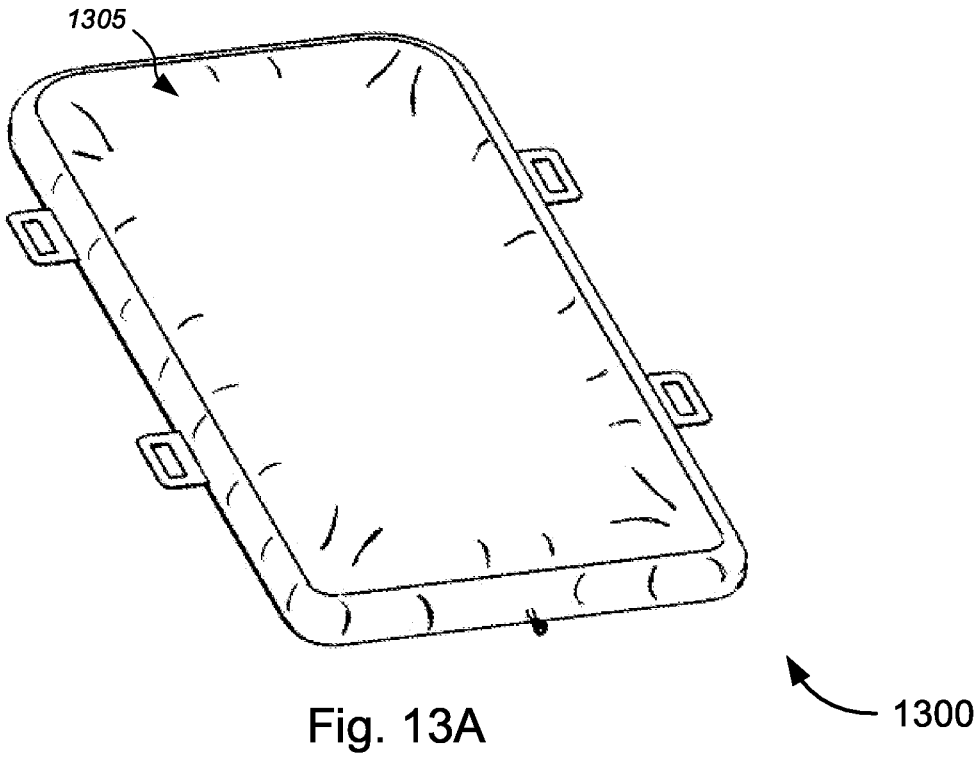
FIGS. 13A-13C are general schematic diagrams illustrating various views of an embodiment implementing contour blocks.
Figure 13B:
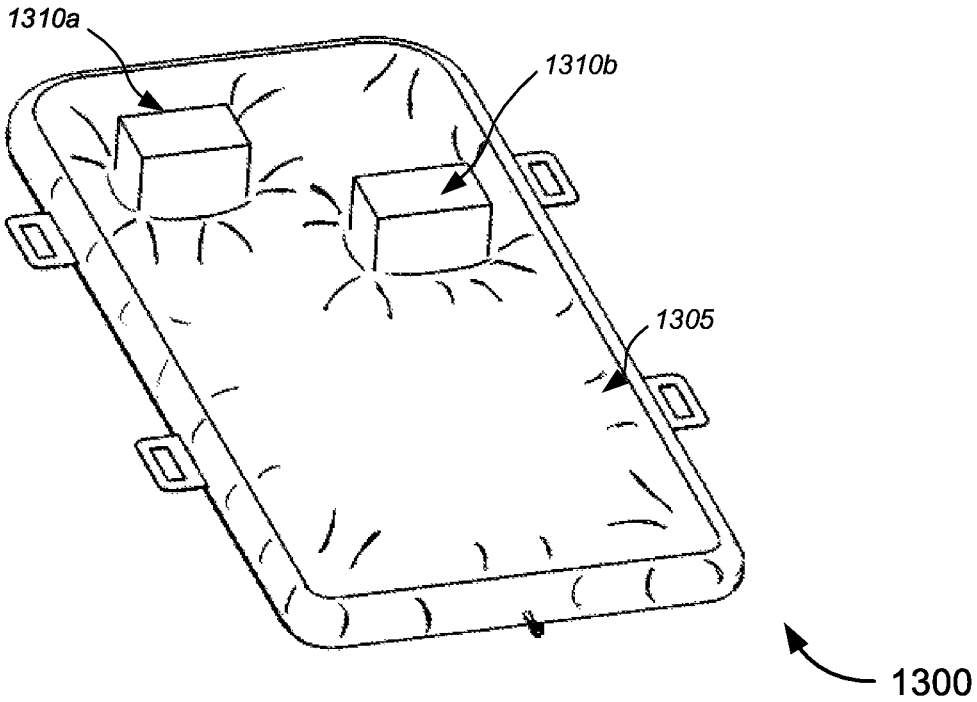
Figure 13C:
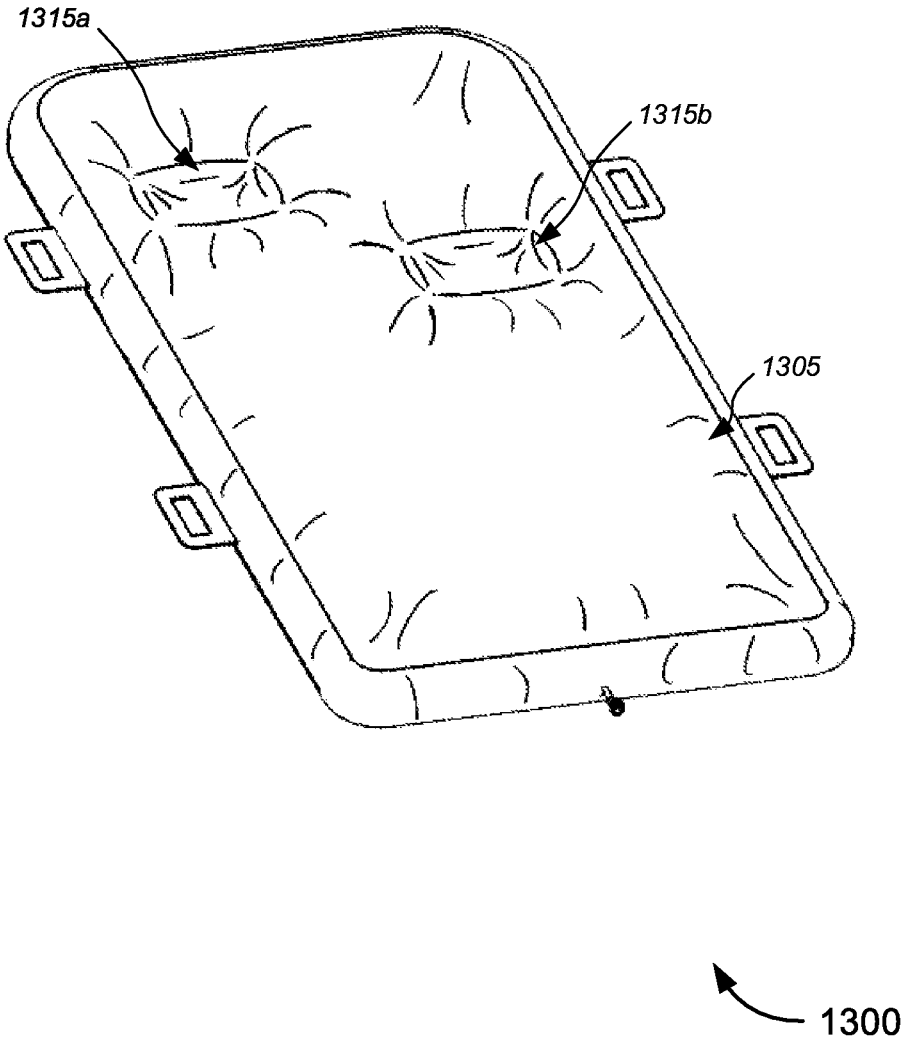

FIGS. 13A-13C illustrate various views of an embodiment implementing contour blocks 1300. The patient turning and lifting device 1300 may use contour blocks 1310*a* and 1310*b* to create depressions in the support structure 1305 to relieve pressure from being applied to the patient's body at specific points, thereby preventing bedsores from forming. FIG. 13A shows support structure 1305 without any contour blocks. In FIG. 13B, contour blocks 1310*a* and 1310*b* are placed under support structure 1305 at strategic points corresponding to pressure points where bedsores may form on the patient's body. As shown, contour blocks 1310*a* and 1310*b* have a generally cube-like structure. It is to be understood that contour blocks 1310*a* and 1310*b* are not limited to a cube shape, and can be made into different shapes, such as cylinders, other prismatic shapes, other irregular shape, or generally form fit the specific area needing relief from pressure. Furthermore, the contour blocks may be made from, but are not limited to, materials such as molded foam, or other material capable of holding its shape while positioned in/on the support structure. Once the contour blocks 1310*a* and 1310*b* are positioned, a vacuum is applied to the support structure creating a negative pressure such that the support structure conforms around the shape of the contour blocks. Once the support structure is under negative pressure, the contour blocks 1310*a* and 1310*b* are removed. At FIG. 13C, cavities 1315*a* and 1315*b* are revealed. Using this technique, one can create a cavity to insure that there will be no pressure exerted on an existing pressure ulcer.

Figure 14A:
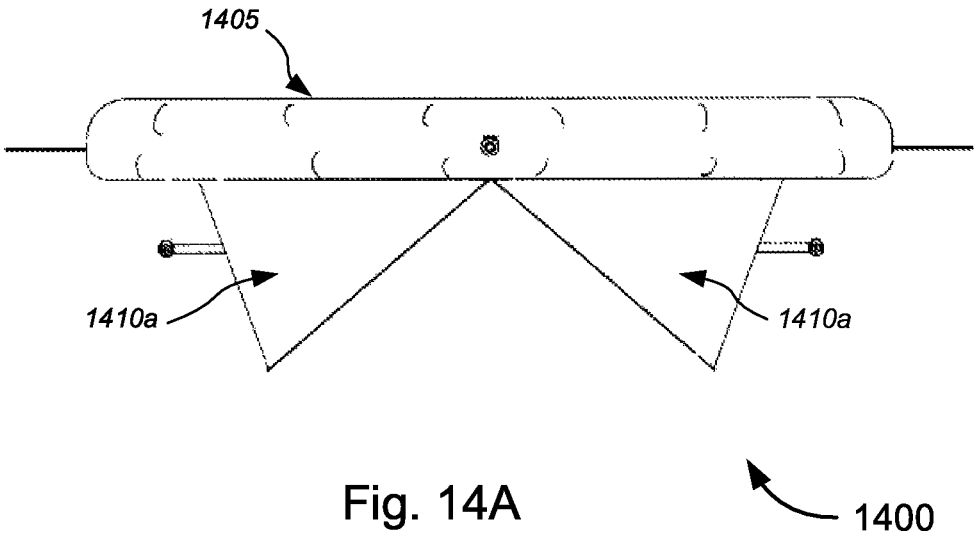
FIGS. 14A-14I are general schematic diagrams illustrating various views of embodiments implementing various inflatable bladder designs with a support structure.
Figure 14B:
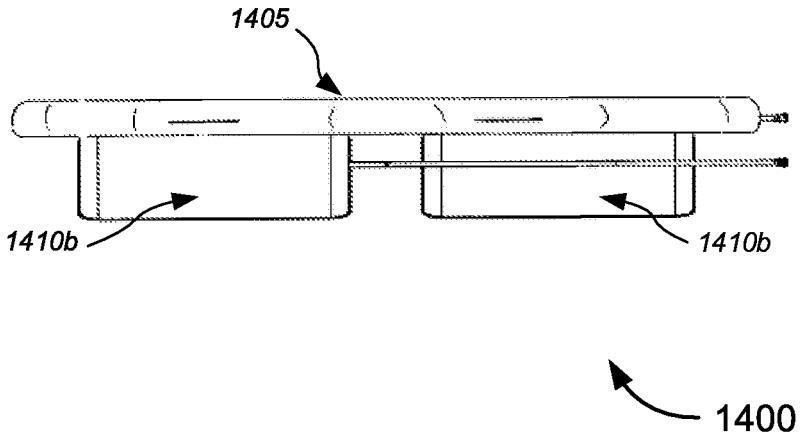

FIGS. 14A-14I illustrates alternative bladder designs for the patient turning and lifting system 1400. FIG. 14A shows the patient turning and lifting system 1400 from a bottom end elevation view. System 1400 includes two separate, bellow-shaped bladders 1410*a* on the right side and 1410*b* on the left side of the support structure. FIG. 14B shows a left-side view of the patient turning and lifting system 1400. The left-side view reveals a pair connected left side bladder 1410*b* under support structure 1405.

Figure 14C:
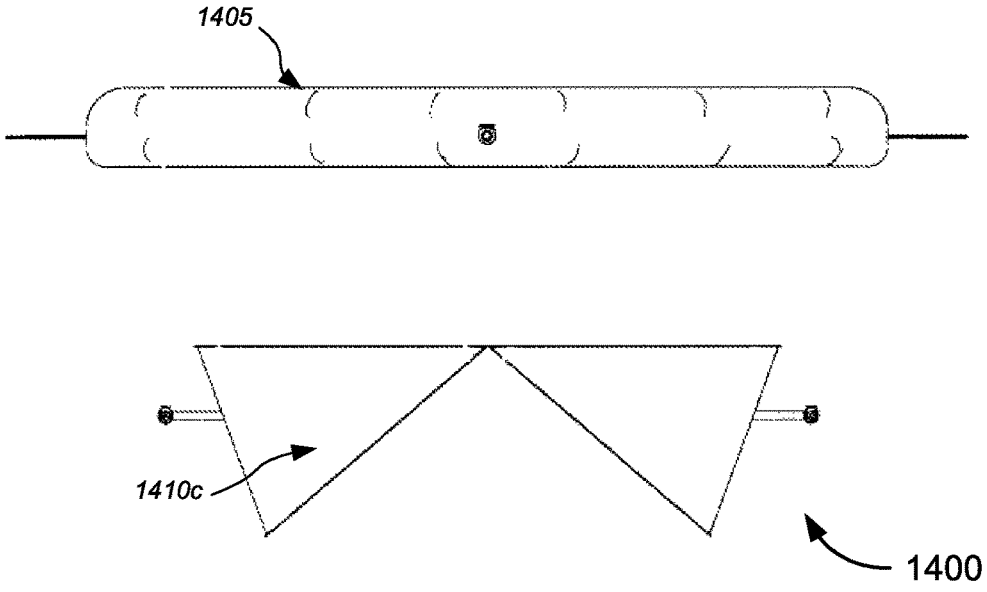
Figure 14D:
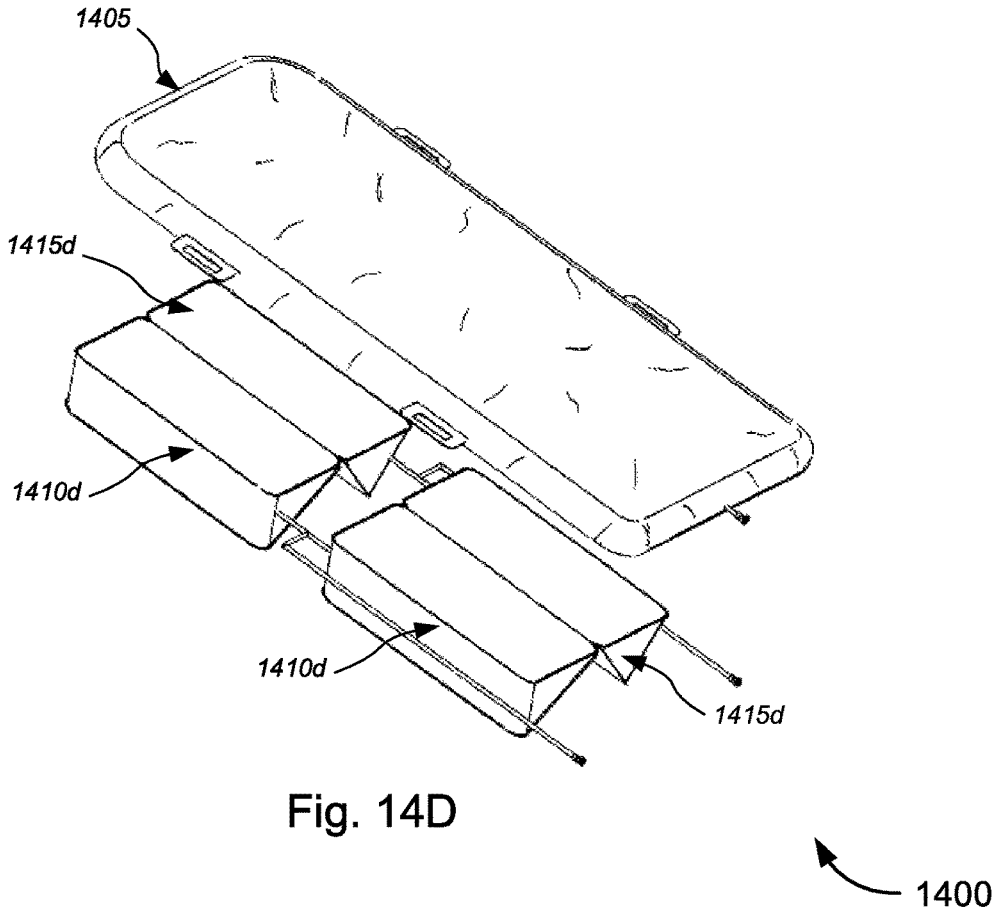

FIG. 14C illustrates the system 1400 with bladder 1410*c* and support structure 1405 separated from each other. FIG. 14D shows a side perspective view of system 1400 with having two pairs of connected bladders under either side of support structure 1405. A pair of bladders 1410*d* are positioned under the left side of support structure 1405, and a pair of bladders 1415*d* are positioned under the right side of the support structure 1405. Instead of two long bladders under either side of the support structure 1405, the left side bladder 1410*d* is separated into two separate bladders, and the right side bladder 1415*d* is separated into two separate bladders. Thus, four separate bladders are used to do the lifting, with that each side having two bladders lifting simultaneous. This added separation allows the bed to be adjusted into a folded position, such as the Fowler's position, while still being able to operate the bladder system, as will be described in more detail with respect to FIG. 14I.

Figure 14E:
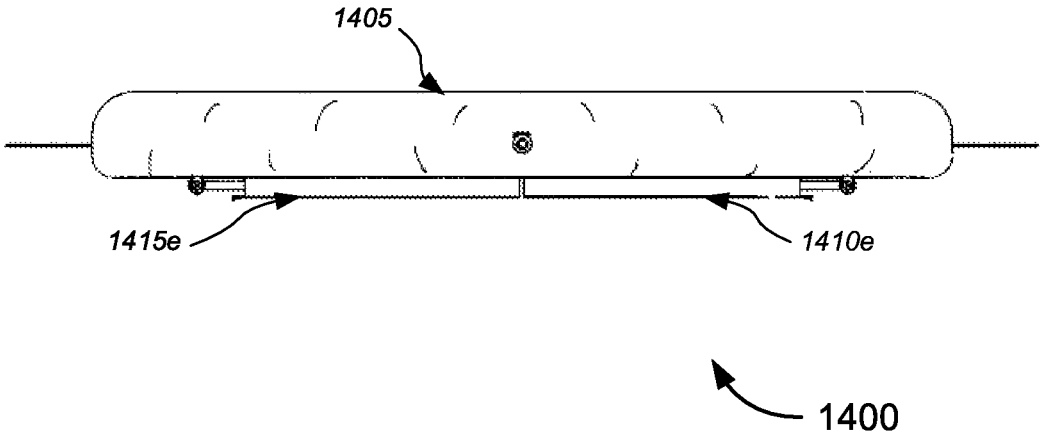
Figure 14F:
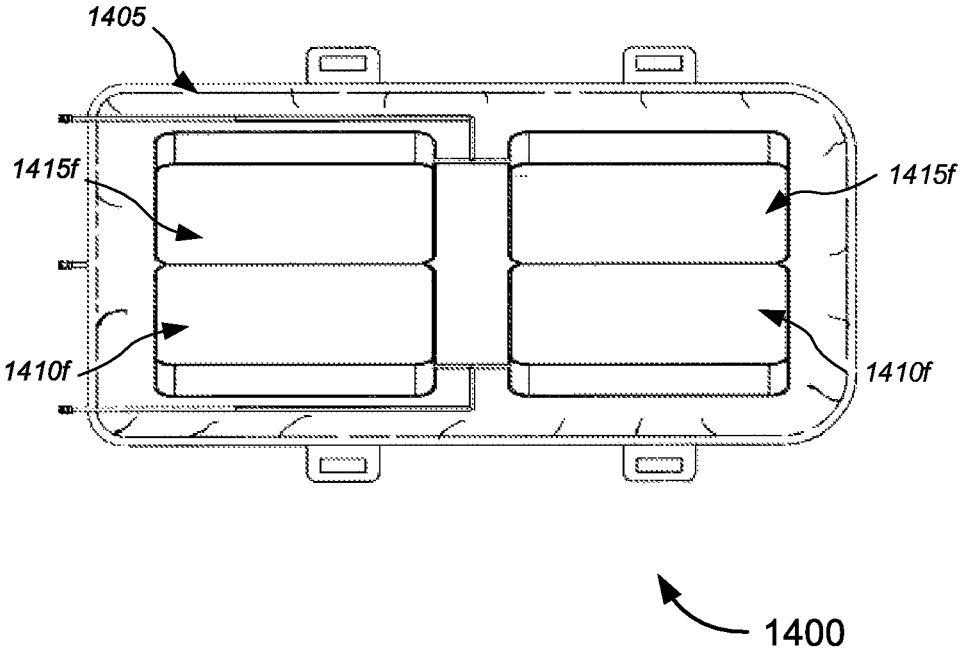

FIG. 14E is an elevation view from the bottom end of the patient lifting and turning system 1400. Here, support structure 1405 rests atop left bladders 1415*e* and right bladders 1410*e*, with both pairs of bladders deflated. FIG. 14F shows a bottom plan view of the patient lifting and turning system 1400 with both pairs of bladders 1415*f* and 1410*f* inflated.

Figure 14G:
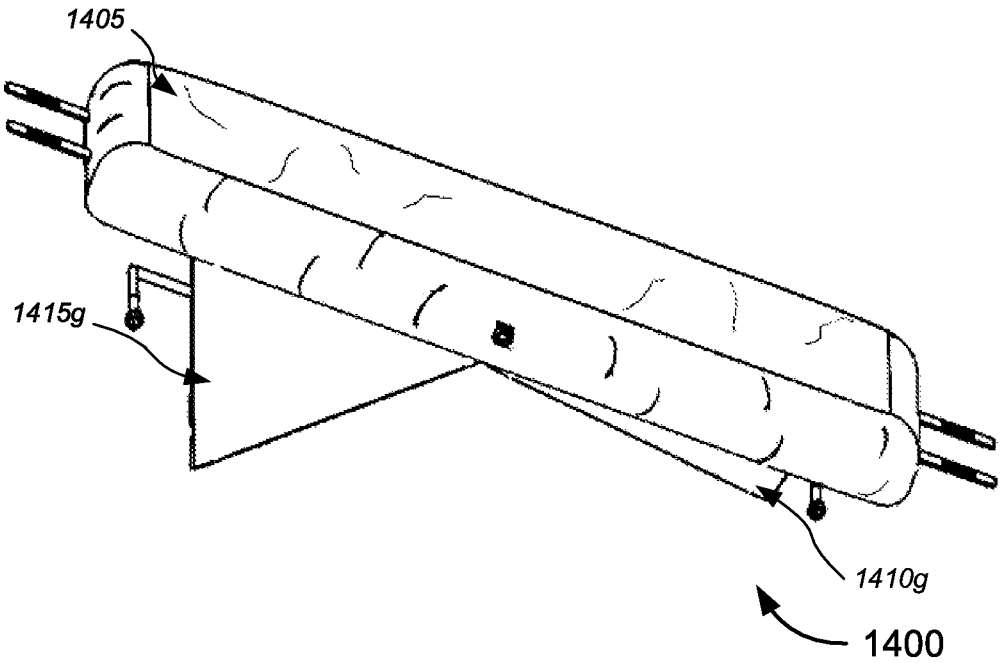
Figure 14H:
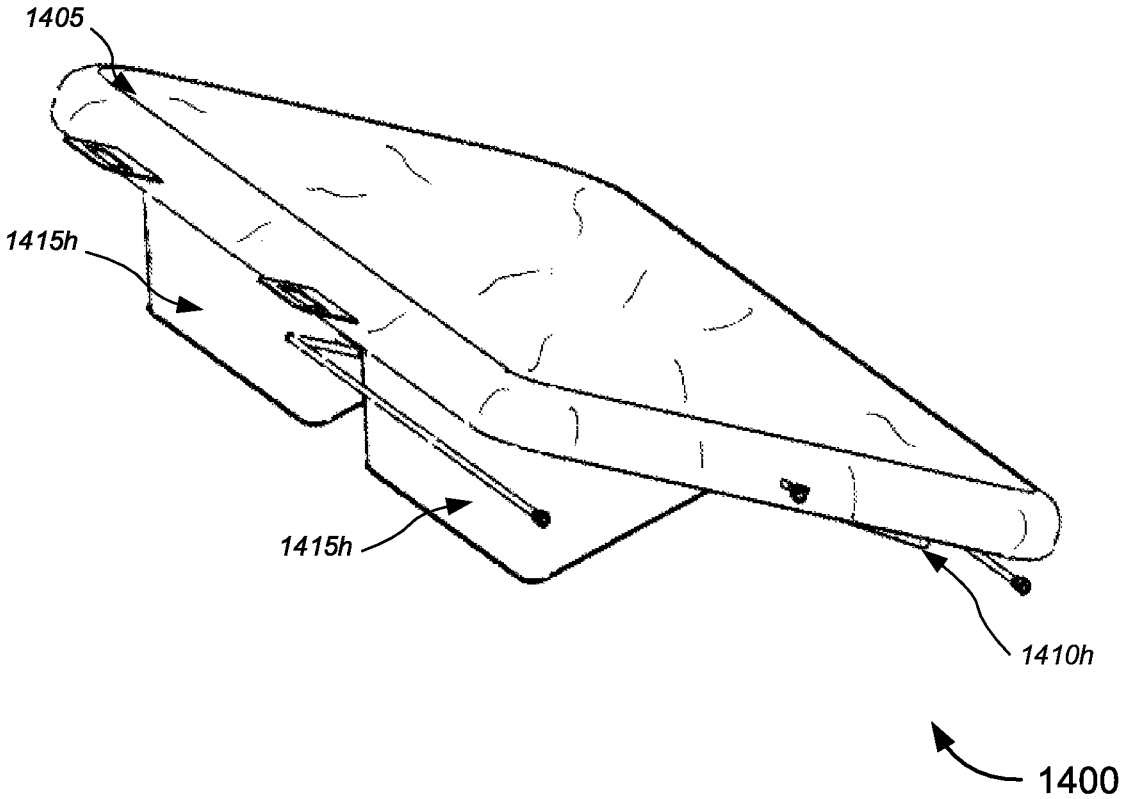

FIGS. 14G and 14H show the patient lifting and turning system with only the left side bladders 1415*g*, 1415*h* inflated. FIGS. 14G and 14H show different perspective views of the same left side bladders 1415*g*, 1415*h*, and right side bladders 1410*g*, 1410*h*.

FIG. 14G is a perspective view showing only one bladder of the pair of left side bladders 1415*g*, and only one bladder of the pair of right side bladders 1410*g*. FIG. 14H is a perspective view showing both bladders of the pair of left bladders 1415*h*, but only showing one bladder of the pair of right bladders 1410*h*. The right side bladders 1410*g*, 1410*h* and left side bladders 1415*g*, 1415*h* can be inflated independently from each another. Therefore, in other embodiments, the left side bladders 1415*g*, 1415*h* may be deflated and right side bladders 1410*g*, 1410*h* may be inflated. In yet other embodiments, each of sides 1410*g*, 1410*h* & 1415*g*, 1415*h*, may independently be inflated to different inflation levels.

Figure 14I:
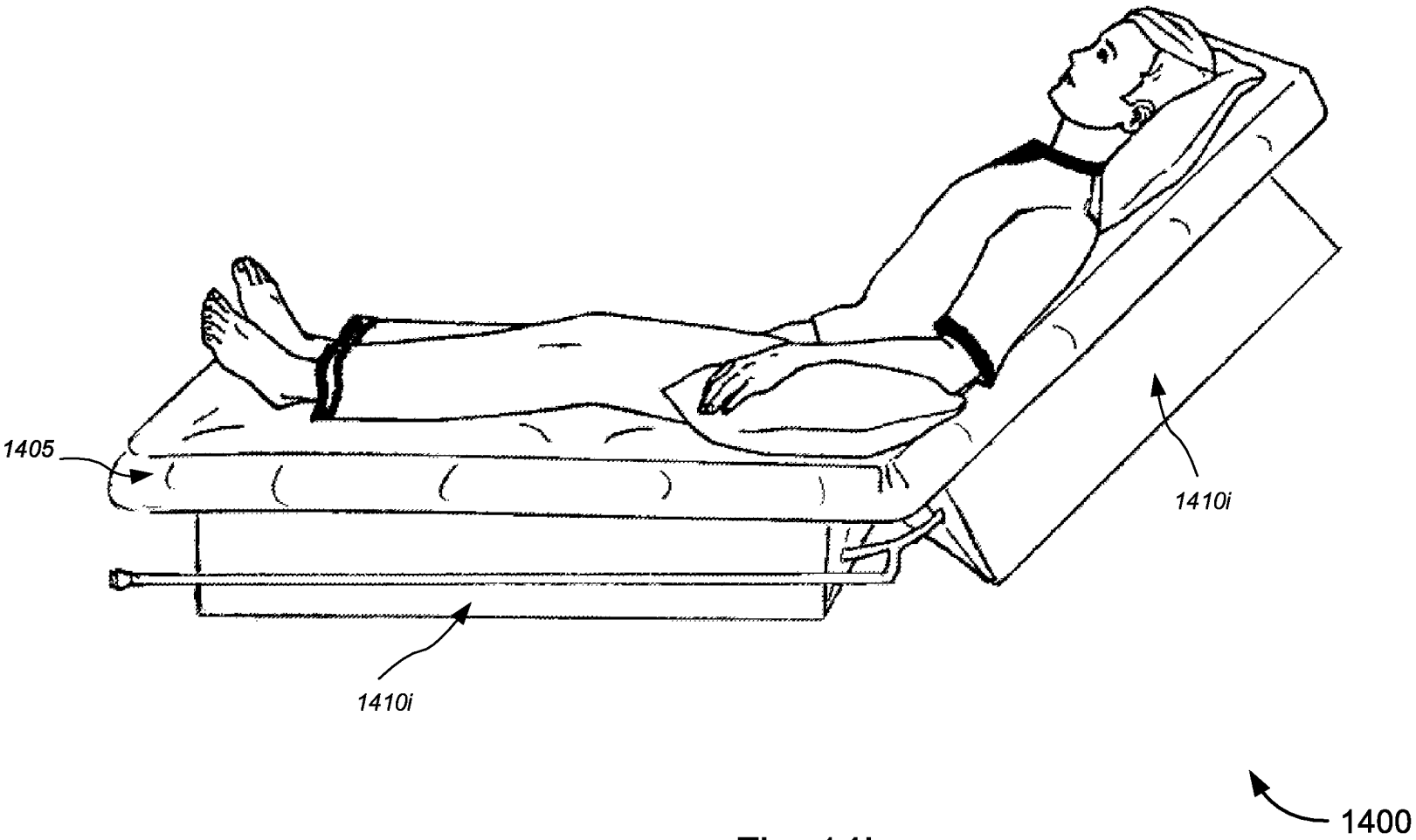

FIG. 14I shows the patient lifting and turning system 1400 having support structure 1405 in the Fowler's position, with each bladder pair 1410*i* inflated (right side bladder pair not shown).

Figure 15:
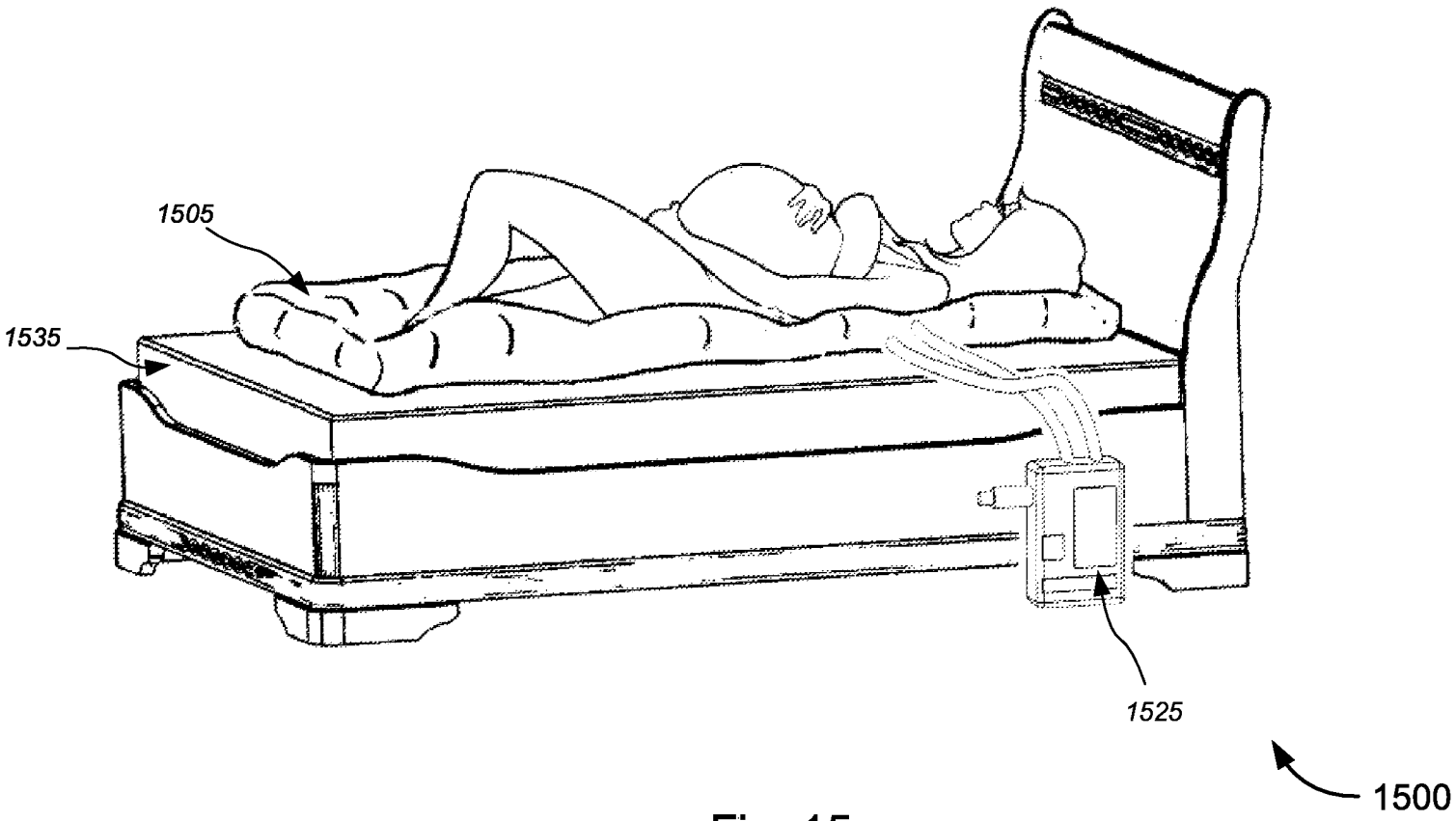
FIG. 15 is a general schematic diagram illustrating one embodiment of a bed-topper system for pregnant women.

FIG. 15 illustrates a patient turning and lifting system implemented as a bed-topper system 1500 for use by pregnant women or people with scoliosis. The bed-topper system 1500 comprises a support structure 1505 positioned on top of bed 1535. Support structure 1505 is operatively coupled to a vacuum controller 1525. A user is able to use vacuum controller 1525 to evacuate air from the support structure 1505 or to release the vacuum so as to let air back into support structure 1505. Thus, when support structure 1505 has air let in by vacuum controller 1525, the user is able to position her or his body on the support structure 1505. Once positioned, the user can use the vacuum controller 1525 to evacuate the air from the support structure 1505, allowing the support structure 1505 to conform around the user's body. When the user wishes to reposition the patient, vacuum controller 1525 can be used to release the vacuum in the support structure 1505, allowing the user to freely reposition her or his body and reshape the support structure 1505.

Figure 16:
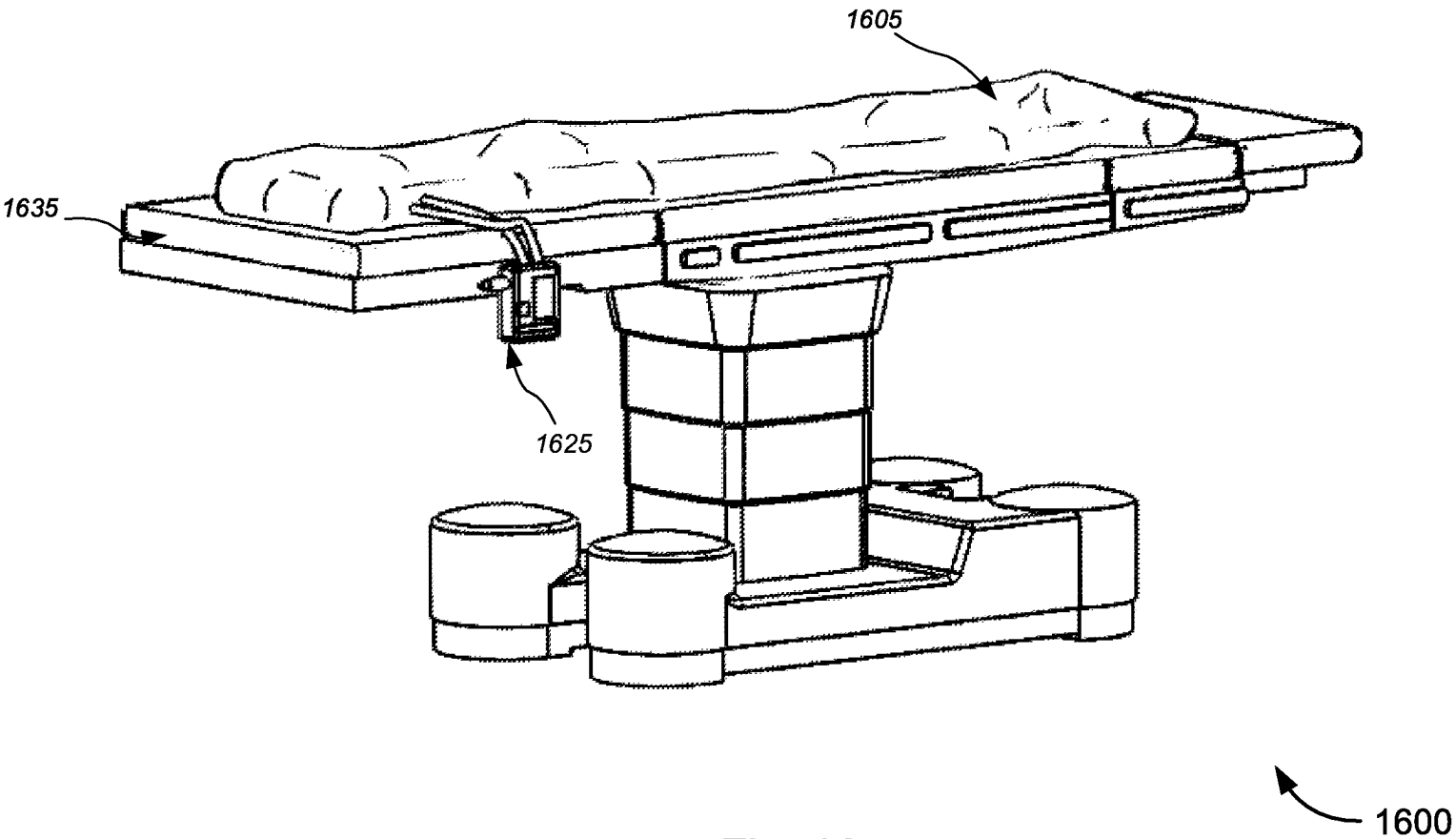
FIG. 16 is a general schematic diagram illustrating a patient positioner for an operating table, according to various embodiments.

FIG. 16 illustrates a patient turning and lifting system implemented as patient positioning system 1600 for use on an operating table 1635. The patient positioning system 1600 includes a support structure 1605 positioned on top of an operating table 1635. Support structure 1605 is operatively coupled to a vacuum controller 1625. A surgeon or an assistant may position the patient on support structure 1605 in a desired position for a specific operation. Once the patient is in position, the surgeon or assistant can use vacuum controller 1625 to evacuate air from support structure 1605, allowing the support structure to conform around the body of the patient, thus aiding in keeping the patient stationary in the desired position. When the patient needs to be repositioned, vacuum controller 1625 can be used to release the vacuum in the support structure 1605, allowing the patient to be repositioned as desired.

Figure 17:
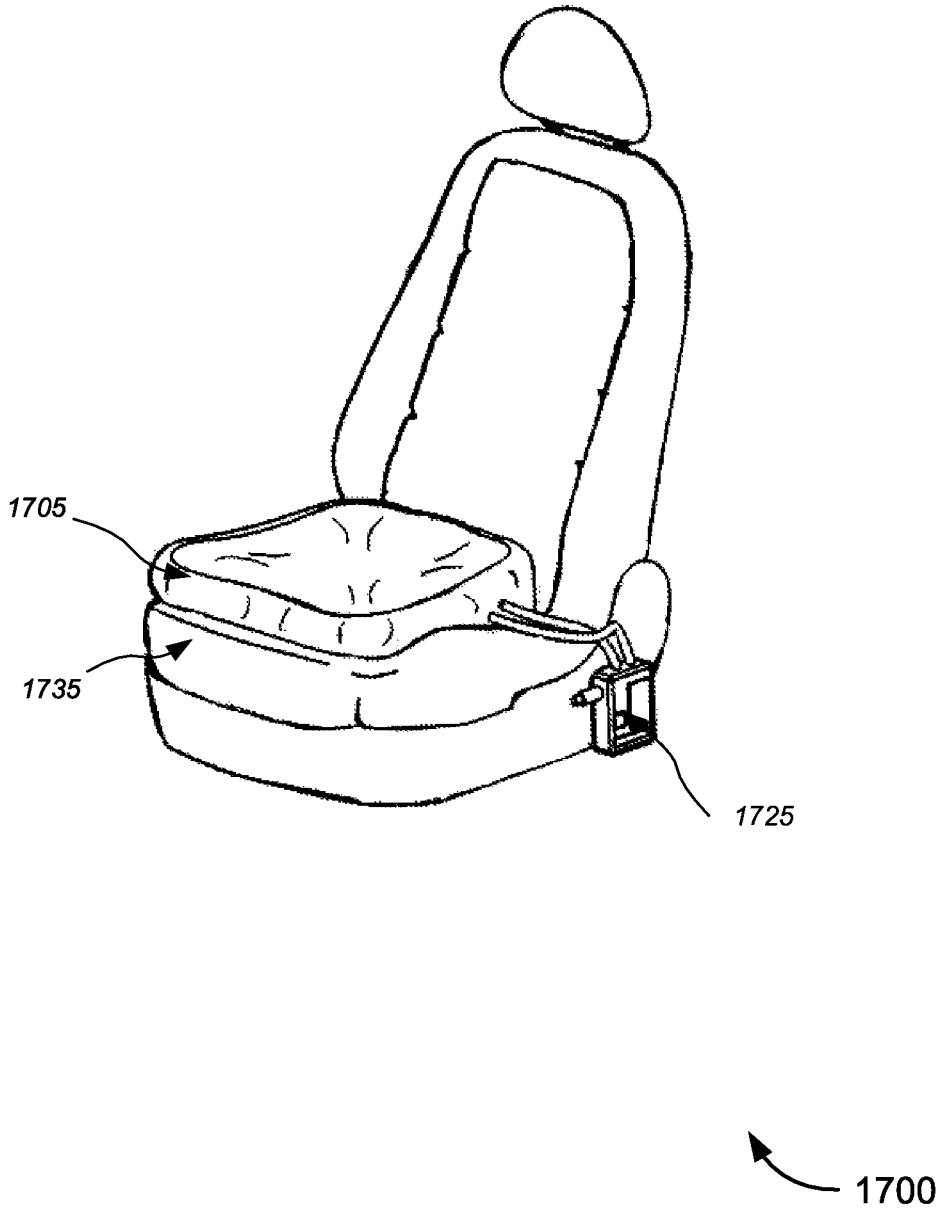
FIG. 17 is a general schematic diagram illustrating a car seat cushion, according to various embodiments.

FIG. 17 illustrates a car seat cushion system 1700 according to various embodiments. A car or truck seat 1735 is provided with a cushion 1705 that includes a plurality of particles. The cushion 1705 is operatively coupled to a vacuum controller 1725. In one embodiment, vacuum controller 1725 is operable using button controls. Vacuum controller 1725 allows the user to control air flow into and out of cushion 1705. This allows the user to find a comfortable position in the seat, and maintain that position. The particles in cushion 1705 conform to the user's body, and subsequently, the user can create a vacuum with vacuum controller 1725 so that cushion 1705 will maintain its shape and give support to the user's body. The vacuum controller 1725 can also release the vacuum for repositioning of the user's body.

Figure 18:
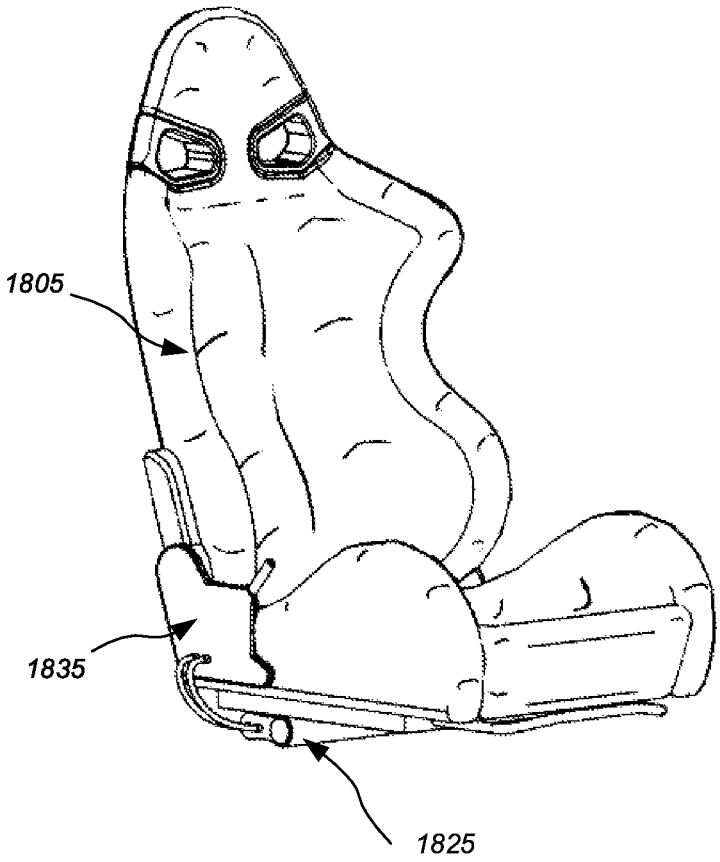
FIG. 18 is a general schematic diagram illustrating a racing or pilot seat, according to various embodiments.

FIG. 18 illustrates a racing or pilot seat system 1800 according to various embodiments. A racing car or fighter pilot seat 1835 uses cushioning 1805, that includes a plurality of particle, throughout the bucket/supporting structures of seat 1835. Cushioning 1805 is operatively coupled to vacuum controller 1825. Thus, cushioning 1805 is able to conform around all parts of the user's body in contact with the seat 1835, as opposed to just the cushion 1705 as in the car seat system 1700. Once positioned in the seat, the driver or pilot can use vacuum controller 1825 to vacuum out the air from cushioning 1805, allowing the cushion 1805 to maintain its conformed shape around the driver or pilot's body, and to provide support.

Figure 19A:
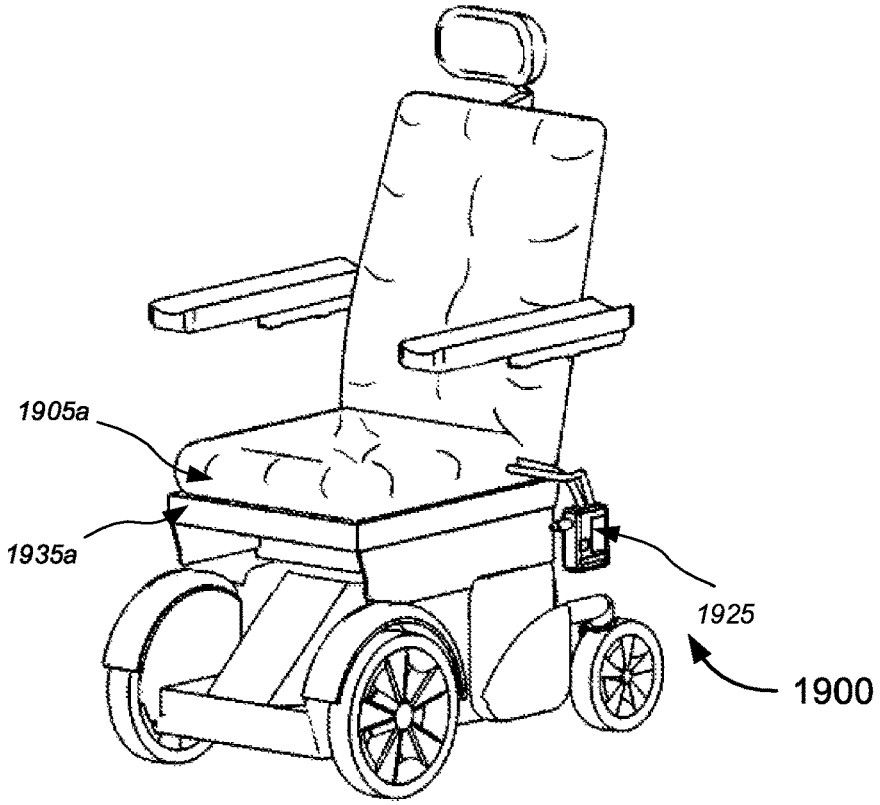
FIGS. 19A-19B are schematic diagrams illustrating a wheel chair pads according to various embodiments.
Figure 19B:
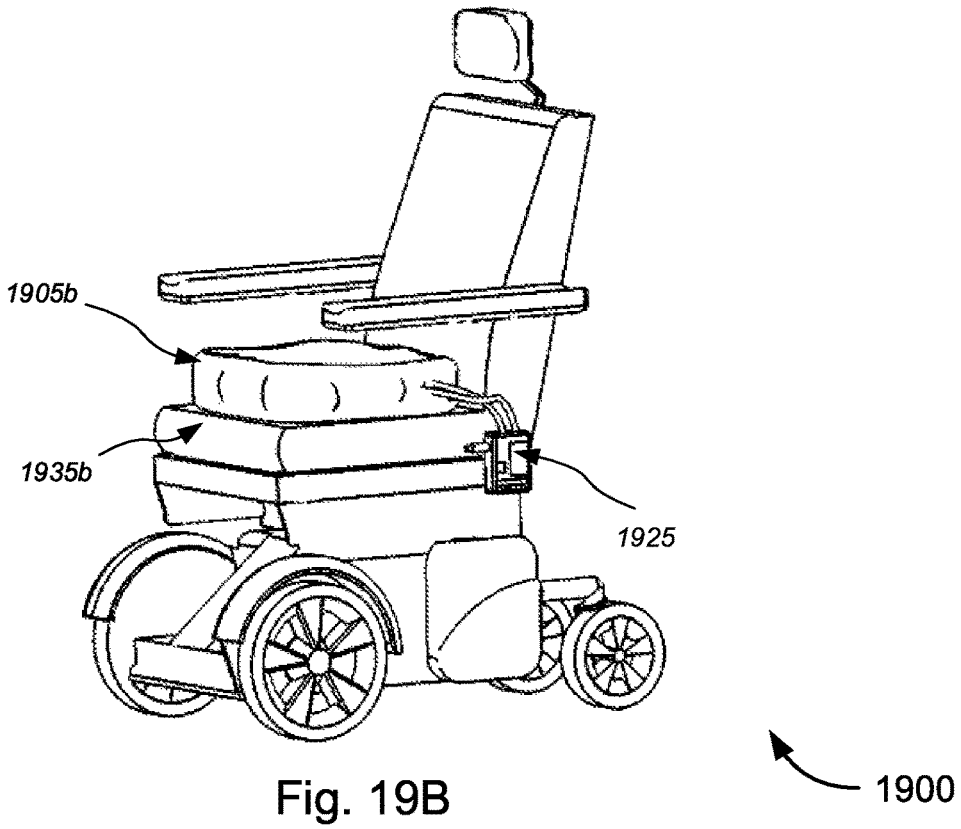

FIGS. 19A-19B illustrate wheel chair systems 1900 according to various embodiments. In FIG. 19A, cushioning 1905*a*, which includes a plurality of particles, is used throughout the seat support structures for the legs and back. The cushioning 1905*a* is incorporated into wheelchair frame 1935*a*, and operatively coupled to vacuum controller 1925. Thus, the cushioning 1905*a* is used to conform around all parts of the user's body in contact with the seat of the wheelchair, and maintain its shape once a vacuum is applied.

In FIG. 19B, a cushion 1905*b* is used, as opposed to cushioning 1905*a* incorporated into the actual wheelchair frame. Thus, cushion 1905*b* can be used with existing wheelchairs, 1935*b*. Cushion 1905*b* is operatively coupled to vacuum controller 1925. Thus, cushion 1905*b* conforms to the user's body and maintains its shape when a vacuum is applied via vacuum controller 1925.

Figure 20:
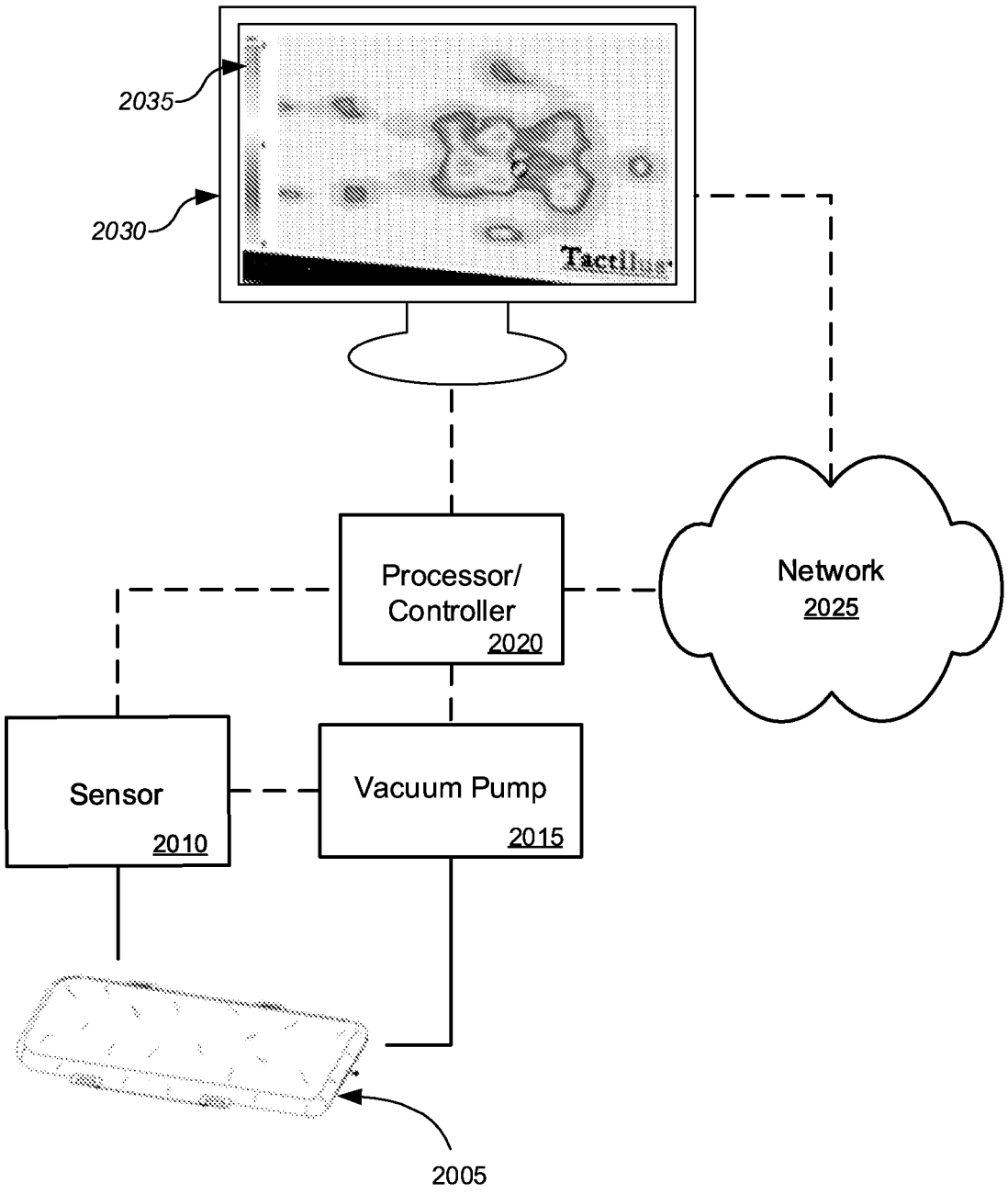
FIG. 20 is a system block diagram illustrating an embodiment of a support structure implementing a pressure mapping system.

FIG. 20 is a block diagram of a pressure mapping system 2000 according to various embodiments. In FIG. 20, a support/cushion 2005 is coupled to sensor 2010, which is a pressure sensor. Support 2005 is also coupled to vacuum pump 2015, the function of which is described above with respect to other embodiments. Sensor 2010 is optionally communicatively coupled to vacuum pump 2015. Both sensor 2010 and vacuum pump 2015 are also optionally in communicatively coupled to a processor/controller 2020. The processor/controller 2020 is optionally coupled to either display 2030 or network 2025. The display 2030 can also optionally be connected to the processor/controller 2020 via the network 2025.

The pressure mapping system 2000 is designed to measure pressure distribution and the magnitude of the pressure between the patient and the support 2005. In some embodiments, the sensor 2010 can be placed on top of support 2005. In other embodiments, the sensor 2010 can be a sleeve that goes over the support 2005, or be implemented directly into the surface or casing of the support 2005. As will be appreciated by one having skill in the art, the sensor 2010 can be any type of sensor suitable to sense pressure distribution, magnitude, and/or temperature. In some embodiments, sensor 2010 includes, but is not limited to, a piezo-resistive or a piezo-electric sensor. In one embodiment, the 2010 includes a matrix of piezo-resistive cells covering a detecting surface of support 2005, each piezo-resistive cell providing a discrete pressure analysis at that particular cell's location on support 2005. In other embodiments, sensor 2010 includes a combination temperature and pressure sensor. In such embodiments, sensor 2010 may include separate temperature and pressure sensing elements, or a single type of sensor 2010 may be used to detect both temperature and pressure.

As described previously with respect to FIG. 1, sensor 2010 may optionally be coupled to vacuum pump 2015. Vacuum pump 2015 may then inflate or deflate various areas of support 2005, or other inflatable structures such as bladders. The sensor 2010 may also optionally be coupled to a processor/controller 2020 that in turn controls the vacuum pump 2015.

Sensor 2010 captures data from the two-dimensional matrix of data points to create a pressure map of the detection surface of support 2005. The pressure map is indicative of a distribution and magnitude of pressure along the detection surface. In some embodiments, the pressure magnitude is indicated by a color scale. In further embodiments, each sensor element of sensor 2010 may be mapped to a point on the pressure map 2035 corresponding to a relative position on the detection surface of support 2005, thus creating a two-dimensional representation of the detection surface. The pressure map 2035 is then presented on a display 2030. The display 2030 may include any display capable of depicting or conveying such pressure map information. The display 2030 may include displays with or without touchscreen functionality. In some embodiments, the display 2030 may be directly coupled to the processor/controller 2020 that is directly coupled to the sensor 2010, thus presenting the pressure map as generated by the processor/controller 2020. In other embodiments, the display 2030 may be coupled to the processor/controller 2020 via network 2025. Network 2025 includes any network capable of communicating pressure map information to cause display 2030 to display pressure map 2035. Such network 2025 includes, but is not limited to, the internet, local area networks, personal area networks, and near-field communications. Network 2025 can include both wireless and wired networks. In various other alternative embodiments, the sensor 2010 may communicate with processor controller 2020 via network 2025, or may communicate directly with display 2030 or through a network 2025.

The information gathered from the pressure map 2035 can be used for a number of purposes, including anticipating a location on a patient where a pressure sore is likely to develop. In an embodiment where the support 2005 is a particle filled support that can be inflated and evacuated as described in any of the various embodiments described herein, a care giver can create a void under the patient by manipulating the particles in the support underlying the location. For example, the care giver could manually create the void by using a hand or by use one of the blocks for creating a void as described with reference to FIGS. 13A-13C. In some further embodiments, depressions could be made corresponding to local peaks of high relative pressure on the pressure map 2035. For example, in one embodiment, several displacing structures may be placed or embedded into the support structure at anticipated local peaks, and a patient may subsequently be placed upon the support structure. Then, based on the pressure map 2035, the displacing structures are repositioned in the support structure according to local peaks on a specific patient's pressure map 2035. In yet other embodiments, the displacement structures may be positioned in the support structure after a pressure map 2035 has been generated for the specific patient.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture but instead can be implemented on any suitable hardware, firmware and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

Example Embodiments

The below enumerated embodiments 1-51 are provided below for illustration purposes only and in no way limit the scope of the subject matter as defined in the claims. These embodiments include combinations, sub-combinations, and multiply dependent combinations as described below. Further, these embodiments may be deployed in other various combinations with any other of the various embodiments described below.

Embodiment 1 includes a patient turning and lifting device, including: two or more inflatable turning bladders; and a support structure positioned on the two or more inflatable turning bladders, the support structure including: an outer casing including an inner chamber filled with a plurality of particles; at least one contact surface configured to be in contact with a patient during use; wherein the outer casing is configured to be inflated and evacuated such that the outer casing is capable of being shapeable when inflated, and forms a resilient structure configured to hold its shape when evacuated; wherein during use the at least one contact surface conforms to the shape of at least one displacing structure, the plurality of beans displaced from around the at least one displacing structure leaving a depression on the at least one contact surface in the shape of the at least one displacing structure; wherein each of the two or more inflatable turning bladders are independently inflatable and deflatable from each other and the support structure.

Embodiment 2 includes the patient turning and lifting device of embodiment 1, further including: at least one pair of lifting straps configured to lie underneath the two or more inflatable turning bladders, and wherein the lifting straps are configured to support the patient and the patient turning and lifting device when lifted.

Embodiment 3 includes the patient turning and lifting device of any of embodiments 1-2, further including a disposable patient interface layer disposed on the support structure.

Embodiment 4 includes the patient turning and lifting device of embodiment 3, wherein the disposable patient interface layer includes a left wing portion and a right wing portion, wherein the support structure includes left and right sidewalls when air is evacuated from the support structure, wherein each of the left and right wing portions includes a pocket that fits over a corresponding one of the left and right sidewalls of the support structure to prevent the disposable patient interface layer from moving laterally with respect to the support structure during use.

Embodiment 5 includes the patient turning and lifting device of any of embodiments 3-4, wherein two or more of: the two or more inflatable turning bladders; the support structure; the at least one pair of lifting straps; and the disposable patient interface layer; are attachable to each other via one or more fasteners.

Embodiment 6 includes the patient turning and lifting device of embodiment 5, wherein the one or more fasteners include a releasable fastener selected from the group consisting of hook and loop fasteners, adhesives, buttons, and tabs.

Embodiment 7 includes the patient turning and lifting device of embodiment 5, wherein the one or more fasteners include a permanent fastener selected from the group consisting of adhesives, welding materials, stitching, and heat-activated sealants.

Embodiment 8 includes the patient turning and lifting device of any of embodiments 1-7, wherein the two or more inflatable turning bladders include at least one left inflatable turning bladder and at least one right inflatable turning bladder.

Embodiment 9 includes the patient turning and lifting device of embodiment 8, wherein each of the two or more inflatable turning bladders is configured to be jointly inflatable or jointly deflatable.

Embodiment 10 includes the patient turning and lifting device of any of embodiments 8-9, wherein each of the left and right inflatable turning bladders has a general cross-sectional shape selected from the group consisting of wedge, trapezoid, circle, oval, triangle, and irregular polygon.

Embodiment 11 includes the patient turning and lifting device of any of embodiments 8-10, wherein each of the left and right inflatable turning bladders includes a plurality of longitudinal chambers, one chamber being nested within an adjacent outer chamber, the plurality of longitudinal chambers being configured to be inflatable sequentially from an innermost chamber to an outermost chamber, and where the left and right inflatable turning bladders are configured such that less than all of the plurality of longitudinal chambers can be inflated during use.

Embodiment 12 includes the patient turning and lifting device of any of embodiments 8-11, wherein the at least one left inflatable turning bladder includes at least two separate left inflatable bladders, and the at least one right inflatable turning bladders includes at least two separate right inflatable bladders, the at least two separate left inflatable bladders and at least two separate right inflatable bladders configured to continue operating when the support structure is in a folded position.

Embodiment 13 includes the patient turning and lifting device of any of embodiments 1-12, wherein the support structure is configured such that when evacuated it brackets at least a torso of the patient without bracketing arms of the patient.

Embodiment 14 includes the patient turning and lifting device of any of embodiments 1-13, wherein support structure further includes a neck support structure when evacuated.

Embodiment 15 includes the patient turning and lifting device of any of embodiments 1-14, wherein, when air within the support structure is evacuated, the plurality of particles compact against each other to form a resilient structure including sidewalls.

Embodiment 16 includes the patient turning and lifting device of embodiment 15, wherein the plurality of particles are formed from a material selected from the group consisting of polystyrene, polyurethane, polyamide, polyethylene oxide, polyvinyl chloride, polypropylene, and polyacrylonitrile.

Embodiment 17 includes the patient turning and lifting device of any of embodiments 1-16, wherein the support structure includes a plurality of separate pockets, each pocket including a plurality of particles, wherein the plurality of separate pockets are configured such that, when air within the support structure is evacuated, the plurality of particles within the plurality of separate pockets are brought together to form a resilient structure including sidewalls.

Embodiment 18 includes the patient turning and lifting device of any of embodiments 1-17, wherein the support structure, includes a non-rigid, foldable structure when inflated and a resilient flat structure when evacuated, wherein the support structure further includes a first fastener on an upper surface thereof.

Embodiment 19 includes the patient turning and lifting device of any of embodiments 1-18, further including one or more resilient blocks each including a second fastener on one or more surfaces thereof, the first and second fasteners configured to couple to removably affix the one or more resilient blocks to the first fasteners on the upper surface of the support structure.

Embodiment 20 includes the patient turning and lifting device of embodiment 19, wherein each of the one or more resilient blocks is in a shape of a triangular prism having two triangular end surfaces and three rectangular side surfaces, wherein the second fastener is provided on two or more of the three rectangular side surfaces, wherein rotation of each the one or more resilient blocks from one of the two or more of the three rectangular side surfaces being in contact with the surface of the support structure to another of the two or more of the three rectangular side surfaces being in contact with the surface of the support structure causes a change in an angle of contact of the subject resilient block with a patient.

Embodiment 21 includes the patient turning and lifting device of any of embodiments 1-20, wherein the support structure, in a first state, includes a non-rigid, foldable structure, wherein, when air is evacuated from the support structure, while the patient is positioned on the at least one contact surface of the support structure, the support structure attains a second state having a resilient structure including a depression conforming to the body of the patient.

Embodiment 22 includes the patient turning and lifting device any of embodiments 1-21, further including: a patient leg turning device that includes at least one inflatable leg turning bladder, each configured to inflate and deflate concurrently with inflation and deflation of a corresponding one of the two or more inflatable turning bladders.

Embodiment 23 includes the patient turning and lifting device of any of embodiments 1-22, further including a rigid board disposed between the two or more inflatable turning bladders and the support structure.

Embodiment 24 includes the patient turning and lifting system of any of embodiments 1-23, further including one or more pumps coupled to the two or more inflatable turning bladders.

Embodiment 25 includes the patient turning and lifting system of any of embodiments 1-24, further including: one or more sensors configured to monitor: the one or more of pumps in fluid communication with the two or more inflatable bladders, or the support structure; at least one of the two or more inflatable turning bladders; or the support structure.

Embodiment 26 includes the patient turning and lifting system of embodiment 25, wherein the two or more inflatable turning bladders includes at least one left inflatable turning bladder and at least one right inflatable turning bladder, each of which is inflatable and deflatable by the one or more pumps in one or more predetermined sequences of inflation and deflation.

Embodiment 27 includes the patient turning and lifting system of embodiment 26, wherein the one or more predetermined sequences of inflation and deflation are controlled by a controller, and wherein the controller modifies the predetermined sequences of inflation and deflation based, at least in part, on measurements by the one or more sensors.

Embodiment 28 includes the patient turning and lifting system of any of embodiments 24-27, wherein the one or more pumps includes one or more fluid pumps that are configured to pump a fluid selected from the group consisting of air, carbon dioxide, nitrogen, water, organic liquids, inert gases, and gas mixtures other than air.

Embodiment 29 includes the patient turning and lifting system of any of embodiments 27-28, wherein the controller includes: one or more processors; a non-transitory computer readable medium having stored thereon software including a set of instructions that, when executed by at least one of the one or more processors, causes the patient turning and lifting system to perform one or more functions, the set of instructions including: instructions to inflate and deflate the at least one left and at least one right inflatable turning bladders in one or more predetermined sequence of inflation and deflation; instructions to monitor, via at least one of the one or more sensors, the two or more inflatable turning bladders, the one or more pumps, or the support structure; and instructions to modify the one or more predetermined sequences of inflation and deflation based at least in part on measurements by the one or more sensors.

Embodiment 30 includes the patient turning and lifting device of any of embodiments 25-29, wherein the one or more sensors further includes at least one sensor for detecting at least a pressure distribution and a pressure magnitude on a detecting surface.

Embodiment 31 includes the patient turning and lifting device of any of embodiments 25-30, wherein the at least one sensor is a piezo-resistive pressure sensor.

Embodiment 32 includes the patient turning and lifting device of any of embodiments 25-31, wherein the at least one sensor includes a temperature sensor.

Embodiment 33 includes the patient turning and lifting device of any of embodiments 25-32, wherein the at least one sensor includes a two-dimensional matrix of sensors.

Embodiment 34 includes the patient turning and lifting device of any of embodiments 25-33, further including: one or more processors; a display in communication with the one or more processors; a non-transitory computer readable medium having stored thereon software including a set of instructions that, when executed by at least one of the one or more processors, causes the patient turning and lifting system to perform one or more functions, the set of instructions including: instructions to receive pressure magnitude and pressure generation measurements from the at least one sensor; instructions to generate a pressure map depicting the pressure magnitude and pressure distribution at corresponding positions of the detecting surface; and instructions to render the pressure map on the display.

Embodiment 35 includes a support structure including: an outer casing including an inner chamber filled with a plurality of particles, at least one contact surface configured to be in contact with a patient during use, and at least one sensor for detecting at least a pressure distribution and a pressure magnitude coupled to the contact surface, wherein the outer casing is configured to be inflated and evacuated such that the outer casing is capable of being shapeable when inflated, and forms a resilient structure configured to hold its shape when evacuated, wherein during use the at least one contact surface conforms to the shape of at least one displacing structure, the plurality of particles displaced from around the at least one displacing structure leaving a depression on the at least one contact surface in the shape of the at least one displacing structure.

Embodiment 36 includes the support structure of embodiment 35, wherein the at least one displacing structure is the patient's body.

Embodiment 37 includes the support structure of any of embodiments 35-36, wherein the at least one displacing structure includes an at least one contour block configured to be positioned at desired positions along the at least one contact surface creating an at least one spot depression in the at least one contact surface.

Embodiment 38 includes the support structure of any of embodiments 35-37, wherein the outer casing is a mattress topper integrated into a mattress casing or a mattress topper separate from the mattress casing.

Embodiment 39 includes the support structure of any of embodiments 35-38, wherein the outer casing is coupled to an operating table.

Embodiment 40 includes the support structure of any of embodiments 35-39, wherein the outer casing includes seat cushioning.

Embodiment 41 includes the support structure of any of embodiments 35-40, wherein the outer casing forms a seat rest separate from a physical structure of a seat.

Embodiment 42 includes the support structure of any of embodiments 35-41, wherein the outer casing forms at least one of an armrest, backrest, or headrest of a seat.

Embodiment 43 includes the support structure of any of embodiments 35-42, wherein the at least one sensor is a piezo-resistive pressure sensor.

Embodiment 44 includes the support structure of any of embodiments 35-43, wherein the at least one sensor includes a temperature sensor.

Embodiment 45 includes the support structure of any of embodiments 35-44, wherein the at least one sensor includes a two-dimensional matrix of sensors.

Embodiment 46 includes the support structure of any of embodiments 35-45, further including: one or more processors; a display in communication with the one or more processors; a non-transitory computer readable medium having stored thereon software including a set of instructions that, when executed by at least one of the one or more processors, causes the support structure to perform one or more functions, the set of instructions including: instructions to receive pressure magnitude and pressure distribution measurements from the at least one sensor; instructions to generate a pressure map depicting the pressure magnitude and pressure distribution at corresponding positions of the detecting surface; and instructions to render the pressure map on the display.

Embodiment 47 includes a method of utilizing a support structure for positioning patients including: positioning a patient on a contact surface of the support structure, the support structure having a flexible state; creating a depression, with the patient's body, in the contact surface; evacuating an inner chamber of the support structure, thereby forming a resilient structure molded around the shape of the patient's body; and detecting at least a pressure distribution and a pressure magnitude coupled on the contact surface.

Embodiment 48 includes the method of embodiment 47 further including: positioning at least one displacing structure on the contact surface while in the flexible state; creating one or more relief depressions, with the at least one displacing structure, in the contact surface; and removing, after evacuation of the inner chamber, the at least one displacing structure from the contact surface.

Embodiment 49 includes the method of any of embodiments 47-48, wherein the patient's body is positioned over the contact surface with the displacing structures embedded within the contact surface.

Embodiment 50 includes the method of any of embodiments 47-49, further including: measuring, with at least one sensor, at least a pressure magnitude and pressure distribution on the contact surface; and adjusting a position of the at least one displacing structure on the contact surface at a local peak as determined by the pressure magnitude and pressure distribution.

Embodiment 51 includes the method of any of embodiments 47-50 further including: providing two or more inflatable turning bladders positioned below the support structure; and causing, via two or more inflatable turning bladders, the support structure to turn, wherein at least one of the two or more inflatable turning bladders are inflated independent of other inflatable turning bladders and the support structure, and wherein the support structure is in its resilient state supporting the patient.

Figure 21:
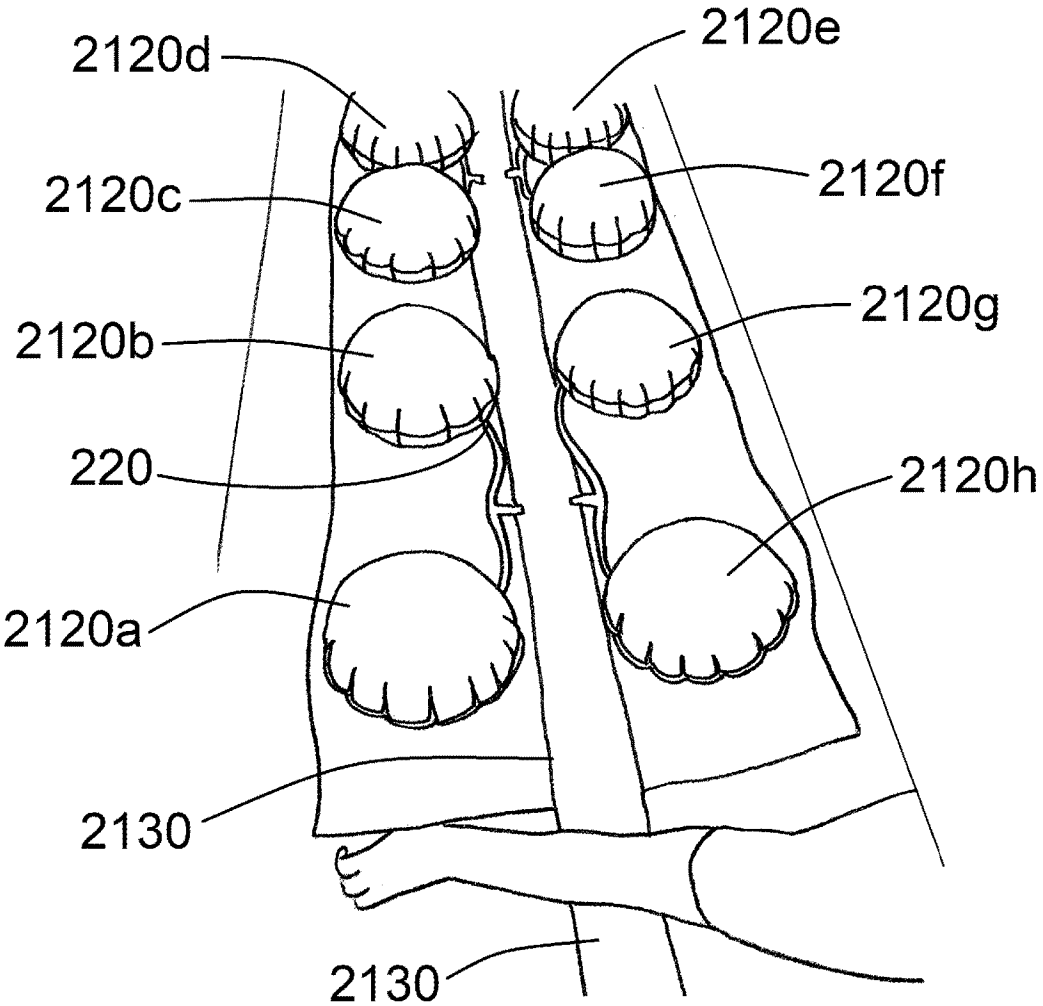
FIG. 21 illustrates a perspective view of an interior section of a patient turning and lifting mattress device having multiple turning bladders.

As shown in FIG. 21, in another embodiment, the patient turning and lifting mattress device 2110 may itself be a mattress having more than two turning bladders, and may comprise multiple turning bladders 2120*a*, 2120*b*, 2120*c*, 2120*d*, 2120*e*, 2120*f*, 2120*g*, 2120*h*, on both the left and right sides of the patent turning and lifting device 2110. As shown in FIG. 21, the multiple turning bladders 2120*a-h* may generally be round or spherical in shape, but other shapes and sizes of turning bladders may also be used herein. Additionally, FIG. 21 illustrates the multiple turning bladders 2120*a-h* as being spaced apart, however, the multiple turning bladders 2120*a-h* may also be placed more closely adjacent one another and may also be touching, directly adjacent, and/or overlapping one another, in some embodiments. In yet other embodiments, the multiple turning bladders 2120*a-h* may be spaced more closely together or overlap one another, where the bulk of a patient's body weight is located (such as the torso) and then may have greater spacing between bladders where there will be less patient weight (such as in the legs), for example.

Figure 22:
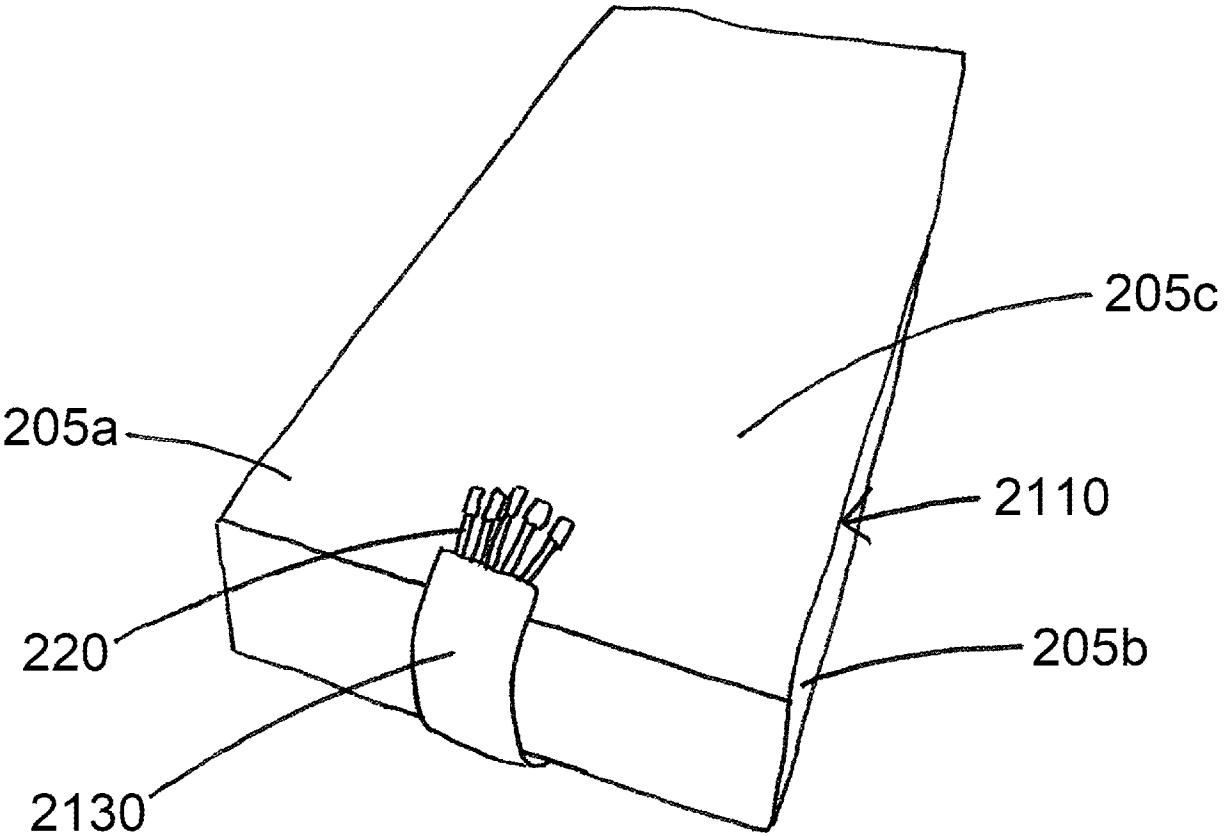
FIG. 22 illustrates a perspective view of the exterior of a patient turning and lifting mattress device having multiple fluid connection hoses.

Each of the multiple turning bladders 2120*a-h* may comprise a single or multiple fluid inflation chamber(s) coupled to a pump system 125 (as shown in FIG. 1) via one or more gas pump interfaces 220, as shown in FIG. 2C. As shown in FIGS. 21 and 22, each of the multiple turning bladders 2120*a-h* may include one or more gas pump interfaces 220 (including, for example, a gas or air nipple, a gas or air valve, a gas pipe, or the like) for interfacing with fluid hoses or pipes (also shown as 220) that connect to one or more pumps (e.g., fluid and/or vacuum pumps of pump system 125, as shown and described above). The gas pump interfaces 220, such as hoses or pipes, may run from each of the multiple turning bladders 2120*a-h* to a pump system 125, or alternatively, the hoses or pipes may connect multiple turning bladders 2120*a-h* together, such as connecting turning bladders 2120*a-h* on the left side and those on the right side to the pump system 125, or for connecting multiple turning bladders 2120*a-h* on one side (e.g., left or right) together with the pump system 125, for example.

Furthermore, the gas pump interfaces 220 (such as gas hoses or pipes, for example), may be enclosed within a protective sleeve 2130 or tab extending from one of the end walls or side walls 205*a* or 205*b*, of the patient turning and lifting mattress device 2110, best shown in FIG. 22. The protective sleeve 2130 protects the gas pump interfaces 220, such as pipes or hoses, where they exit the protection of the mattress device 2110 to couple to an external pump system 125. The protective sleeve 2130 surrounding the pump interfaces 220 (gas hoses or pipes, for example) may help to prevent crushing, twisting, kinking, tangling, pinching, and/or blockages of the gas hoses or pipes 220.

In the embodiment shown in FIG. 21, the multiple bladders 2120*a-h* may be built into, or integrally formed as a mattress, creating the patient tuning and lifting mattress device 2110 embodiment. As shown in FIG. 22, in this embodiment, the mattress device 2110 itself is also the support structure 205 having sidewalls 205*a*, 205*b*, and a flat upper main body portion 205*c*, on which the patient's body rests. The patient turning and lifting mattress device 2110 may also include a generally rectangular internal chamber, or multiple separate pockets and/or inner chambers, which also include a plurality of particles contained therein, as described above. Alternatively, the sidewalls 205*a*, 205*b*, and the flat upper main body portion 205*c* of the patient turning and lifting mattress device 2110 may form a generally rectangular internal chamber (except for the multiple turning bladders 2120*a-h*) including a plurality of particles contained therein, as described above.

Figure 23:
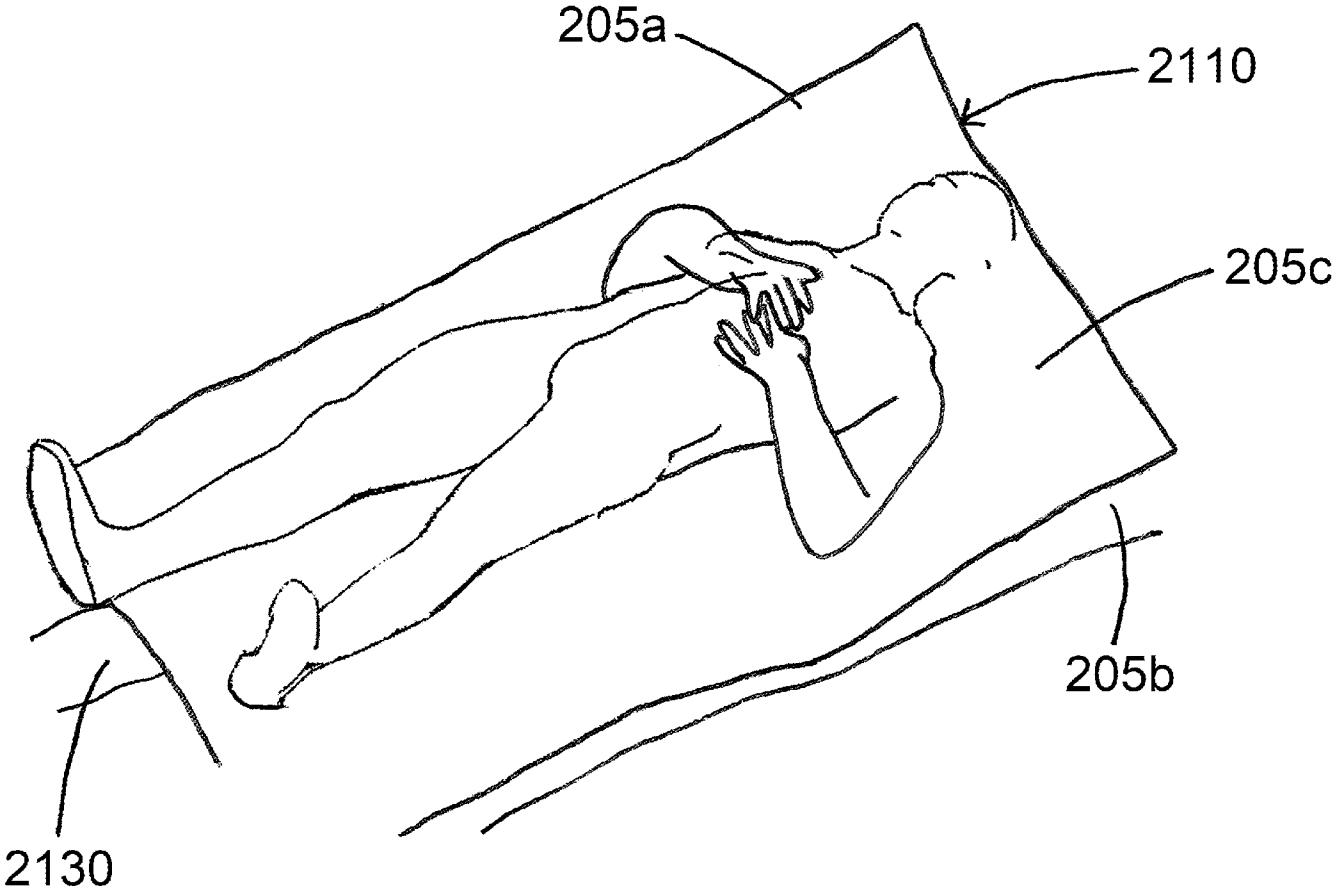
FIG. 23 illustrates a perspective view of a patient turning and lifting mattress device in use by a patient.
Figure 24:
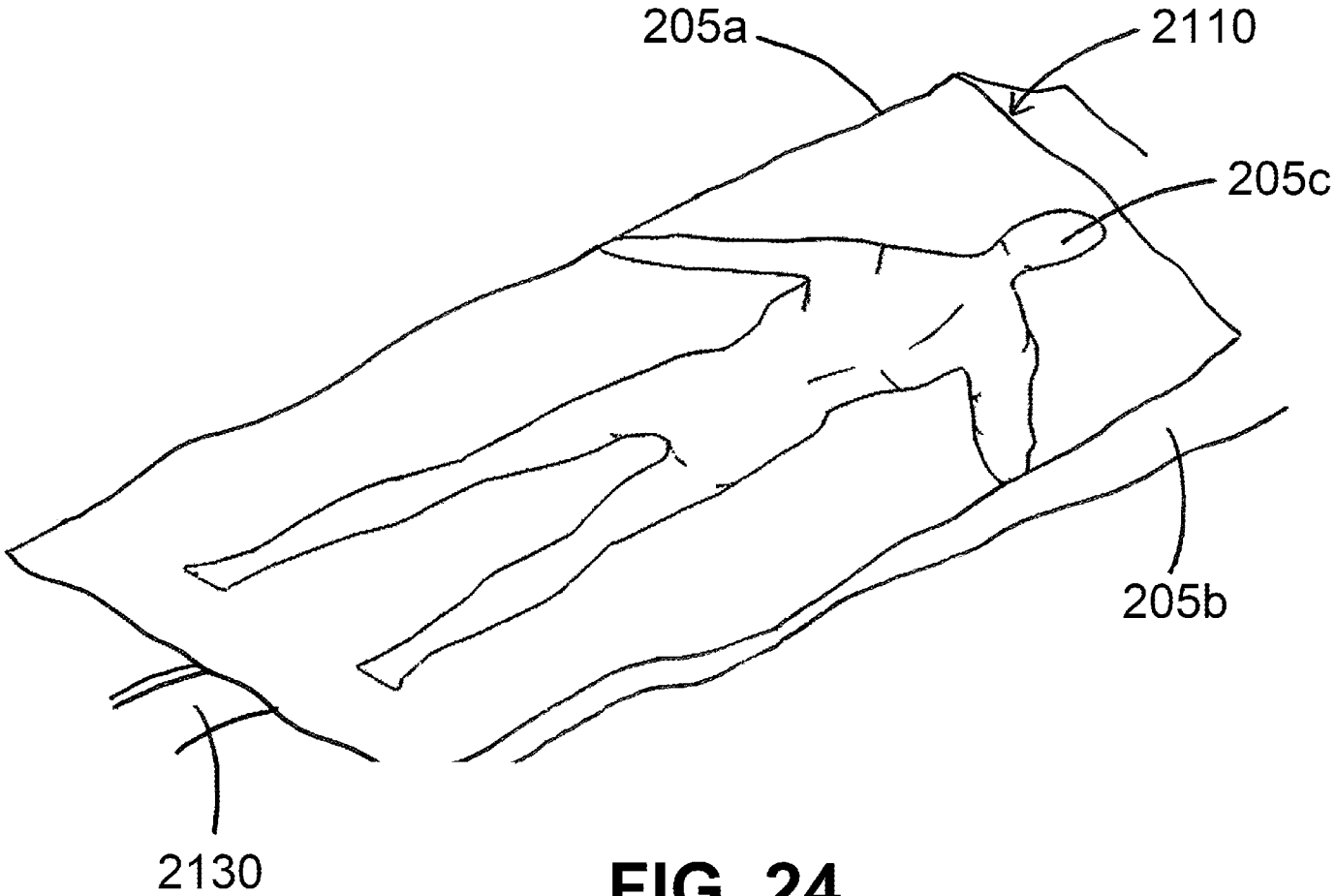
FIG. 24 illustrates a perspective view of a patient turning and lifting mattress device after being laid on by a patient and having conformed to the body contours of the patient.

In a first state, the integral support structure 205 of the patient turning and lifting mattress device 2110 is substantially flat or non-rigid (i.e., flexible or floppy), with air or gas held within the mattress device 2110, such that the plurality of particles within the internal chamber(s) and/or pockets (not shown) are free to move about the interior chamber(s) of the mattress device 2110 and/or are free to move relative to each other. FIGS. 22 and 23 illustrate this first state of the patient turning and lifting mattress device 2110 in its substantially flat or non-rigid state. In a second state, shown in FIG. 24, when the air or gas is caused to be evacuated from the internal chamber(s) or pockets (via vacuum pump system 125 and gas pump interfaces 220) the plurality of particles are forced to compact or compress against each other under negative pressure, forming a resilient and/or substantially rigid structure. After evacuation of the air or gas, under negative pressure, the resilient and/or substantially rigid mattress device 2110 generally holds the shape of the sidewalls 205*a* and 205*b*, while the flat upper main body portion 205*c* of the mattress device 2110 conforms to the shape of the patient's body, as shown in FIG. 24.

The embodiments shown and described in FIGS. 21-24 herein may also operate similarly to the embodiment shown and described in FIG. 2, wherein patient turning and lifting mattress device 2110 may also be operably coupled to a pump system 125 (including vacuum pump 125*c*), control device 135, processor/controller 140, display 145, storage device 150, input/output device 155, network interface device 160, sensor(s) 165, network 170, server 175, user device 180, and local and remote databases 185*a* and 185*b*, as described above.

While various embodiments of devices and systems and methods for using the same have been described in considerable detail herein, the embodiments are merely offered as non-limiting examples of the disclosure described herein. It will therefore be understood that various changes and modifications may be made, and equivalents may be substituted for elements thereof, without departing from the scope of the present disclosure. The present disclosure is not intended to be exhaustive or limiting with respect to the content thereof.

Further, in describing representative embodiments, the present disclosure may have presented a method and/or a process as a particular sequence of steps. However, to the extent that the method or process does not rely on the particular order of steps set forth therein, the method or process should not be limited to the particular sequence of steps described, as other sequences of steps may be possible. Therefore, the particular order of the steps disclosed herein should not be construed as limitations of the present disclosure. In addition, disclosure directed to a method and/or process should not be limited to the performance of their steps in the order written. Such sequences may be varied and still remain within the scope of the present disclosure.

The invention claimed is:

1. A patient turning and lifting mattress device, comprising:

a plurality of left inflatable turning bladders and a plurality of right inflatable turning bladders;

a mattress support structure positioned on the plurality of left and right inflatable turning bladders, comprising;

an outer mattress casing comprising an inner chamber filled with a plurality of particles; and at least one contact surface configured to be in contact with a patient during use;

wherein the outer mattress casing is configured to be inflated and evacuated such that the outer mattress casing is capable of being shapeable when inflated, and forms a resilient structure configured to hold its shape when evacuated;

wherein, during use, the at least one contact surface conforms to the shape of a body, the plurality of particles displaced from around the body leaving a depression on the at least one contact surface in the shape of the body; and wherein when in use by the patient, all of the plurality of left inflatable turning bladders in a region of the mattress configured to support a torso of the patient are spaced more closely together than all of the plurality of left inflatable turning bladders in a region of the mattress configured to support the legs of the patient.

2. The patient turning and lifting mattress device of claim 1, wherein each of the plurality of left turning bladders and right turning bladders has a general shape selected from the group consisting of wedge, trapezoid, circle, sphere, oval, triangle, and irregular polygon.

3. The patient turning and lifting mattress device of claim 1, wherein at least one of the plurality of left turning bladders and at least one of the plurality of right turning bladders are fluidly connected via one or more hoses.

4. The patient turning and lifting mattress device of claim 1, wherein the mattress support structure comprises a plurality of separate pockets, each pocket of the plurality of separate pockets comprising a plurality of particles, wherein the plurality of separate pockets are configured such that, when air within the mattress support structure is evacuated, the plurality of particles within the plurality of separate pockets are brought together by negative pressure to form a resilient structure comprising sidewalls.

5. The patient turning and lifting mattress device of claim 1, further comprising one or more sensors configured to monitor at least one of:

one or more pumps in fluid communication with the plurality of left and right inflatable turning bladders or the mattress support structure;

at least one of the plurality of left and right inflatable turning bladders; or the mattress support structure.

6. The patient turning and lifting mattress device of claim 5, wherein each of the plurality of left and right inflatable turning bladders is inflatable and deflatable by the one or more pumps in one or more predetermined sequences of inflation and deflation, wherein the one or more predetermined sequences of inflation and deflation are controlled by a controller, and wherein the controller modifies the predetermined sequences of inflation and deflation based, at least in part, on measurements by the one or more sensors.

7. The patient turning and lifting mattress device of claim 5, wherein the one or more sensors further comprises at least one sensor for detecting at least a pressure distribution and a pressure magnitude on a detecting surface.

8. The patient turning and lifting mattress device of claim 7, wherein the at least sensor is a piezo-resistive pressure sensor.

9. A patient turning and lifting device, comprising:

at least four inflatable left turning bladders and at least four inflatable right turning bladders;

a support structure positioned on the at least four inflatable left turning bladders and on the at least four inflatable right turning bladders, comprising;

an outer casing comprising an inner chamber filled with a plurality of particles; and at least one contact surface configured to be in contact with a patient during use;

wherein the outer casing is configured to be inflated and evacuated such that the outer casing is capable of being shapeable when inflated, and forms a resilient structure configured to hold its shape when evacuated;

wherein, during use, the at least one contact surface conforms to the shape of a body, the plurality of particles displaced from around the body leaving a depression on the at least one contact surface in the shape of the body; and wherein when in use by the patient, all of the bladders of the at least four left inflatable turning bladders in a region of the mattress configured to support a torso are spaced more closely together than the bladders of the at least four left inflatable turning bladders in a region of the mattress configured to support the legs of the patient.

10. The patient turning and lifting device of claim 9, wherein the support structure comprises a mattress.

11. The patient turning and lifting device of claim 9, wherein each of the at least four left and right inflatable turning bladders has a general shape selected from the group consisting of wedge, trapezoid, circle, sphere, oval, triangle, and irregular polygon.

12. The patient turning and lifting device of claim 9, wherein at least one of the left turning bladders and at least one of the right turning bladders are fluidly connected via one or more hoses.

13. The patient turning and lifting device of claim 9, wherein the support structure comprises a plurality of separate pockets, each pocket of the plurality of pockets comprising a plurality of particles, wherein the plurality of separate pockets are configured such that, when air within the support structure is evacuated, the plurality of particles within the plurality of separate pockets are brought together by negative pressure to form a resilient structure comprising sidewalls.

14. The patient turning and lifting device of claim 9, further comprising one or more sensors configured to monitor at least one of:

one or more pumps in fluid communication with the at least four left inflatable turning bladders, the at least four right inflatable turning bladders, or the support structure;

at least one of the left or right inflatable turning bladders; or the support structure.

15. The patient turning and lifting device of claim 14, wherein each of the at least four left and right inflatable turning bladders is inflatable and deflatable by the one or more pumps in one or more predetermined sequences of inflation and deflation, wherein the one or more predetermined sequences of inflation and deflation are controlled by a controller, and wherein the controller modifies the predetermined sequences of inflation and deflation based, at least in part, on measurements by the one or more sensors.

16. The patient turning and lifting device of claim 14, wherein the one or more sensors further comprises at least one sensor for detecting at least a pressure distribution and a pressure magnitude on a detecting surface.

17. The patient turning and lifting device of claim 16, wherein the at least sensor is a piezo-resistive pressure sensor.

18. A patient turning and lifting mattress device, comprising:

a plurality of left inflatable turning bladders and a plurality of right inflatable turning bladders;

a mattress support structure positioned on the plurality of left and right inflatable turning bladders, comprising;

an outer mattress casing comprising an inner chamber filled with a plurality of particles; and at least one contact surface configured to be in contact with a patient during use;

wherein the outer mattress casing is configured to be inflated and evacuated such that the outer mattress casing is capable of being shapeable when inflated, and forms a resilient structure configured to hold its shape when evacuated;

wherein, during use, the at least one contact surface conforms to the shape of a body, the plurality of particles displaced from around the body leaving a depression on the at least one contact surface in the shape of the body;

wherein each of the plurality of left and right inflatable turning bladders are independently inflatable and deflatable from each other and the mattress support structure; and wherein when in use by the patient, all of the plurality of left inflatable turning bladders in a region of the mattress configured to support a torso of the patient are spaced more closely together than the plurality of left inflatable turning bladders in a region of the mattress configured to support the legs of the patient and all of the plurality of right inflatable turning bladders in the region of the mattress configured to support the torso of the patient are spaced more closely together than the plurality of right inflatable turning bladders in the region of the mattress configured to support the legs of the patient.

* * * * *